US009829833B2

(12) United States Patent
Iwakawa et al.

(10) Patent No.: US 9,829,833 B2
(45) Date of Patent: Nov. 28, 2017

(54) IMAGE FORMING APPARATUS THAT SETS SPEEDS OF DRIVING SOURCES

(71) Applicant: CANON KABUSHIKI KAISHA, Tokyo (JP)

(72) Inventors: Tadashi Iwakawa, Iwakawa (JP); Koichi Taniguchi, Tokyo (JP); Takuya Matsumura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/057,542

(22) Filed: Mar. 1, 2016

(65) Prior Publication Data

US 2016/0259275 A1 Sep. 8, 2016

(30) Foreign Application Priority Data

Mar. 2, 2015 (JP) ..... 2015-040785

(51) Int. Cl.
*G03G 15/16* (2006.01)
*G03G 15/00* (2006.01)

(52) U.S. Cl.
CPC ..... *G03G 15/1615* (2013.01); *G03G 15/5008* (2013.01)

(58) Field of Classification Search
None
See application file for complete search history.

(56) References Cited

U.S. PATENT DOCUMENTS

2008/0298856 A1* 12/2008 Koike ..... G03G 15/167 399/302
2010/0008689 A1* 1/2010 Iwasaki ..... G03G 15/167 399/66
2010/0239293 A1* 9/2010 Ishizaki ..... G03G 15/161 399/66
2011/0026980 A1* 2/2011 Mizushima ..... G03G 15/161 399/301
2011/0129241 A1* 6/2011 Tomioka ..... G03G 15/5008 399/36

FOREIGN PATENT DOCUMENTS

JP 2006-243545 A 9/2006
JP 2009-222814 A 10/2009
JP 2015-040999 A 3/2015

* cited by examiner

*Primary Examiner* — Victor Verbitsky
(74) *Attorney, Agent, or Firm* — Fitzpatrick, Cella, Harper & Scinto

(57) ABSTRACT

An image forming apparatus includes an image bearing member, a toner image forming unit, an intermediary transfer member, a first driving source, a second driving portion, a speed instruction value changing portion, an executing portion for executing an operation in a detecting mode in a first detection period in a first state and in a second detection period in a second state larger in frictional force than in the first state, and a setting portion. In each of the first and second detection periods, the speed instruction value of the second driving source is set at a fixed value and the speed instruction value of the first driving source is successively changed to different values, and the setting portion sets the speed instruction value of the first driving source used during the image formation on the basis of a detection result in the detecting mode.

16 Claims, 29 Drawing Sheets

(a)

(b)

(a)

(b)

IMAGE FORMING APPARATUS THAT SETS SPEEDS OF DRIVING SOURCES

FIELD OF THE INVENTION AND RELATED ART

The present invention relates to an image forming apparatus, such as a copying machine, a printer or a facsimile machine, using an electrophotographic type or an electrostatic recording type.

Conventionally, in the image forming apparatus using the electrophotographic type or the electrostatic recording type, a toner image is formed by an appropriate image forming process on an image bearing member which is a drum-shaped or belt-shaped electrophotographic photosensitive member or electrostatic recording dielectric member. The toner image is directly transferred onto a recording material such as a recording paper (sheet) fed by a recording material carrying member or once primary-transferred onto an intermediary transfer member and then secondary-transferred onto the recording material. As a feeding member such as the recording material carrying member or the intermediary transfer member, a recording material carrying belt or an intermediary transfer belt each formed by an endless belt is used in many cases.

An electrophotographic image forming apparatus of an intermediary transfer type in which a drum-shaped photosensitive member (photosensitive drum) and an endless belt-shaped intermediary transfer member (intermediary transfer belt) are provided will be described as an example. In general, the photosensitive drum and the intermediary transfer belt are rotated at constant speeds so that a degree of expansion and contraction of an image is constant. In either of the photosensitive drum and the intermediary transfer belt, a speed accuracy thereof has the influence on reproducibility of an image finally formed on the recording material. Even the image exposure and contraction due to minute rotational speed non-uniformity appears as a density fluctuation non-uniformity which is called banding on the image on the recording material and causes an image deterioration. Further, conventionally, a tandem type in which a plurality of image forming portions for forming images of different colors, respectively, and an image is formed so as to transfer toner images superposedly from photosensitive drums of the image forming portions onto the intermediary transfer belt has been known. In the case of this tandem type, a speed fluctuation of each of the photosensitive drums causes a deviation from an original toner image forming position and a toner image transfer position, and a speed fluctuation of the intermediary transfer belt causes a deviation in transfer position of the toner image from each photosensitive drum onto the intermediary transfer belt. Further, on the image formed on the recording material, each of the color images appears in a deviated state from the original transfer position, i.e., as a so-called color misregistration, and thus leads to a factor of the image deterioration. When the color misregistration is about 100 μm in size, the color misregistration is at a level where it can be sufficiently recognized visually as the image deterioration. For that reason, inclusive of the above-described speed fluctuation and another factor, design is made so that for example the color misregistration is suppressed to several tens of μm or less.

In a driving device for rotationally driving the photosensitive drum or the intermediary transfer belt, PLL control using a brushless DC motor is frequently used. This method is such a method that control is effected so that a signal, having rotational speed information, called an FG signal showing a rotational position of the motor and a block externally provided are synchronized with each other. In this method, a stable clock signal having a constant cycle and a distance of rotation per constant cycle are synchronized with each other, so that a constant speed is obtained and a general-purpose driver IC becomes widespread, and therefore the method has been used in general.

At a driving portion for the photosensitive drum or the intermediary transfer belt, a motor output is converted into a low-speed high torque, and therefore gears with a reduction ratio are used at one stage or two stages in some cases. In such cases, due to eccentricity of the gears, even when a motor speed is made constant, in some cases, a speed of the photosensitive drum or a speed of a driving roller for the intermediary transfer belt does not become constant. Therefore, a method in which a speed of a load shaft (photosensitive drum, driving roller for the intermediary transfer belt) is subjected to feed-back control using an encoder without using constant-speed control of a driving motor is used.

However, the constant-speed control using the encoder on the load shaft is not equivalent to control in which a surface speed of the photosensitive drum is made constant at a target value, e.g., because there is a tolerance in diameter of the photosensitive drum. Similarly, the constant-speed control using the encoder on the load shaft is not equivalent to control in which a surface speed of the intermediary transfer belt is made constant at a target value, e.g., because there are tolerances in diameter of the driving roller for the intermediary transfer belt and in thickness of the intermediary transfer belt.

A target value of a speed difference between the photosensitive drum and the intermediary transfer belt is a target value of the encoder on the load shaft, and is set at 0-0.15%, for example, in some cases. However, the tolerances of a unit for rotationally driving the photosensitive drum and a unit for rotationally driving the intermediary transfer belt are accumulated, and in terms of a steady speed error, an error of the surface speed adjusting modes can reach ±0.15% in some cases. Further, the influence of the tolerances cannot be detected, and therefore it has become difficult to use a target value of the speed of the motor shaft or the speed of the encoder on the load shaft in place of the target value of the surface speed. Further, due to not only the tolerances but also a change in ambient environment temperature, outer diameters of the photosensitive drum and the driving roller for the intermediary transfer belt change, so that the surface speeds of the photosensitive drum and the intermediary transfer belt change from desired values in some cases. As a result, the surface speed difference between the photosensitive drum and the intermediary transfer belt becomes large, so that a degree of the speed non-uniformity between the photosensitive drum and the intermediary transfer belt becomes worse and thus degrees of the color misregistration and the banding become worse in some cases.

As a method of detecting the surface speeds of the photosensitive drum and the intermediary transfer belt, a method in which the photosensitive drum and the intermediary transfer belt are subjected to marking at regular intervals and a passing time of the marking is read by an optical sensor and a method using a Doppler speed meter would be considered. However, these methods lead to an increase in cost due to provision of the sensor or the speed meter.

In order to solve such problems, Japanese Laid-Open Patent Application (JP-A) 2006-243545 proposes the following method. That is, the rotational speed of the intermediary transfer belt is changed, and a load exerted on the photosensitive drum at that time is detected. Then, an inflection point in a graph showing a relationship between the speed of the intermediary transfer belt and the detected load of the photosensitive drum is regarded as a state in which the rotational speeds of the intermediary transfer belt and the photosensitive drum are equal to each other, and then the intermediary transfer belt is rotated and driven at a target speed obtained by providing the speed with a predetermined peripheral speed difference.

However, as in JP-A 2006-243545, a process of obtaining the inflection point of the graph obtained from the detected values is liable to be influenced by a detection error in a differential operation, so that accuracy is liable to lower.

Further, depending on a characteristic of the intermediary transfer belt, a frictional force with the photosensitive drum at an initial stage of use is small, so that in some cases, the frictional force with the photosensitive drum becomes large by repetitive use. In this case, even when the inflection point is intended to acquire the inflection point as in JP-A 2006-243545 when the frictional force at the initial stage of use of the intermediary transfer belt, the frictional force is small and therefore a detected load fluctuation relative to a change in surface speed difference is small, so that the inflection point cannot be acquired in some instances.

SUMMARY OF THE INVENTION

According to an aspect of the present invention, there is provided an image forming apparatus comprising: a rotatable image bearing member for bearing a toner image; a toner image forming unit for forming the toner image on the image bearing member; a rotatable intermediary transfer member, contacting the image bearing member at a transfer portion, for carrying the toner image transferred from the image bearing member at the transfer portion and then to be transferred onto a recording material; a first driving source for rotationally driving the image bearing member; a second driving source for rotationally driving the intermediary transfer member; a detecting portion for detecting information on an output torque of the first driving source or the second driving source; a changing portion for changing a speed instruction value of each of driving speeds of the first driving source and the second driving source; an executing portion for executing an operation in a detecting mode in which information on the output torque of the other driving source corresponding to the speed instruction value of one driving source is detected while driving the first driving source and the second driving source in a period other than during image formation, wherein the detecting mode includes a first detection period in which a state relating to a frictional force between the image bearing member and the intermediary transfer member at the transfer portion is set at a first state and then the detection is made, and includes a second detection period in which the state is set at a second state larger in the frictional force than in the first state and then the detection is made, and wherein in each of the first and second detection periods, the speed instruction value of the other driving source is set at a fixed value and the speed instruction value of the one driving source is successively changed to a plurality of different values; and a setting portion for setting the speed instruction value of the one driving source used during the image formation on the basis of a detection result in the detecting mode.

According to another aspect of the present invention, there is provided an image forming apparatus comprising: a plurality of rotatable image bearing members for bearing toner images; a plurality of toner image forming units for forming the toner images on the plurality of image bearing members, respectively; a rotatable intermediary transfer member, contacting the plurality of image bearing members at a plurality of transfer portion, respectively, for carrying the toner images transferred from the image bearing members at the plurality of transfer portions and then to be collectively transferred onto a recording material; a plurality of first driving sources for rotationally driving the plurality of image bearing members, respectively; a second driving source for rotationally driving the intermediary transfer member; a detecting portion for detecting information on an output torque of the plurality of first driving sources or the second driving source; a changing portion for changing a speed instruction value of each of driving speeds of the plurality of first driving sources and the second driving source; an executing portion for executing an operation in a detecting mode in which information on the output torque of the second driving source corresponding to the speed instruction value of a specific first driving source of the plurality of first driving sources is detected while driving the plurality of first driving sources and the second driving source in a period other than during image formation, wherein the detecting mode includes a first detection period in which a state relating to a frictional force between a specific image bearing member corresponding to the specific first driving source and the intermediary transfer member at the transfer portion is set at a first state and then the detection is made, and includes a second detection period in which the state is set at a second state larger in the frictional force than in the first state and then the detection is made, and wherein in each of the first and second detection periods, the speed instruction value of the second driving source is set at a fixed value and the speed instruction value of the specific first driving source is successively changed to a plurality of different values; and a setting portion for setting the speed instruction value of the specific first driving source used during the image formation on the basis of a detection result in the detecting mode.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Structure and Operation of Image Forming Apparatus

Figure 1:
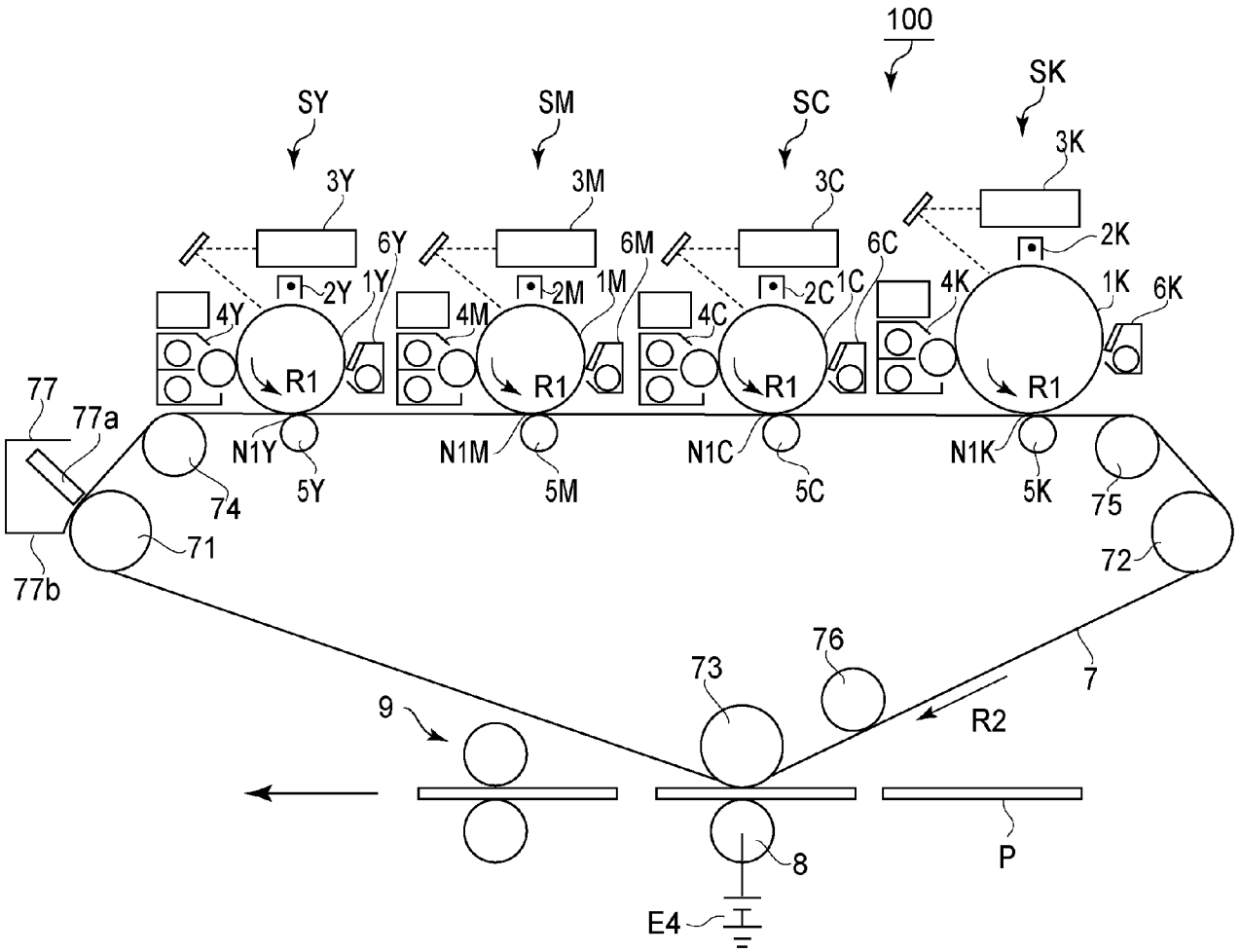
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type printer which is capable of forming a full-color image using an electrophotographic type and which employs an intermediary transfer type.

Figure 2:
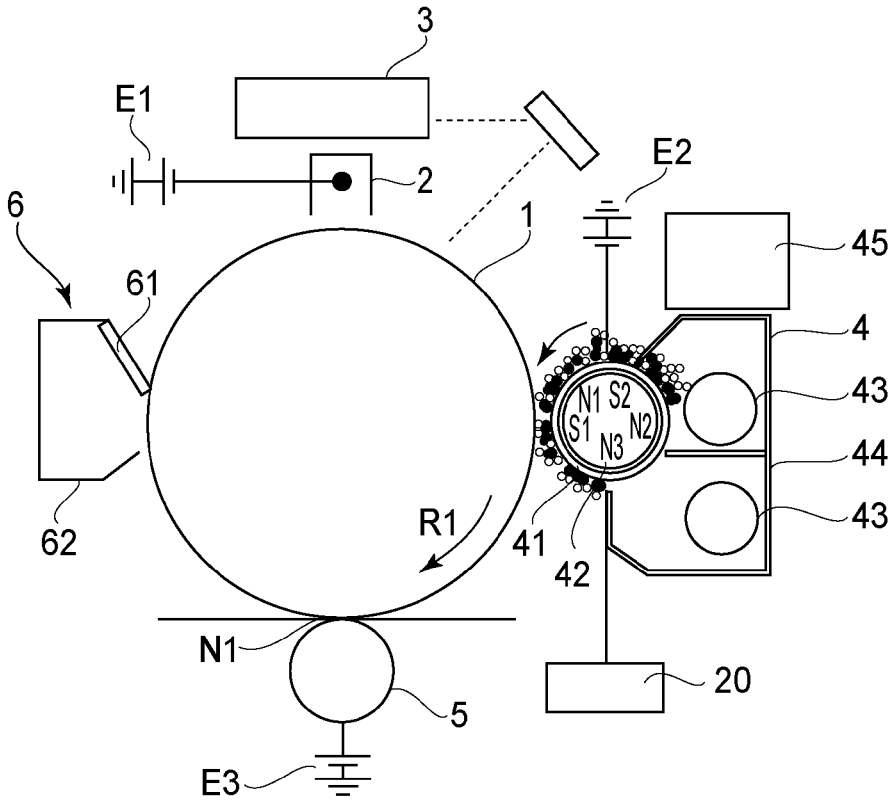
FIG. 2 is a schematic sectional view of an image forming portion.

The image forming apparatus 100 includes, as a plurality of image forming portions, first to fourth image forming portions (stations) SY, SM, SC and SK for forming images of yellow (Y), magenta (M), cyan (C) and black (K), respectively. Incidentally, in the case where particular distinction is not required for elements having substantially the same functions and constitutions at the image forming portions SY, SM, SC and SK suffixes Y, M, C and K for representing elements for associated image forming portions, respectively, are omitted, and the elements will be collectively described. Further, in order to distinguish the image forming portions SY, SM, SC and SK and their elements, description is made by adding prefixes Y, M, C and K in some cases. FIG. 2 is a schematic sectional view of the image forming portion S.

At the image forming portion S, a photosensitive drum 1 which is a drum-shaped (cylindrical) electrophotographic photosensitive member as a rotatable image bearing member for bearing (carrying) a toner image is provided. The photosensitive drum 1 is rotationally driven in an arrow R1 direction. At a periphery of the photosensitive drum 1 in the image forming portion S, the following process devices are provided. First, a charger (corona electric discharge generating device) 2 as a charging means is disposed. Next, an exposure device (laser scanner device) 3 as an exposure means is disposed. Next, a developing device 4 as a developing means is disposed. Next, a primary transfer roller 5 which is a roller-shaped primary transfer member as a primary transfer means is disposed. Next, a drum cleaning device 6 as a photosensitive member cleaning means is disposed. In this embodiment, the charger 2, the exposure device 3, the developing device 4 and the like constitute a toner image forming means for forming a toner image on the image bearing member.

Further, the image forming apparatus 100 includes an intermediary transfer belt ("ITB") 7 constituted by an endless belt as an intermediary transfer member is disposed opposed to the photosensitive drums 1 of the image forming portions SY, SM, SC and SK. The intermediary transfer belt 7 is an example of a rotatable feeding member, in contact with the image bearing member, onto which the toner image is transferred from the image bearing member. The intermediary transfer belt 7 is stretched by, as a plurality of stretching rollers (supporting rollers), a driving roller 71, a tension roller 72, a secondary transfer opposite roller 73, and first, second and third idler rollers 74, 75 and 76. In an inner peripheral (back) surface side of the intermediary transfer belt 7, at positions opposing the photosensitive drums 1, the above-described transfer primary rollers 5 are disposed. Each of the primary transfer rollers 5 is urged (pressed) against the intermediary transfer belt 7 toward the associated photosensitive drum 1, so that a primary transfer portion (primary transfer nip) N1 which is a contact portion between the intermediary transfer belt 7 and the photosensitive drum 1 is formed. In an outer peripheral (front) surface side of the intermediary transfer belt 7, at a position opposing the secondary transfer opposite roller 73, a secondary transfer roller 8 which is a roller-shaped secondary transfer member at a secondary transfer means is disposed. The secondary transfer roller 8 is urged (pressed) against the intermediary transfer belt 7 toward the secondary transfer opposite roller 73, so that a secondary transfer portion (secondary transfer nip) N2 which is a contact portion between the intermediary transfer belt 7 and the secondary transfer roller 8 is formed. The intermediary transfer belt 7 is rotationally driven in an arrow R2 direction in the figure by the driving roller 71. The tension roller 72 imparts a predetermined tension (tensile force) to the intermediary transfer belt 7. The secondary transfer opposite roller 73 backs up the secondary transfer roller 8 when the toner image formed on the intermediary transfer belt 7 is transferred onto the recording material P.

The first and second idler rollers 74 and 75 adjust an attitude of the intermediary transfer belt 7 so as to maintain each of the primary transfer portions N1 in a substantially rectilinear shape. The third idler roller 76 adjusts the attitude of the intermediary transfer belt 7 so that the recording material P can enter the secondary transfer portion N2 along the intermediary transfer belt 7. Further, in the outer peripheral surface side of the intermediary transfer belt 7, at a position opposing the driving roller 71, a belt cleaning device 77 as an intermediary transfer belt cleaning means is disposed.

The image forming apparatus 100 further includes a feeding (supplying) device (not shown) for feeding (supplying) the recording material P such as a recording sheet to the secondary transfer portion N2, a fixing device 9 for fixing an image on the recording material P, and the like.

During image formation, a surface of the rotationally driven photosensitive drum 1 is electrically charged uniformly by the charger 2 to a predetermined polarity (negative in this embodiment) and a predetermined potential. At this time, to the charger 2, from a charging voltage source E1 as a charging voltage applying means, a predetermined charging voltage (charging bias) is applied. The charged surface of the photosensitive drum 1 is irradiated (scanning exposure) with laser light modulated depending on an image information signal by the exposure device 3, so that an electrostatic latent image (electrostatic image) is formed on the surface of the photosensitive drum 1. The electrostatic latent image formed on the photosensitive drum 1 is developed (visualized) with a toner into a toner image by the developing device 4. In this embodiment, the developing device 4 uses, as a developer, a two-component developer containing a non-magnetic toner and a magnetic carrier (low-magnetization high-resistance carrier). The non-magnetic toner is constituted by using a binder resin such as styrene resin or polyester resin, a colorant such as carbon black, a dye or a pigment, a parting agent such as a wax, a charge control agent, and the like in appropriate amounts. Such a non-magnetic toner can be manufactured by an ordinary method such as a pulverizing method or a polymerizing method. As shown in FIG. 2, the developing device 4 includes a developing sleeve 41 as a developer carrying member, a magnet roller 42 disposed as a magnetic field generating means at a hollow portion of the developing sleeve 41, a stirring and feeding member 43 for stirring and feeding the developer, a developing container 44 for accommodating the developer, and the like. The toner is triboelectrically charged by being stirred and fed in the developing device 4 together with the carrier. In this embodiment, a charge polarity (normal charge polarity) of the toner during development is negative. The developing sleeve 41 is rotationally driven by a developing (sleeve) driving portion 20 as a developing (sleeve) driving means. The developing device 4 constrains the developer (the carrier on which the toner is deposited) on the developing sleeve 41 by a magnetic force generated by the magnet roller 42 and feeds the developer to an opposing portion (developing portion) between the photosensitive drum 1 and the developing sleeve 41. To the developing sleeve 41, from a developing voltage source E2 as a developing voltage applying means, a predetermined developing voltage (developing bias) is applied. As a result, the charged toner is transferred onto the photosensitive drum 1 by a potential difference between the photosensitive drum 1 and the developing sleeve 41, so that the electrostatic latent image on the photosensitive drum 1 is visualized. To the developing device 4, a toner in an amount equal to an amount of the toner consumed in the image formation is supplied from a toner supplying tank 45.

The toner image formed on the photosensitive drum 1 is electrostatically transferred (primary-transferred) at the primary transfer portion N1 onto the rotationally driven intermediary transfer belt 7 by the action of the primary transfer roller 5. At this time, to the primary transfer roller 5, from a primary transfer voltage source E3 as a primary transfer voltage applying means, a primary transfer voltage (primary transfer bias) which is a DC voltage of an opposite polarity to the normal charge polarity of the toner is applied.

For example, during full-color image formation, the color toner images of yellow, magenta, cyan and black formed on the photosensitive drums 1Y, 1M, 1C and 1K are successively transferred superposedly onto the intermediary transfer belt 7 at the primary transfer portions N1.

The toner image transferred on the intermediary transfer belt 7 is electrostatically transferred (secondary-transferred) onto the recording material P, and sandwiched and fed between the intermediary transfer belt 7 and the secondary transfer roller 8, by the action of the secondary transfer roller 8. At this time, to the secondary transfer roller 8, from a secondary transfer voltage source E4 as a secondary transfer voltage applying means, a secondary transfer voltage (secondary transfer bias) which is a DC voltage of an opposite polarity to the normal charge polarity of the toner is applied. The recording material P is fed to the secondary transfer portion N2 in synchronism with the toner image on the intermediary transfer belt 7 by a feeding device (not shown).

The recording material P on which the toner image is transferred is fed to the fixing device 9 and is heated and pressed by the fixing device 9, so that the toner image is fixed on the recording material P. Thereafter, the recording material P is discharged to an outside of an apparatus main assembly of the image forming apparatus 100.

Further, a toner (transfer residual toner) remaining on the surface of the photosensitive drum 1 after a primary transfer step is removed from the surface of the photosensitive drum 1 by a drum cleaning device 6 and is collected. The drum cleaning device 6 scrapes off the transfer residual toner from the surface of the rotating photosensitive drum 1 by a cleaning blade 61 as a cleaning member disposed in contact with the photosensitive drum 1, and accommodates the toner in a collecting container 62. The toner (secondary transfer residual toner) remaining on the surface of the intermediary transfer belt 7 after the secondary transfer step is removed from the surface of the intermediary transfer belt 7 by a belt cleaning device 77 and is collected. The belt cleaning device 77 scrapes off the secondary transfer residual toner or the like from the surface of the rotating intermediary transfer belt 7 by a cleaning blade 77*a* as a cleaning member disposed in contact with the intermediary transfer belt 7, and accommodates the toner in a collecting container 77*b*.

Figure 3:
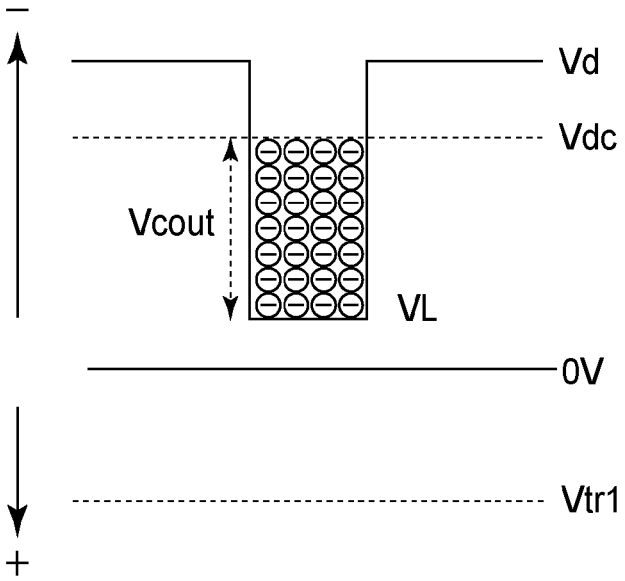
FIG. 3 is an illustration of a potential relationship among respective portions during image formation.

FIG. 3 is a schematic view showing a potential relationship among respective portions in the above-described image forming process. In this embodiment, the toner image is formed on the photosensitive drum 1 by image portion exposure and reverse development. That is, the surface of the photosensitive drum 1 is charged by the charger 2 to a predetermined negative potential (charge potential) Vd, and a potential (exposed portion potential) VL at a portion where the photosensitive drum 1 is exposed by the exposure device 3 is discharged toward a 0 V-side. In this embodiment, as an example, a charge potential Vd is −700 V and the exposed portion potential V1 is −200 V. The developer containing the toner triboelectrically charged to the negative polarity in the developing device 4 is fed to the neighborhood of the photosensitive drum 1 by the developing sleeve 41. At this time, a developing bias (DC component) Vdc applied to the developing sleeve 41 is a potential between the charge potential Vd and the exposed portion potential VL. In this embodiment, as an example, the developing bias Vdc is −550 V. The toner negatively charged on the developing sleeve 41 moves to the portion having the exposed portion potential VL relatively closer to a positive potential than the charge potential Vd and the developing bias Vdc until the potential at the portion becomes the same potential as the developing bias Vdc. That is, the toner in an amount corresponding to a developing latent image potential (developing contrast) Vcont which is a difference between the developing bias Vdc and the exposed portion potential VL is placed on the photosensitive drum 1. Incidentally, by adjusting the developing latent image potential Vcont, an image density can be adjusted. Then, the negatively charged toner moved onto the photosensitive drum 1 is transferred onto the intermediary transfer belt 7 at the toner portion N1 by a pressure and an electric field force between the toner roller 5 and the intermediary transfer belt 7. At this time, to the primary transfer roller 5, a primary transfer bias Vtr1 of the opposite polarity to the normal charge polarity of the toner is applied. In this embodiment, as an example, the primary transfer bias Vtr1 is +1500 V.

The image forming apparatus 100 in this embodiment is capable of forming not only the full-color image but also a monochromatic image such as a black (single color) image, and in that case, the image is formed by the above-described image forming process only at the image forming portion for a necessary color. Further, in this embodiment, as the photosensitive drum PK at the K image forming portion SK, a photosensitive drum having an outer diameter larger than those of other photosensitive drums 1Y, 1M and 1C is provided. This is because in the case where the black (single color) image formation is effected in addition to the full-color image formation, early end of a lifetime of the photosensitive drum 1K at the K image forming portion SK is suppressed. However, the present invention is not limited thereto, but the outer diameters of all of the photosensitive drums 1 may also be substantially the same.

2. Operation Sequence

Next, an operation sequence of the image forming apparatus 100 in this embodiment will be described taking a sequence during printing on 2 sheets as an example.

The operation sequence of the image forming apparatus 100 roughly includes operations such as a pre-rotation, image formation, a sheet interval and a post-rotation. The pre-rotation operation refers to an operation in which drive and high voltage application of respective portions are turned on and placed in a stable state in order to execute an image forming operation. The image forming operation refers to an operation for actually performing formation of the electrostatic latent image, formation of the toner image, and primary transfer of the toner image. The sheet interval is a period corresponding to an interval between recording materials P when images are continuously formed on a plurality of recording materials P, and refers to a period in which no image formation is made. The post-rotation operation refers to an operation for turning off the drive and the high-voltage application of the respective portions with no problem. During the image formation is during image formation, and a period other than during the image formation is during non-image formation and includes a period in which the respective operations of the pre-rotation, the sheet interval and the post-rotation are performed. In the pre-rotation operation, first, the drive of the photosensitive drum 1 and the intermediary transfer belt 7 is started. The photosensitive drum 1 and the intermediary transfer belt 7 are relatively large in inertia, and therefore, for example, it takes a time of 500 msec from start of the drive until the speed reaches a target speed at which the drum or the belt can be stably subjected to rotation control at a constant speed. A driving method of the photosensitive drum 1 and the intermediary transfer belt 7 will be described later. Thereafter, when the photosensitive drum 1 and the intermediary transfer belt 7 can be subjected to the rotation control at the constant speed, charging bias application is started. The primary transfer bias is turned on at arbitrary timing after the charging portion on the photosensitive drum 1 reaches the primary transfer portion N1. The rotational drive (developing (sleeve) drive) and the developing bias may only be required so that the rotational speed and the bias reach a desired rotational speed and a desired bias before the electrostatic latent image formed on the photosensitive drum 1 reaches the developing portion. However, these may desirably be turned on at late timing to the possible extent in order to suppress a deterioration of the developer. In the image forming operation, the charged photosensitive drum 1 is exposed to light by the exposure device 3, and the electrostatic latent image is formed and then is visualized as the toner image at the developing portion. Thereafter, this toner image is transferred onto the intermediary transfer belt 7 at the primary transfer portion N1. At the sheet interval, the exposure by the exposure device 3 is turned off, but the drive and the biases at the respective portions are maintained in the states during the image formation. In the post-rotation, the exposure, the developing drive, the developing bias, the primary transfer bias and the charging bias are turned off in the listed order, and thereafter the drive of the photosensitive drum 1 and the intermediary transfer belt 7 is stopped.

3. Surface Speeds of Photosensitive Drum and Intermediary Transfer Belt

Next, the surface speed of the photosensitive drum 1 and a target surface speed of the intermediary transfer belt 7 will be described.

From the viewpoint of an image quality, in the case where the surface speeds of the photosensitive drum 1 and the intermediary transfer belt 7 coincide with each other, the toner image is transferred without being rubbed, and therefore thin line reproducibility is high. However, such a phenomenon which is so-called white void that a central portion of an image such as a character or a line results in a white hollow portion where the toner image is not transferred can be reduced by providing a surface speed difference between the photosensitive drum 1 and the intermediary transfer belt 7.

Further, from the viewpoint of a mechanical mechanism, when a magnitude relationship between the surface speeds of the photosensitive drum 1 and the intermediary transfer belt 7 is replaced in alternating manner by a tolerance such as eccentricity or circularity, drive transmission becomes incontinuous due to play of a gear and a coupling, so that constant-speed rotation is adversely affected. For that reason, it is preferable that the surface speed difference is provided to the extent that the magnitude relationship between the surface speeds of the photosensitive drum 1 and the intermediary transfer belt 7 is not replaced.

Conventionally, in order to satisfy these requirements, the speed difference between the photosensitive drum 1 and the intermediary transfer belt 7 was set at about 0.3% in terms of a target value of the encoder on the load shaft. This value is a value determined so that a degree of image deterioration falls within a range of satisfying requirement specification for a product even when there is a tolerance of driving mechanisms for the photosensitive drum 1 and the intermediary transfer belt 7.

On the other hand, in order to improve a transfer property onto the recording materials P of various species, as the intermediary transfer belt 7, a multi-layer elastic belt in which an elastic rubber is attached to a surface, onto which the image is to be transferred, of a polyimide belt is used in some cases. The multi-layer elastic belt is liable to cause a large frictional force generating between the photosensitive drum 1 and the intermediary transfer belt 7 due to a surface speed difference therebetween when the multi-layer elastic belt is used as the intermediary transfer belt 7 since a contact portion with the photosensitive drum 1 is the elastic rubber. This frictional force acts as an outer disturbance and has the adverse influence on the image quality by increasing a degree of speed non-uniformity of each of the photosensitive drum 1 and the intermediary transfer belt 7. This is also true for the case where the frictional force between the photosensitive drum 1 and the intermediary transfer belt 7 is large even in the case where the intermediary transfer belt 7 is not the multi-layer elastic belt. Further, depending on the species of the intermediary transfer belt 7, the frictional force with the photosensitive drum 1 at an initial stage of use is small, but by respective use, the frictional force with the photosensitive drum 1 becomes large in some cases. Also in this case, similarly, when the intermediary transfer belt 7 is repetitively used, the frictional force has the adverse influence on the image quality.

As described above, in recent years, the speeds of the photosensitive drum 1 and the intermediary transfer belt 7 have been desired to be set at target values at which a surface speed difference therebetween is small and a surface speed magnitude relationship is not replaced due to the tolerances. For example, a target value of the speed difference between the photosensitive drum 1 and the intermediary transfer belt 7 is 0-0.15% in terms of a target value of the encoder on the load shaft.

4. Speed Control of Photosensitive Drum and Intermediary Transfer Belt

Next, a basic speed control method of the photosensitive drum 1 and the intermediary transfer belt 7 will be described.

Figure 4:
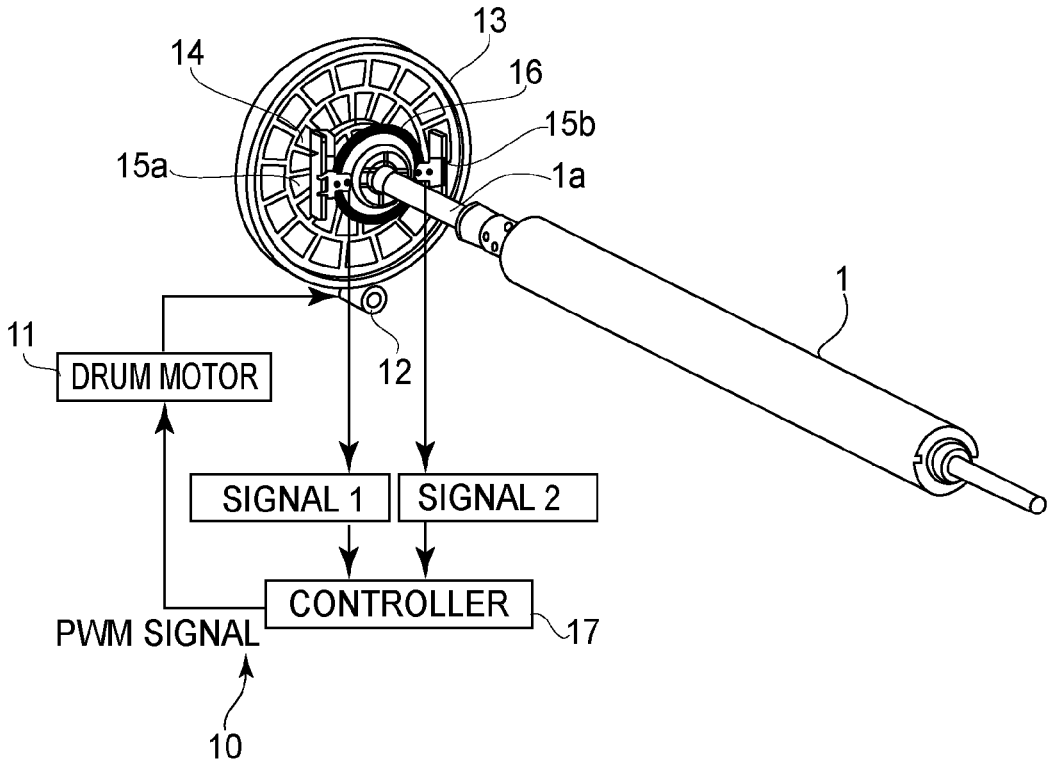
FIG. 4 is an illustration of a drum driving portion.

FIG. 4 shows a drum driving portion 10 as a first driving means in this embodiment. In this embodiment, basic constitution and operation of the drum driving portion 10 are the same among the respective image forming portions SY, SM, SC and SK. The drum driving portion 10 includes a drum driving motor 11 as a driving source, a motor gear 12 as a drive output member and a drum driving gear 13 as a drive transmission member. Further, the drum driving portion 10 includes an encoder 14 as a speed detecting means for detecting the speed of a driving shaft (load shaft) 1*a* of the photosensitive drum 1 and a speed (control) controller (control circuit) 17 for controlling the drum driving motor 11 on the basis of a detection result of the encoder. The encoder 14 is constituted by including encoder sensors 15*a* and 15*b* and a code wheel 16. The photosensitive drum 1 is rotationally driven by the drum driving motor 11. The code wheel 16 of the encoder 14 is mounted on the driving shaft 1*a* of the photosensitive drum 1, and rotation (rotational direction, rotational position, rotational speed) of the code wheel 16 is monitored by the two encoder sensors 15*a* and 15*b*. The encoder sensors 15*a* and 15*b* count the speed of the driving shaft 1*a* of the photosensitive drum 1 as pulses, and input the pulses as speed detection signals 1 and 2 into the speed controller 17. The speed controller 17 effects feed-back control operation (computation) on the basis of the speed detection signals 1 and 2, and outputs a PWM signal which is a drive instruction (command) to the drum driving motor 11.

Figure 5:
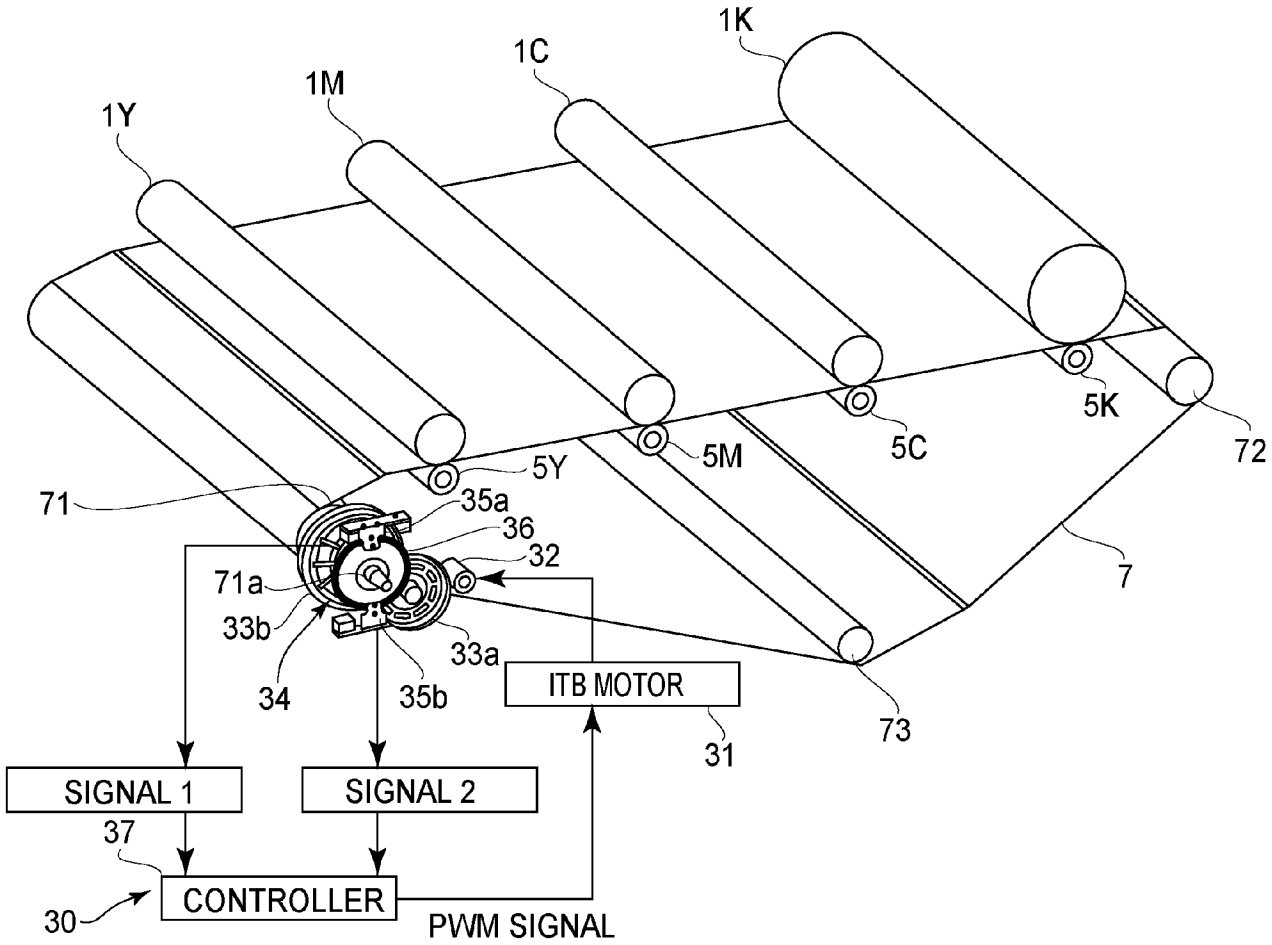
FIG. 5 is an illustration of an ITB (intermediary transfer belt) driving portion.

FIG. 5 shows an ITB driving portion 30 as a second driving means in this embodiment. The intermediary transfer belt driving portion 30 includes an ITB driving motor 31 as a driving source, a motor gear 32 as a drive output member and ITB driving gears 33*a* and 33*b* as drive transmission members. Further, the ITB driving portion 30 includes an encoder 34 as a speed detecting means for detecting a speed of a driving shaft (load shaft) 71*a* of a driving roller 71 constituting a driving shaft (load shaft) of the intermediary transfer belt 7. Further, the ITB driving portion 30 includes a speed (control) controller (control circuit) 37 for controlling the ITB driving motor 31 on the basis of a detection result of the encoder. The encoder 34 is constituted by including encoder sensors 35*a* and 35*b* and a code wheel 36. The intermediary transfer belt 7 is moved by rotationally driving the driving roller 71 by the drum driving motor 31, whereby drive thereof is transmitted and the intermediary transfer belt 7 is fed. The code wheel 36 of the encoder 34 is mounted on the driving shaft 71*a* of the driving belt 71, and rotation (rotational direction, rotational position, rotational speed) of the code wheel 36 is monitored by the two encoder sensors 35*a* and 35*b*. The encoder sensors 35*a* and 35*b* count the speed of the driving shaft 71*a* of the driving roller 71 as pulses, and input the pulses as speed detection signals 1 and 2 into the speed controller 37. The speed controller 37 effects feed-back control operation (computation) on the basis of the speed detection signals 1 and 2, and outputs a PWM signal which is a drive instruction (command) to the ITB driving motor 31.

5. Control Mode

Figure 6:
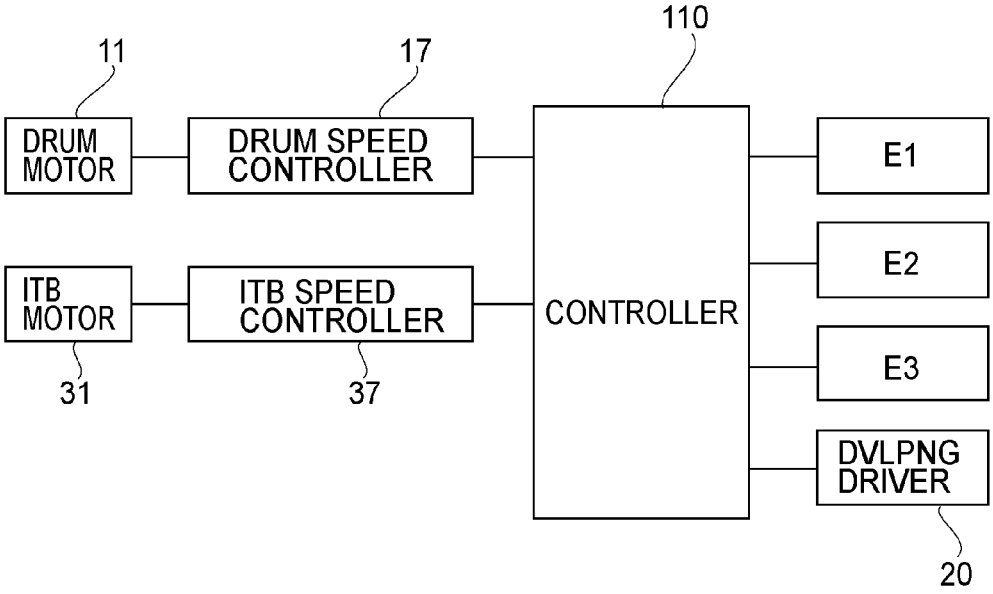
FIG. 6 is a schematic control block diagram of a principal part of the image forming apparatus.

FIG. 6 is a block diagram showing a schematic control mode of a principal part of the image forming apparatus 100 in this embodiment. The image forming apparatus 100 is provided with a controller 110 as a control means for effecting integrated control of the respective portions of the image forming apparatus 100. The controller 110 is constituted by including CPU which is a central element (unit) for performing computation (operation), memories, such as ROM and RAM, which are storing elements (storing portions), and the like. In the RAM, a detection result of the sensors, a computation result, and the like are stored, and in the ROM, a control program, a data table acquired in advance, and the like are stored. In this embodiment, the charging voltage source E1, the developing voltage source E2, the primary transfer voltage source E3, the speed controller 17 for the drum driving portion 10, the speed controller 37 for the ITB driving portion 30, and the like are connected with the controller 110. Further, in this embodiment, the controller 110 executes an operation in a speed instruction value adjusting mode described later.

Incidentally, in FIG. 6, the speed controller 17 and the drum driving motor 11 of the drum driving portion 10 are illustrated as those only for one image forming portion S, but in this embodiment, these members are provided correspondingly to each of the image forming portions SY, SM, SC and SK as described above.

6. Speed Instruction (Command) Value Adjusting Mode

Figure 7:
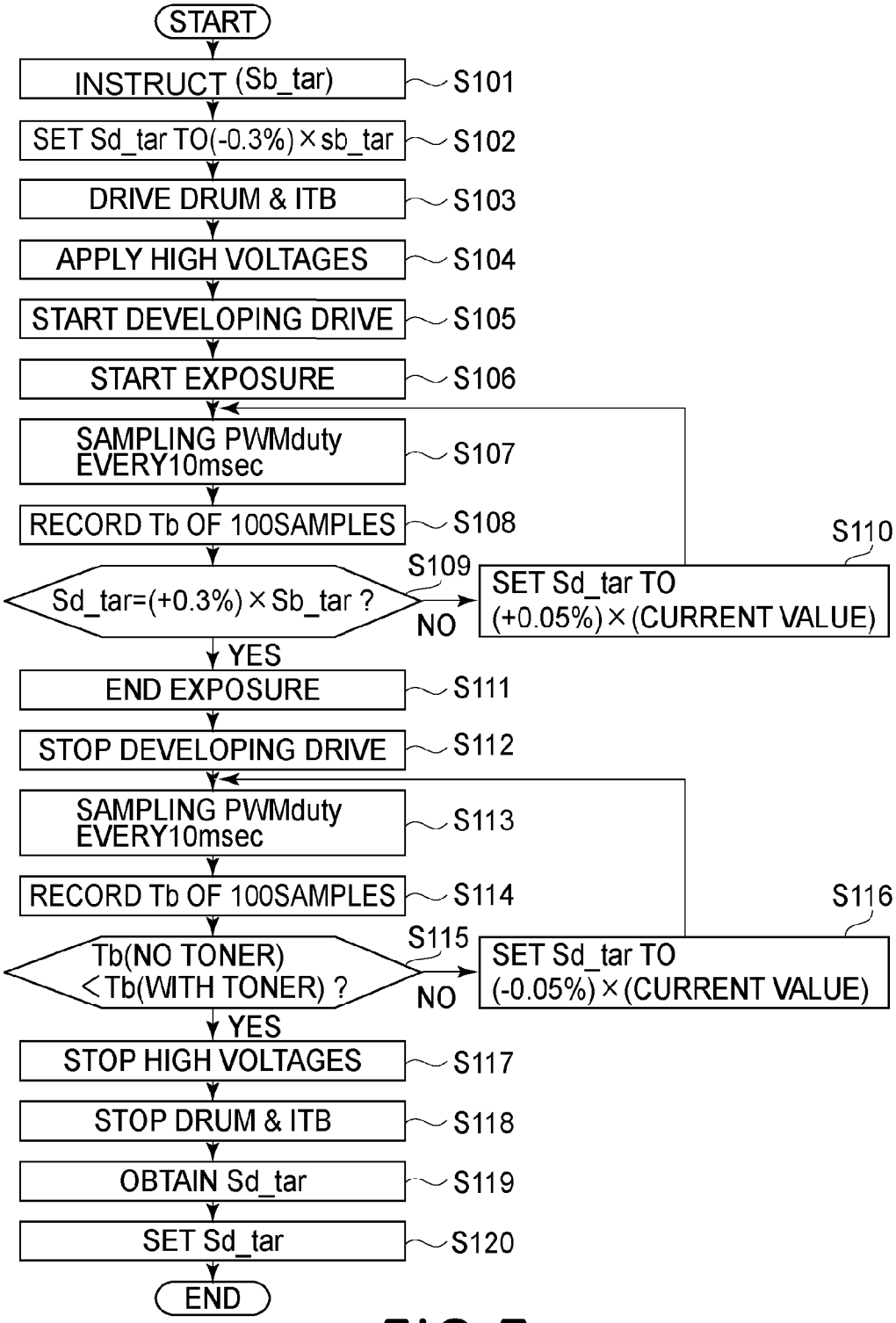
FIG. 7 is a flowchart of a speed instruction (command) value adjusting mode in Embodiment 1.

Next, the speed instruction value adjusting mode in this embodiment will be described. FIG. 7 is a flowchart schematically showing a procedure of an operation in the speed instruction value adjusting mode in this embodiment.

In this embodiment, the controller 110 executes the operation in the speed instruction value adjusting mode in the case where exchange (replacement) of any one of the plurality of photosensitive drums 1 or the intermediary transfer belt 7 is detected or on the basis of start instruction (command) from an operator such as a user or a service person. The controller 110 can detect the exchange of the photosensitive drum 1 or the intermediary transfer belt 7, for example, by reading information of a memory tag (not shown) provided on the photosensitive drum 1 and the intermediary transfer belt 7 via a reading means (not shown) of the apparatus main assembly. Further, the operator can input the start instruction of the operation in the speed instruction value adjusting mode from an operating portion (not shown) provided on the apparatus main assembly into the controller 110 at arbitrary timing such as the case where the photosensitive drum 1 or the intermediary transfer belt 7 is exchanged. In this embodiment, in the operation in the speed instruction value adjusting mode, by adjusting the speed instruction value for particularly the photosensitive drum 1, the surface speed difference between the photosensitive drum 1 and the intermediary transfer belt 7 during the image formation is changed to a desired value.

Incidentally, as a unit of the speed instruction value of the photosensitive drum 1 and the speed instruction value of the intermediary transfer belt 7, from the viewpoint of calculation of the CPU in the controller 110, an angular speed (rad/s) detected by each of the encoders 14 and 34 is used in many cases. However, in this embodiment, in order to unify the description of speed units, for convenience, the unit of the speed instruction value is described as a surface speed conversion value (mm/s), of each of the photosensitive drum 1 and the intermediary transfer belt 7, converted using a nominal value of a value acquired by adding a thickness of the intermediary transfer belt 7 to each of a diameter of the photosensitive drum 1 and a diameter of the driving roller 71. Here, the speed instruction values of the photosensitive drum 1 and the intermediary transfer belt 7 are target values (target driving speeds) of the encoders 14 and 34 on the load shafts, but are not target values (target surface speeds) of the surface speeds of the photosensitive drum 1 and the intermediary transfer belt 7.

In order for ease of understanding of the present invention, first in this embodiment (also similarly in Embodiments 2-7 described later), the case where the speed instruction values of the photosensitive drums 1 of all of the image forming portions S are collectively adjusted will be described. In this case, a diameter tolerance among the photosensitive drums 1 of the YMCK image forming portions SY, SM, SC and Sk and a diameter change due to an environmental change are negligible. Control corresponding to the diameter tolerance among the photosensitive drums 1 of the image forming portions S and the diameter change due to the environmental change will be described in Embodiment 8 described later.

Referring to FIG. 7, first, when the operation in the speed instruction value adjusting mode is started, the controller 110 sets a speed instruction value Sb-tar for the intermediary transfer belt 7 at a fixed value and sets a speed instruction value Sd-tar for all of the photosensitive drums 1 at a value slower than the speed instruction value Sb-tar by 0.3% (S101-S102).

Then, the controller 110 starts constant-speed rotation of the ITB driving motor 31 and all of the drum driving motors 11 (S103). Sd-tar being slower than Sb-tar by 0.3% means that Sb-tar is, for example, 300 mm/s, and Sd-tar is 299.1 mm/s. That is, in this embodiment, a speed difference (speed instruction difference) of Sd-tar relative to Sb-tar is represented by [(Sd-tar−Sb-tar)/Sb-tar]×100(%).

The controller 110 starts, when the speeds of the intermediary transfer belt 7 and all of the photosensitive drums 1 become desired speeds, application of each of the charging bias, the developing bias and the primary transfer bias at the above-described timing at all of the image forming portions S (S104). Further, when the application of each of the biases is started, at all of the image forming portions S, the developing drive is started and exposure is started by inputting a predetermined image signal into the exposure device 3, and then predetermined toner images are sent to the primary transfer portions N1 (S105-S106). In this embodiment, as the toner image, a halftone image with a predetermined density was formed in an entire image forming region (a toner image formable region on the photosensitive drum 1). In this embodiment, the toner image sent to the primary transfer portion N1 is transferred onto the intermediary transfer belt 7 and thereafter is removed and collected from the intermediary transfer belt 7 by the belt cleaning device 77.

By the above-described process, the intermediary transfer belt 7 and all of the photosensitive drums 1 are subjected to detection feed-back control of the encoders 34 and 14 with respect to the respective speed instruction values, and are placed in a constant-speed rotation state. Further, the intermediary transfer belt 7 and the photosensitive drums 1 are in a state in which a predetermined toner image (a toner in a toner amount per unit area not less than a predetermined amount) exists at the primary transfer portion N1 of each of all of the image forming portions S. In this state, the controller 110 detects a duty (PWM duty) of a PWM driving signal, outputted from the ITB speed controller 37 to the ITB driving motor 31, every 10 ms (S107). Then, the controller 110 acquires an average Tb of 100 sampling values for 1 second, and associates the average Tb with Sd-tar and then stores Sd-tar (S108).

Then, the controller 110 discriminates whether or not Sd-tar reaches +0.3% (300.9 mm/s) relative to Sb-tar (S109). In this embodiment, Sd-tar does not reach +0.3%, and therefore the controller 110 then changes Sd-tar to a value faster than a current value by 0.05% (S110). That is, Sd-tar is changed to a value slower than Sb-tar by 0.25%, so that when Sb-tar is 300 mm/s, Sd-tar is 299.25 mm/s. The controller 110 repeats the processes of S107-S110 while increasing Sd-tar in 0.05% increments, and acquires Tb at each of Sd-tar values and associates Vb with Sd-tar and then stores Sd-tar. Then, when Sd-tar reaches the value (300.9 mm/s) slower than Sb-tar by 0.3%, the controller 110 ends the above-described repetitive processes (S109).

Figure 8:
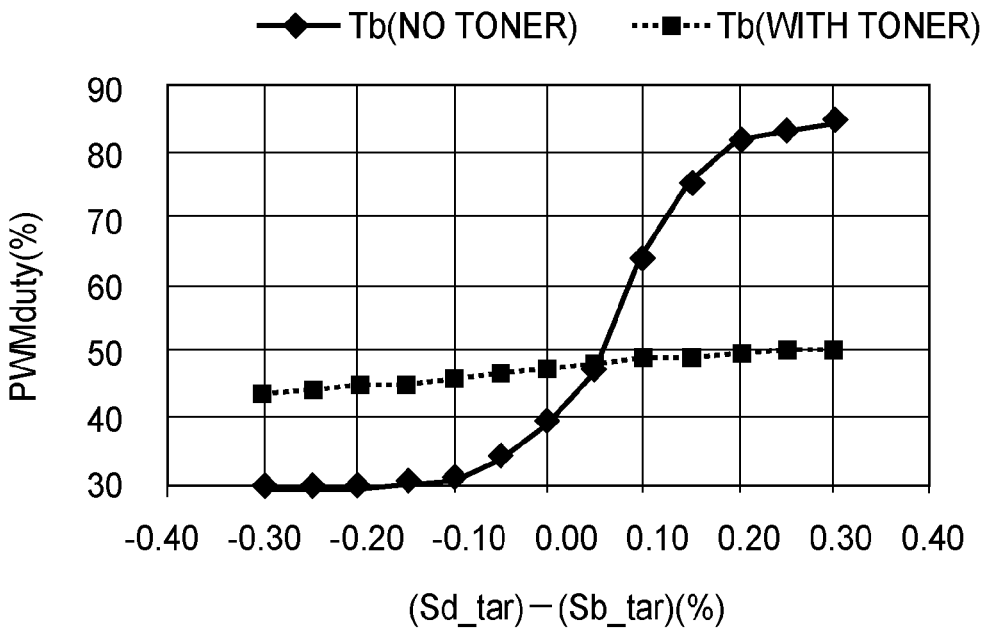
FIG. 8 is a graph showing a PWM duty characteristic of an intermediary transfer belt driving motor depending on a speed instruction difference between a photosensitive drum and an intermediary transfer belt.

In a graph of FIG. 8, a broken line shows the case of Tb measured in an experiment in which processes similar to S107-S110 were performed. In FIG. 8, the ordinate represents a magnitude of the PWM duty outputted from the ITB speed controller 37 to the ITB driving motor 31. This magnitude of the PWM duty is a parameter substantially proportional to an output torque of the ITB driving motor 31 in a state in which a rotational speed of the ITB driving motor 31 is controlled to a constant speed. Further, the abscissa in FIG. 8 represents a speed difference (speed instruction difference) of Sd-tar relative to Sb-tar. From FIG. 8, it is understood that with an increasing Sd-tar, a state between the photosensitive drum 1 and the intermediary transfer belt 7 is changed from a state in which the intermediary transfer belt 7 drags the photosensitive drum 1 to a state in which the photosensitive drum 1 drags the intermediary transfer belt 7 and therefore the output torque of the intermediary transfer belt driving motor 31 decreases.

Then, the controller 110 stops, at all of the image forming portions S, the exposure by stopping an input of the predetermined image signal into the exposure device 3 in a state in which Sd-tar is the value faster than Sb-tar by 0.3% (S111), and stops the developing drive (S112). As a result, the toner on the developing sleeve 41 is not moved onto the photosensitive drum 1, and therefore a state in which there is substantially no toner at the primary transfer portions N1 of all of the image forming portions S is formed. In this state, the controller 110 detects the duty of the PWM driving signal, every 10 ms, outputted from the ITB speed controller 37 to the ITB driving motor 31 (S113). Then, the controller 110 acquires the average Tb of the 100 sampling values for 1 sec, and associates Tb with Sd-tar and stores Sd-tar (S114).

Then, the controller 110 discriminates whether or not Tb, acquired above, in a state (during no toner) in which there is no toner at the primary transfer portions N1 is below Tb acquired by the processes of S107-S109 in a state (during toner existence) the toner exists at the primary transfer portions N1 (S115). At this time, the Tb (during no toner) is not below the Tb (during toner existence), and therefore the controller 110 then changes Sd-tar to a value slower than a current value by 0.05% (S116). The controller 110 repeats the processes of S113-S116 in 0.05% decrements and acquires Tb at each of Sd-tar values and associates Tb with Sd-tar and then stores Sd-tar. Then, the controller 110 ends the above-described repetitive processes when the Tb during no toner is below the Tb during toner existence (S115). Thereafter, the controller 110 ends application of the charging bias, the developing bias and the primary transfer bias at all of the image forming portions S (S117), and stops the rotational drive of the intermediary transfer belt 7 and all of the photosensitive drums 1 (S118).

In the graph of FIG. 8, a solid line shows the case of Tb measured in an experiment in which processes similar to those in S113-S116 were performed. In the processes of S113-S116, the process for repetitively acquiring Tb is ended at the time when the Tb during no toner is below the Tb during toner existence as described above. For that reason, in the control in this embodiment, the data at the speed instruction difference of −0.3% is not acquired, but in FIG. 8, an empirically measured result obtained without ending the above-described repetitive processes. From FIG. 8, it is understood that the output torque of the ITB motor 31 increases since the state between the photosensitive drum 1 and the intermediary transfer belt 7 is changed from the state in which the photosensitive drum 1 drags the intermediary transfer belt 7 to the state in which the intermediary transfer belt drags the photosensitive drum 1. Further, it is understood that a degree of a fluctuation in output torque of the ITB driving motor 31 relative to a fluctuation in speed instruction difference during no toner is larger than that during toner existence since the frictional force between the photosensitive drum 1 and the intermediary transfer belt 7 during no toner is larger than that during toner existence. That is, during toner existence, the frictional force between the photosensitive drum 1 and the intermediary transfer belt 7 becomes small and therefore a degree of a change in output torque of the ITB driving motor 31 is relatively small between the case where the surface speed of the photosensitive drum 1 is lower than the second speed of the intermediary transfer belt 7 and the case where the surface speed of the photosensitive drum 1 is higher than the surface speed of the intermediary transfer belt 7. However, during no toner, the degree of the change in output torque of the ITB driving motor 31 is relatively large between the case where the surface speed of the photosensitive drum 1 is lower than the surface speed of the intermediary transfer belt 7 and the case where the surface speed of the photosensitive drum 1 is higher than the surface speed of the intermediary transfer belt 7.

Then, the controller 110 acquires a difference in each of Sd-tar values between the Tb during toner existence and the Tb during no toner, and then acquires Sd-tar at which this difference becomes substantially 0 (S119). When the speed instruction value for the photosensitive drum 1 is Sd-tar at which the difference is substantially 0 and the speed instruction value for the intermediary transfer belt 7 is Sb-tar which is a fixed value, it can be regarded that the surface speeds of the photosensitive drum 1 and the intermediary transfer belt 7 are equal to each other. That is, when the output torque of the ITB driving motor 31 is unchanged irrespective of the presence or absence of the toner at the primary transfer portions N1, Sb-tar can be discriminated as Sb-tar at which the surface speeds of the photosensitive drum 1 and the intermediary transfer belt 7 are equal to each other. In an example of FIG. 8, at the time when Sd-tar is the value faster than Sb-tar by 0.05%, i.e., at the time when Sd-tar is 300.15 mm/s and Sb-tar is 300 mm/s, in actuality, the surface speeds of the photosensitive drum 1 and the intermediary transfer belt 7 can be regarded as being equal to each other. For the above-described reasons, even when there is a variation in tolerance of the photosensitive drum 1 and the intermediary transfer belt 7, it is possible to acquire Sd-tar capable of making the surface speeds of the photosensitive drum 1 and the intermediary transfer belt 7 equal to each other.

Here, in the example of FIG. 8, there is a point where the difference between the Tb during no toner and the Tb during toner existence is 0. However, when there is no point where the difference is 0 and the lines during toner existence and during no toner (the broken line and the solid line in FIG. 8) cross each other, Sd-tar at a zero-cross point may only be required to be acquired, for example, assuming that a change in data between plots sandwiching the point is linear.

Next, the controller 110 sets the speed instruction value for the photosensitive drum 1 when the image formation is actually effected, by adding or subtracting a value obtained in view of the above-described white void to or from Sd-tar obtained by the operation in the above-described speed instruction value (S120). As a result, even when there is a variation in tolerance of the photosensitive drum 1 and the intermediary transfer belt 7 due to mass-production, the variation can be corrected and it is possible to output a good image. The speed instruction value for the photosensitive drum 1 during the image formation may also be set at Sd-tar obtained by the operation in the above-described speed instruction value adjusting mode so that the surface speeds of the photosensitive drum 1 and the intermediary transfer belt 7 during the image formation are equal to each other.

In this embodiment, a torque characteristic is detected by the PWM duty of the driving motor but is not limited thereto, but it is possible to use an arbitrary index correlating with the output torque of the driving motor. For example, an input current into the driving motor substantially proportional to the torque similarly as in the case of the PWM duty, and the like index may also be used.

Further, in this embodiment, when the Tb during toner existence is measured, after the developing drive is started, the predetermined image signal is inputted into the exposure device 3 to form a predetermined toner image on the photosensitive drum 1, and then the toner image was sent into the primary transfer portion N1. On the other hand, by starting the developing drive, in general, a toner (a toner insufficient in charge amount or a toner having a reversed charge polarity) in a small amount on the developing sleeve 41 moves onto the photosensitive drum 1. For that reason, in this case, even when the predetermined toner image is formed by inputting the predetermined image signal into the exposure device 3, the toner in a small amount can be supplied to the primary transfer portion N1. Accordingly, when the frictional force between the photosensitive drum 1 and the intermediary transfer belt 7 can be made sufficiently small even with the toner in the small amount, it is possible to measure the Tb during toner existence even with the toner in the small amount. A lower limit (predetermined amount) of the toner amount capable of making the frictional force between the photosensitive drum 1 and the intermediary transfer belt 7 sufficiently small can be appropriately set from the following viewpoint. That is, it is only required that a difference in frictional force between the photosensitive drum 1 and the intermediary transfer belt 7 is provided between during voltage existence and during no toner to the extent that the point where the difference in Tb between during toner existence and during no toner can be acquired with desired accuracy.

7. Primary Transfer Voltage in Operation in Speed Instruction Value Adjusting Mode Next, the influence by the presence or absence of the primary transfer bias when Tb is measured in the operation in the speed instruction value adjusting mode will be described.

Figure 9:
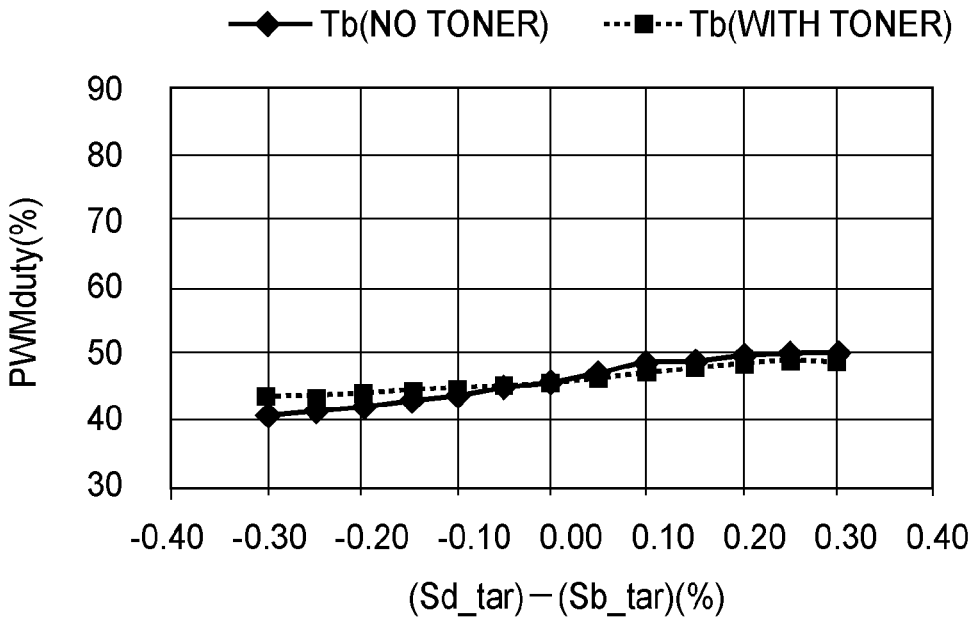
FIG. 9 is a graph showing another PWM duty characteristic of the intermediary transfer belt driving motor depending on the speed instruction difference between the photosensitive drum and the intermediary transfer belt.

FIG. 9 shows a PWM duty characteristic depending on the speed instruction difference in the case where the primary transfer bias is not applied. An experimental result of FIG. 9 is obtained by an experiment similar to the case of FIG. 8 except that the primary transfer bias is not applied.

From FIG. 9, in the case where the primary transfer bias is not applied, an electrostatic attraction force does not act between the photosensitive drum 1 and the primary transfer roller 7 at the primary transfer portion N1, and therefore it is understood that a degree of the increase or decrease in torque is smaller than that in the case of FIG. 8 even when the speed instruction difference is changed during no toner (the solid line in FIG. 9). For this reason, a sufficient difference in slope of Tb cannot be formed between during toner existence and during no toner, so that an error when Sd-tar at the time when the difference in Tb is substantially 0 is liable to become large. That is, by applying the primary transfer bias when Tb is measured, the slope of the Tb current during no toner becomes large, and therefore a cross-point between the Tb during no toner and the Tb during toner existence becomes easy to seek. As a result, it becomes possible to acquire Sd-tar, where the surface speeds of the photosensitive drum 1 and the intermediary transfer belt 7 are equal to each other, with high accuracy. This is more conspicuous in the case where a friction coefficient between the photosensitive drum 1 and the intermediary transfer belt 7 is relatively low.

For that reason, particularly in the case where the friction coefficient between the photosensitive drum 1 and the intermediary transfer belt 7 is relatively low, when Tb is measured in the operation in the speed instruction value adjusting mode as in this embodiment, it is effective to apply the primary transfer bias not only during toner existence but also during no toner.

However, for example, in the case where the friction coefficient between the photosensitive drum 1 and the intermediary transfer belt 7 is relatively large and a sufficient difference in slope of Tb between toner existence and during no toner, when Tb is measured in the operation in the speed instruction value adjusting mode, the primary transfer bias may also be not applied. In this case, no application of the primary transfer bias can be made during no toner or during both of toner existence and no toner. In the case where the primary transfer bias is not applied during toner existence, the toner supplied onto the photosensitive drum 1 passes through the primary transfer portion N1 and is removed and collected from the surface of the photosensitive drum 1 by the drum cleaning device 6.

The primary transfer bias applied when Tb is measured in the operation in the speed instruction value adjusting mode may also be identical to and different from the primary transfer bias applied during the image formation. When a sufficient electrostatic attraction force is caused to act between the photosensitive drum 1 and the intermediary transfer belt 7, an absolute value of a voltage or a current of the primary transfer bias applied when Tb is measured may also be smaller than that during the image formation. Further, in the case where a larger electrostatic attraction force is intended to be caused to act between the photosensitive drum 1 and the intermediary transfer belt 7, the absolute value of the voltage or the current of the primary transfer bias applied when Tb is measured may also be made larger than that during the image formation.

8. Cleaning of Toner on Intermediary Transfer Belt in Operation in Speed Instruction Value Adjusting Mode The toner deposited on the intermediary transfer belt 7 when Tb is measured during toner existence in the operation in the speed instruction value adjusting mode is removed and collected from the surface of the intermediary transfer belt 7 by the belt cleaning device 77. The belt cleaning device 77 is provided with the cleaning blade 77*a* as the cleaning member disposed in contact with the intermediary transfer belt 7. When the toner is interposed at a contact portion (cleaning portion) between this cleaning blade 77*a* and the intermediary transfer belt 7, the toner acts as a lubricant. For that reason, a load of the ITB driving motor 31 varies depending on also the presence or absence of the toner at the cleaning portion in some cases.

For this reason, it is desirable that the measurement of Tb in the operation in the speed instruction value adjusting mode is ended until before a trailing end of the toner image, with respect to the rotational direction of the intermediary transfer belt 7, sent to the primary transfer portion N1 reaches the cleaning nip.

For the same reason as above, it is desirable that the measurement of Tb during no toner in the operation in the speed instruction value adjusting mode is started after a region on the intermediary transfer belt 7 on which the toner sent to the primary transfer portion N1 in order to measure Tb during toner existence passes through the cleaning nip.

As described above, the image forming apparatus 100 in this embodiment includes a first driving means 10 for rotationally driving the image bearing member 1 and a second driving means 30 for rotationally driving the feeding member 7. The image forming apparatus 100 further includes a detecting means (speed controller) 37 for detecting information on the output torque of the second driving means 30 and a control means 110 for controlling the first driving means 10 and the second driving means 20. The image forming apparatus 100 effects the image formation by forming the toner image on the image bearing member 1 and then by transferring the toner image from the image bearing member 1 onto the feeding member 7. The first driving means 10 and the second driving means 30 drives the image bearing member 1 and the feeding member 7 by causing the speeds of the driving shafts of the image bearing member 1 and the feeding member 7 to be close to speeds corresponding to speed instruction values instructed by the control means 110. Then, the control means 110 executes the following detecting operation. The detecting operation includes a first detecting period and a second detecting period in which the detection of the information on the output torque of the second driving means 30 by the detecting means is made in a first state and a second state, respectively, different in condition relating to the frictional force between the image bearing member 1 and the feeding member 7. In this embodiment, the frictional force between the image bearing member 1 and the feeding member 7 is relatively small in the first state and is relatively large in the second state. In each of the first detecting period and the second detecting period in the detecting operation, the image bearing member 1 and the feeding member 7 are driven not only by making the speed instruction value for the second driving means 30 constant but also by changing the speed instruction value for the first driving means 10. Then, the information on the output torque of the second driving means 30 when the speed instruction value for the first driving means 10 is changed to each of a plurality of different speed instruction values is detected by the detecting means 37. Thereafter, the control means 110 sets the speed instruction value for the first driving means 10 during the image formation on the basis of a detection result of the detecting means 37 in each of the first detecting period and the second detecting period of the detecting operation.

Particularly, in this embodiment, the control means 110 causes the toner image forming means to supply the toner to the image bearing member 1 and thus causes the toner in a predetermined amount or more to exist between the image bearing member 1 and the feeding member 7, so that the first state is formed. Further, the control means 110 causes the toner image forming means not to supply the toner to the image bearing member 1 and thus causes the toner in the predetermined amount or more not to exist between the image bearing member 1 and the feeding member 7, so that the second state is formed. In this case, it is desirable that the control means 110 ends the first detecting period until the toner supplied to between the image bearing member 1 and the feeding member 7 in the first detecting period is fed by the feeding member 7 and reaches the contact portion between the cleaning member 77*a* and the feeding member 7. Further, in this case, it is desirable that the control means 110 starts the second detecting period after a region of the feeding member 7 on which the toner supplied to between the image bearing member 7 and the feeding member 7 in the first detecting period is deposited passes through the contact portion between the cleaning member 77*a* and the feeding member 7. In this embodiment, the predetermined toner image is formed on the image bearing member 1 and the toner of the toner image is supplied to the primary transfer portion N1 to form the first state desired above, but the developing drive is simply started and the toner deposited on the image bearing member 1 is supplied to the primary transfer portion N1, so that the first state may also be formed. In this embodiment, in the second state, a state in which there is substantially no toner between the photosensitive drum 1 and the intermediary transfer belt 7 was formed. However, when a sufficient difference in frictional force between the photosensitive drum 1 and the intermediary transfer belt 7 can be provided between the first state and the second state, the toner in sufficiently small amount may exist intentionally or unintentionally between the photosensitive drum 1 and the intermediary transfer belt 7. Particularly, in this embodiment, the control means 110 causes the electric field forming means to form an electric field between the image bearing member 1 and the feeding member 7 in both of the first state and the second primary transfer. In this embodiment, the electric field forming means for forming the electric field between the image bearing member 1 and the feeding member at the contact portion N1 between the image bearing member 1 and the feeding member 7 includes the transfer member 5. The transfer member 5 is contactable to the feeding member 7 toward the image bearing member 1, and a voltage is applied to the transfer member 5 in a state in which the transfer member 5 is contacted to the feeding member 7 toward the image bearing member 1, so that the electric field is formed between the image bearing member 1 and the feeding member 7.

In this embodiment, in each of the first detecting period and the second detecting period, the control means 110 changes the speed instruction value for the first driving member in a range from a low-speed side to a high-speed side than the speed instruction value where the surface speed of the image bearing member 1 and the surface speed of the feeding member 7 are equal to each other. In this embodiment, the control means 110 acquires the speed instruction value for the first driving means 10 where detection results in the first detecting period and the second detecting period by the detecting means 37 are equal to each other. Then, the control means 110 sets the speed instruction value for the first driving means 10 during the image formation on the basis of the acquired speed instruction value. In this embodiment, the information on the output torque of the second driving means 30 detected by the detecting means 37 is a drive instruction (command) value outputted from the driving circuit 37 provided in the second driving means 30 to the motor 31 provided in the second driving means 30.

As described above, according to this embodiment, irrespective of the friction coefficient between the intermediary transfer belt 7 and the photosensitive drum 1, the speed instruction value where the surface speeds of the photosensitive drum 1 and the intermediary transfer belt 7 are equal to each other can be acquired, so that it is possible to set an optimum speed instruction value during the image formation.

Incidentally, the speed instruction value adjusting mode similar to that in this embodiment is similarly applicable to an image forming apparatus in which a commonality of a plurality of driving sources for the photosensitive drums is realized, an image forming apparatus of a single drum type or a single-color image forming apparatus. In the image forming apparatus of the single drum type, a plurality of developing devices are provided for a single photosensitive drum, and electrostatic latent images successively formed on the photosensitive drum are successively developed with toners different in color by the plurality of developing devices and then the toner images are successively transferred onto an intermediary transfer belt.

Embodiment 2

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

In Embodiment 1, when Tb was measured in the operation in the speed instruction value adjusting mode, the primary transfer bias was applied and thus the electrostatic attraction force was caused to act, so that the frictional force between the photosensitive drum 1 and the intermediary transfer belt 7 was relatively increased.

However, there is a limit to an increase in absolute value of a voltage or a current of the primary transfer bias for causing the electrostatic attraction force to act in such a manner, and when the absolute value is made excessively large, for example, the photosensitive drum 1 is damaged in some cases. Further, in the operation in the speed instruction value adjusting mode, by applying the primary transfer bias, it would be considered that, for example, a deterioration due to energization to the primary transfer roller 5 and the intermediary transfer belt 7 progresses.

On the other hand, as a means for increasing the frictional force between the photosensitive drum 1 and the intermediary transfer belt 7, it is possible to cite an increase in an urging force of the intermediary transfer belt 7 against the photosensitive drum 1. Therefore, in this embodiment, as described specifically later, when Tb is measured in the operation in the speed instruction value adjusting mode, the urging force of the primary transfer roller 5 toward the photosensitive drum 1 is made larger than that during the image formation.

2. Urging Mechanism for Primary Transfer Roller

Figure 10:
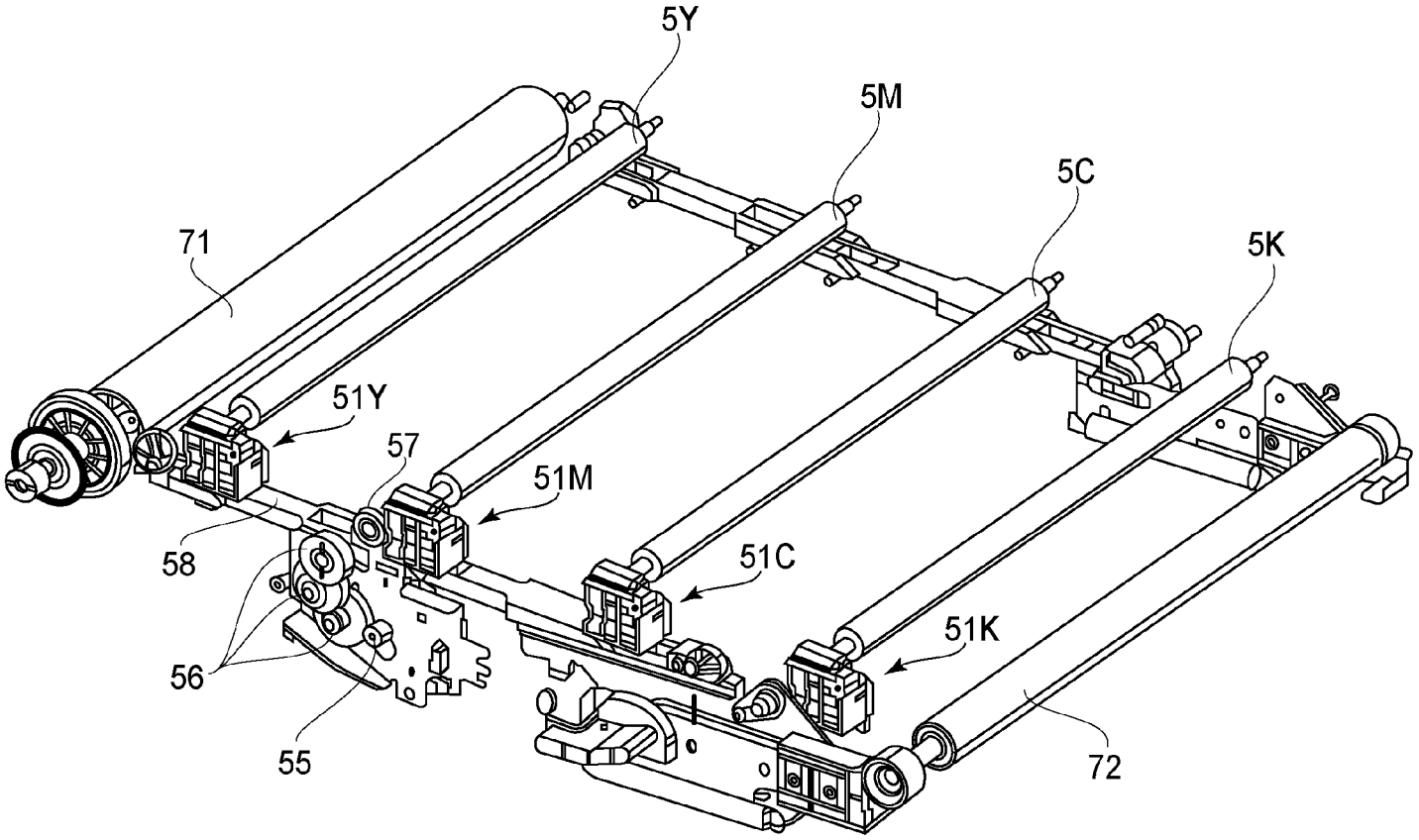
FIG. 10 is a perspective view showing an urging mechanism for primary transfer rollers.
Figure 11:
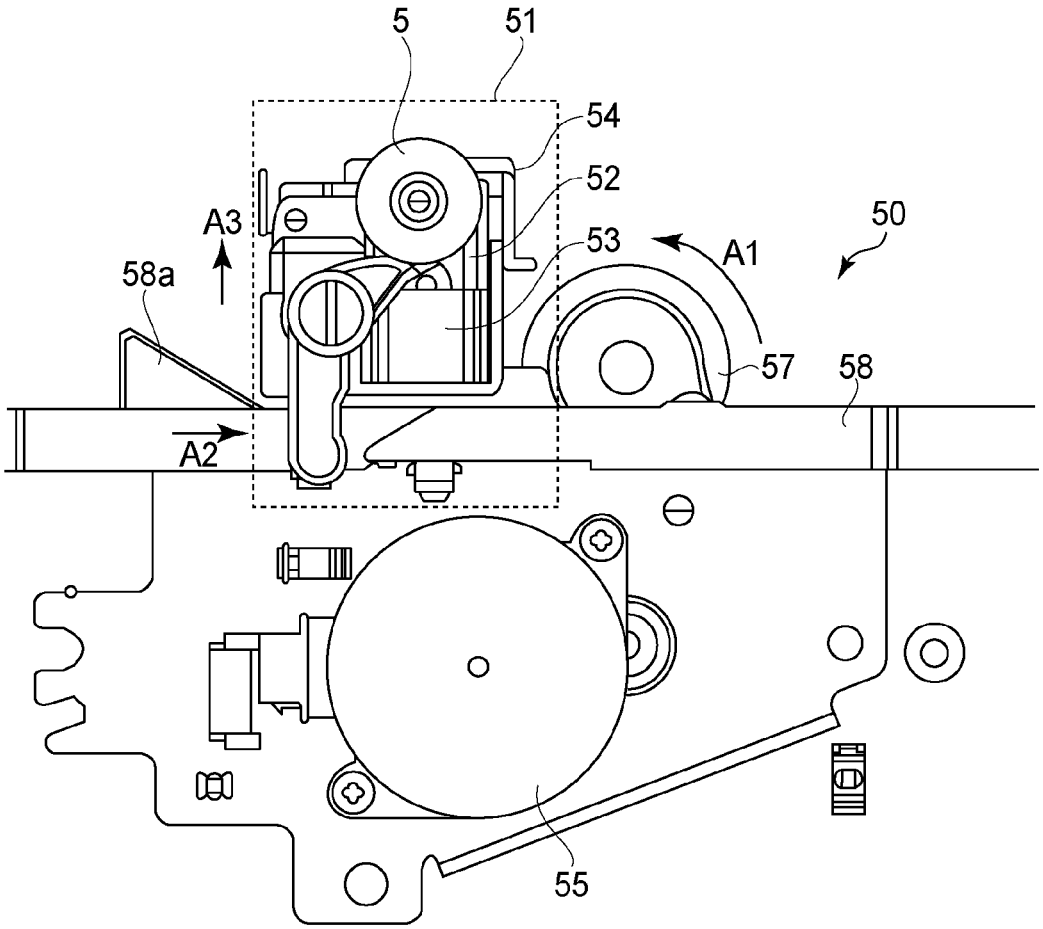
FIG. 11 is a side view for illustrating an urging operation of the primary transfer roller.

Next, an urging mechanism as an urging means will be described. First, referring to FIGS. 10 and 11, an urging mechanism 50 for urging the primary transfer rollers 5Y, 5M, 5C of the YMC image forming portions SY, SM, SC toward the photosensitive drums 1Y, 1M, 1C will be described. FIG. 10 is a perspective view showing the urging mechanism 50. FIG. 11 is a side view showing a supporting structure for the primary transfer roller 5 of one image forming portion S as a representative example. In this embodiment, supporting structures of the primary transfer rollers 5Y, 5M, 5C of the YMC image forming portions SY, SM, SC are substantially the same. Further, in this embodiment, the urging mechanism 50 collectively adjusts urging forces of the primary transfer rollers 5Y, 5M, 5C of the YMC image forming portions SY, SM, SC toward the photosensitive drums 1Y, 1M, 1C.

As shown in FIG. 10, the urging mechanism 50 includes a folder unit (illustrated only at one end portion) 51 as a supporting means for supporting rotatably both end portions of the primary transfer rollers 5 of the image forming portions S with respect to a longitudinal direction (rotational axis direction). As shown in FIG. 11, the folder unit 51 includes a bearing 52 rotatably supporting an end portion of a rotation shaft of the primary transfer roller 5 and a spring 53 as an urging means for urging the bearing 52 toward the photosensitive drum 1. The bearing 52 is provided in a casing 54 of the folder unit 51 so as to be slidable and movable toward and away from the photosensitive drum 1 (up-down direction in FIG. 11). The spring 53 urges the bearing 52 so that the bearing 52 slides and moves toward the photosensitive drum 1, and thus urges the primary transfer roller 5 toward the photosensitive drum 1. The folder unit 51 is held by an unshown frame member as a whole so as to be slidable and movable toward and away from the photosensitive drum 1 (up-down direction in FIG. 11). In this embodiment, the primary transfer roller 5 is constituted by forming a rubber layer which is an elastic member at a periphery of a metal-mode core material (core metal).

The urging mechanism 50 includes a moving motor 55, a gear (gear train) 56, a moving cam 57 and a sliding member 58. The moving motor 55 is driven and a driving force thereof is transmitted by the gear 56, so that the moving cam 57 is rotated. By rotation of the moving cam 57 in an arrow A1 direction in FIG. 11, the sliding member 58 is slid and moved in an arrow A2 direction in FIG. 11. As a result, a projected portion 58*a* provided on the sliding member 58 moves an entirety of the folder unit 51 toward the photosensitive drum 1 (upward in FIG. 11) as shown by an arrow A3 in FIG. 11. During the image formation, a state (state of FIG. 11) in which the projected portion 58*a* of the sliding member 58 does not move the folder unit 51 toward the photosensitive drum 1 is formed. In this state, the primary transfer roller 5 contacts the intermediary transfer belt 7 toward the photosensitive drum 1 and is urged toward the photosensitive drum 1 at a predetermined pressure by the spring 53. On the other hand, when the frictional force between the photosensitive drum 1 and the intermediary transfer belt 7 is made larger than that during the image formation in the output in the speed instruction value adjusting mode, a state in which the projected portion 58*a* of the sliding member 58 moves the folder unit 51 toward the photosensitive drum 1 (upward in FIG. 11) is effected. As a result, the folder unit 51 approaches the photosensitive drum 1, and therefore the urging force of the spring 53 for urging the primary transfer roller 5 toward the photosensitive drum 1 becomes large, so that the pressure at the primary transfer portion N1 increases. Then, the frictional force between the photosensitive drum 1 and the intermediary transfer belt 7 becomes larger than that during the image formation.

Here, in the tandem-type image forming apparatus, for example, in the case where image formation of black (single color) is effected frequently, consumption of the photosensitive drums 1Y, 1M, 1C and the developing devices 4Y, 4M, 4C of the YMC image forming portions SY, SM, SC where the image formation is not effected can be suppressed in some cases. That is, as shown in (a) of FIG. 12, in an operation in a full-color mode in which images are formed at all of the YMCK image forming portions SY, SM, SC, SK, the photosensitive drums 1Y, 1M, 1C, 1K of the YMCK image forming portions SY, SM, SC, SK are contacted to the intermediary transfer belt 7. On the other hand, in an operation in a black (monochromatic) mode in which the image is formed at only the K image forming portion SK, as shown in (b) of FIG. 12, the photosensitive drums 1Y, 1M, 1C of the YMC image forming portions SY, SM, SC and the intermediary transfer belt 7 are spaced from each other. Then, in the operation in the black (monochromatic) mode, in order to suppress deterioration of the photosensitive drums and the developing devices 4 of the YMC image forming portions SY, SM, SC, drive of these members is stopped. In the case where the image forming apparatus includes such a spacing mechanism, a motor for the spacing mechanism can also function as the moving motor 55 in the above-descried urging mechanism 50 or the like motor. As a result, there is no need to separately provide an actuator for the urging mechanism 50.

Figure 13:
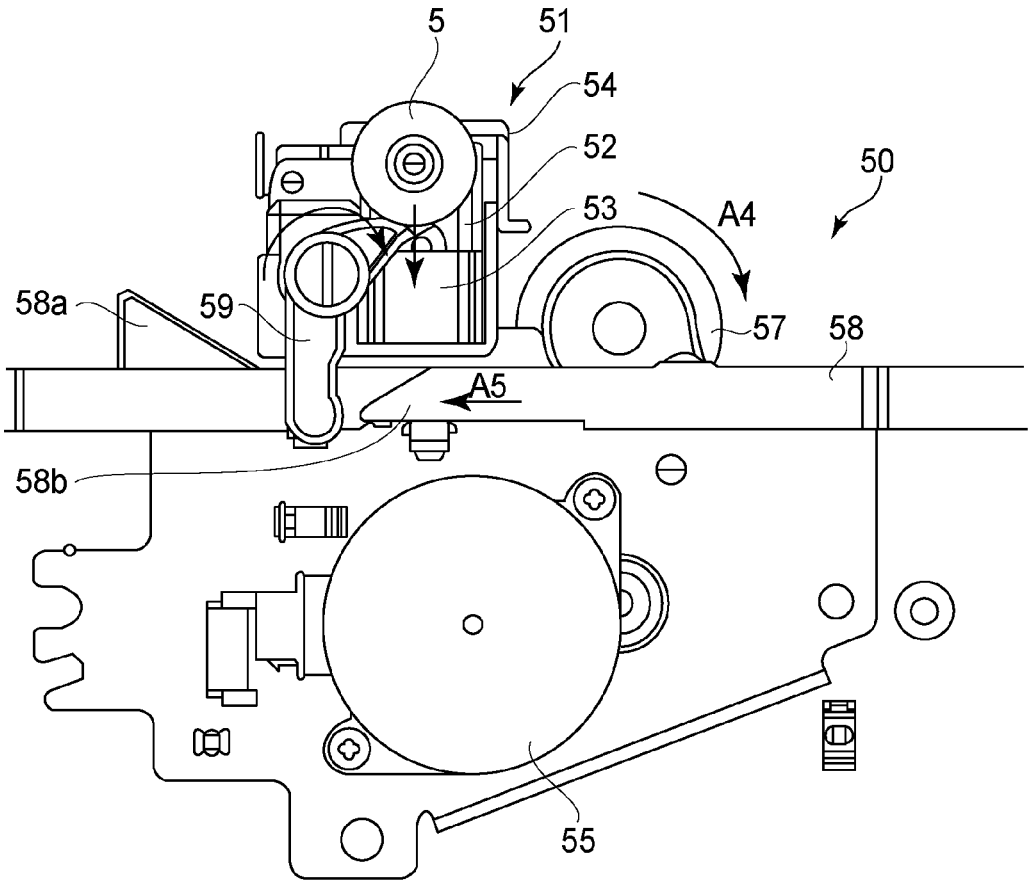
FIG. 13 is a side view for illustrating a spacing operation of the primary transfer portion.

Specifically, as shown in FIG. 13, the moving motor 55 is rotated in an opposite direction to the direction in the case where the pressure at the primary transfer N1 is increased as described above. At this time, the moving cam 57 is rotated in an arrow A4 direction in FIG. 13, so that the sliding member 58 is slid and moved in an arrow A5 direction in FIG. 13. Then, by movement of the sliding member 58, a spacing projected portion 58*b* provided on the sliding member 58 rotates a spacing arm 59 provided in the folder unit 51. As a result, the bearing 52 provided in the folder unit 51 is moved downward. The primary transfer roller 5 is rotatably mounted on the bearing 52 and therefore by this operation, the primary transfer roller 5 is moved away from the photosensitive drum 1 (downward in FIG. 13).

In this embodiment, as an urging mechanism as an urging means for urging the primary transfer roller 5 of the K image forming portion SK toward the photosensitive drum 1, an urging mechanism similar to the urging mechanism 50 for urging the YMC image forming portions SY, SM, SC is separately provided. However, the present invention is not limited thereto; for example, an urging mechanism common to the primary transfer rollers 5 of the YMCK image forming portions SY, SM, SC, SK may also be provided. Further, urging mechanisms may also be provided individually for the primary transfer rollers 5 of the YMCK image forming portions SY, SM, SC, SK.

3. Speed Instruction (Command) Value Adjusting Mode

Figures 14, 14A, 14B:
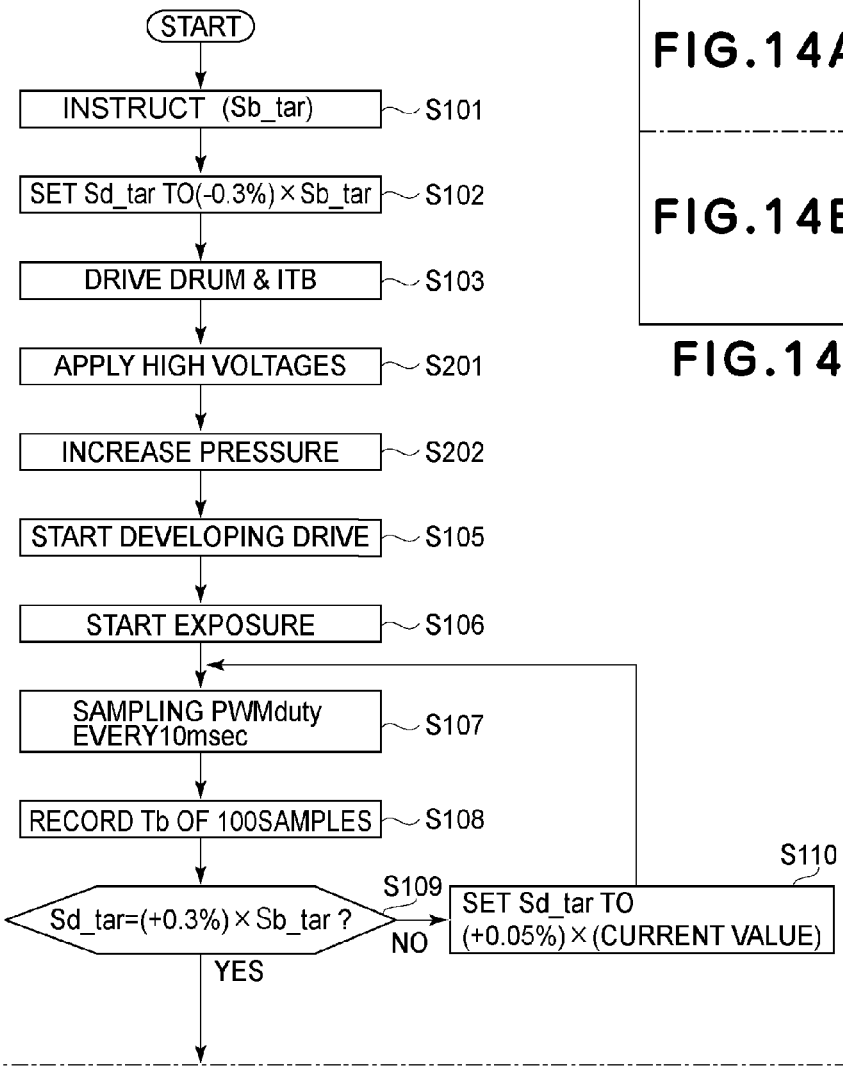
FIG. 14, comprised of FIGS. 14A and 14B, is a flowchart of a speed instruction value adjusting mode in Embodiment 2.
Figure 14B:
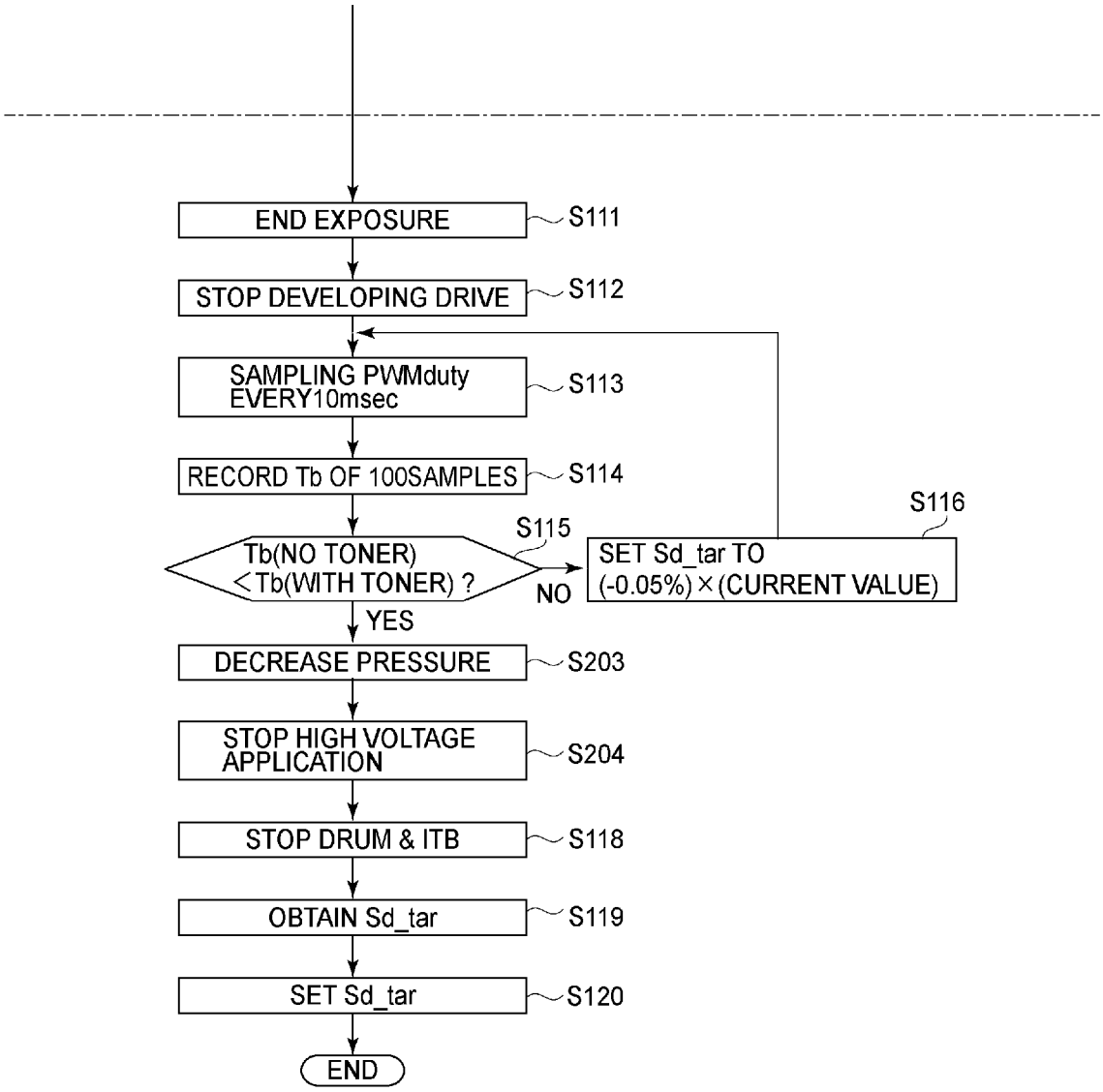

Next, the speed instruction value adjusting mode in this embodiment will be described. FIG. 14 is a flowchart schematically showing a procedure of an operation in the speed instruction value adjusting mode in this embodiment. In the operation in the speed instruction value adjusting mode, processes similar to those in Embodiment 1 in accordance with the flowchart of FIG. 7 are represented by the same step symbols and will be omitted from detailed description.

First, when the operation in the speed instruction value adjusting mode is started, the controller 110 executes the same processes as those in S101-S103 in FIG. 7.

Then, the controller 110 starts, when the speeds of the intermediary transfer belt 7 and all of the photosensitive drums 1 become desired speeds, application of each of the charging bias and the developing bias at the above-described timing at all of the image forming portions S (S201).

Then, the controller 110 drives the moving motor 55 of the urging mechanism 50 as described above, so that the pressures at the primary transfer portions N1 at all of the image forming portions S are increased (S202). In this embodiment, the pressures at the primary transfer portions N1 during normal image formation are 1.2 kg as a total pressure, whereas the pressures at the primary transfer portions N1 in the operation in the speed instruction value adjusting mode are set at a total pressure which is twice the total pressure during the image formation. In this embodiment, during the image formation, when the pressures at the primary transfer portions N1 are made twice the normal pressures, a transfer condition is largely changed, and therefore there is a liability that an image defect is caused.

Then, the controller 110 executes the same processes in S105-S116 in FIG. 7. As a result, the pressures at the primary transfer portions N1 are increased and the frictional force between each photosensitive drum 1 and the intermediary transfer belt 7 is increased, and then data of a relationship between the speed instruction difference and Tb can be obtained during toner existence and during no toner. As in this embodiment, also the Tb values during toner existence and during no toner measured by increasing the pressures at the primary transfer portions N1 without applying the primary transfer bias are similar to those shown by the broken line and the solid line, respectively, in FIG. 8. Incidentally, the Tb values during toner existence and during no toner measured in the case where the primary transfer bias is not applied and also the pressures at the primary transfer portions N1 are not increased and similar to those shown by the broken line and the solid line, respectively, in FIG. 9. These are more conspicuous in the case where a friction coefficient between the photosensitive drum 1 and the intermediary transfer belt 7 is relatively low. For that reason, particularly in the case where the friction coefficient between the photosensitive drum 1 and the intermediary transfer belt 7 is relatively low, when Tb is measured in the operation in the speed instruction value adjusting mode as in this embodiment, it is effective to increase the pressures at the primary transfer portions N1 not only during toner existence but also during no toner.

Next, the controller 110 lowers the pressures at the primary transfer portions N1 at all of the image forming portions S to pressures at the primary transfer portions N1 at all of the image forming portions S (S203), and ends the application of the charging bias and the developing bias (S204).

Then, the controller 110 executes the same processes as those in S118-S120 in FIG. 7. As a result, Sd-tar where the difference in Tb between during toner existence and during no toner is substantially 0 is acquired, and then on the basis of thus Sd-tar, the speed instruction value for the photosensitive drum 1 during the image formation is set.

As described above, the image forming apparatus 100 in this embodiment includes the urging means 50 capable of urging the transfer member 5 toward the image bearing member 1 at a first urging force and a second urging force larger than the first urging force. In this embodiment, the controller 110 causes the urging means 50 to urge the transfer member 5 toward the image bearing member 1 in both of the first detecting period and the second detecting period in the detecting operation described above.

As described above, according to this embodiment, not only an effect similar to that in Embodiment 1 but also damages on the photosensitive drums 1, the intermediary transfer belt 7, the primary transfer rollers 5 and the like, which can generate under application of the primary transfer bias in the operation in the speed instruction value adjusting mode, can be suppressed.

In this embodiment, the constitution in which each of the primary transfer rollers 5 having the surface layer formed with the elastic member was urged toward the photosensitive drum 1 was employed. However, the present invention is not limited thereto; for example, a constitution in which the primary transfer roller 5 is constituted using a material close to a rigid member such as metal and is rotatably supported at a fixed position may also be employed. In this case, the position of the primary transfer roller 5 is made variable and is caused to enter the intermediary transfer belt 7 toward the photosensitive drum 1, so that the pressure at the primary transfer portion N1 is increased, and thus it is possible to increase the frictional force between the photosensitive drum 1 and the intermediary transfer belt 7.

In this embodiment, the pressure at the primary transfer portion N1 was increased in place of the primary transfer bias application in the operation in the speed instruction value adjusting mode in Embodiment 1. However, the present invention is not limited thereto; for example, in the case where there is a need to further increase the frictional force between the photosensitive drum 1 and the intermediary transfer belt 7, as desired, not only the primary transfer bias is applied in the operation in the speed instruction value adjusting mode but also the pressure at the primary transfer portion N1 may also be increased.

Further, in the operation in the speed instruction value adjusting mode, it is also possible to employ a constitution in which the primary transfer bias is applied at some image forming portions of the plurality of image forming portions and the pressure at the primary transfer portion N1 is increased at one or more remaining image forming portions. For example, as described above, the spacing mechanism for spacing the intermediary transfer belt 7 from the photosensitive drums 1 is provided at the YMC image forming portions SY, SM, SC, but the spacing mechanism is not provided at the K image forming portion SK in some cases. In this case, in the operation in the speed instruction value adjusting mode, it is also possible to employ a constitution in which in the operation in the speed instruction value adjusting mode, the pressure at the primary transfer portion is increased at the YMC image forming portions SY, SM, SC and the primary transfer bias is applied at the K image forming portion SK.

Embodiment 3

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

In Embodiments 1 and 2, in the operation in the speed instruction value adjusting mode, the first state in which the frictional force between the photosensitive drum 1 and the intermediary transfer belt 7 was relatively small and the second state in which the frictional force was relatively large were switched depending on the presence or absence of the toner between the photosensitive drum 1 and the intermediary transfer belt 1.

Here, as described in Embodiments 1 and 2, the frictional force between the photosensitive drum 1 and the intermediary transfer belt 7 can be changed also depending on the presence or absence of the primary transfer bias application or a magnitude of the pressure at the primary transfer portion N1.

For that reason, the supply of the toner to the primary transfer portion N1 may also be not effected in the case where the frictional force between the photosensitive drum 1 and the intermediary transfer belt 7 is relatively large and a sufficient difference in slope of Tb is provided only depending on the presence or absence of the primary transfer bias application or only the magnitude of the pressure at the primary transfer portion N1.

For example, the following operation may only be required to be performed in the case where only depending on the presence or absence of the primary transfer bias application, the first state in which the frictional force between the photosensitive drum 1 and the intermediary transfer belt 7 is relatively small and the second state in which the frictional force is relatively large are switched with each other. That is, in the operation in the speed instruction value adjusting mode in Embodiment 1 in accordance with the flowchart of FIG. 7, the measurement of Tb may only be required to be made in a state in which the primary transfer bias is not applied in place of the measurement of Tb made in a state in which the toner exists at the primary transfer portion N1. Further, in the operation in the speed instruction value adjusting mode in accordance with the flowchart of FIG. 7, the measurement of Tb is made in a state in which the primary transfer bias is applied in place of the measurement of Tb made in a state in which there is no toner at the primary transfer portion N1.

At this time, in place of ON/OFF of the primary transfer bias, the magnitude of an absolute value of the voltage or the current of the primary transfer bias may also be switched. That is, with an increasing absolute value of the primary transfer bias voltage or current, the electrostatic attraction force acting between the photosensitive drum 1 and the intermediary transfer belt 7 becomes large. Accordingly, it is only required that the frictional force between the photosensitive drum 1 and the intermediary transfer belt 7 is provided between a large absolute value state in which the absolute value of the primary transfer bias voltage or current is large and a small absolute value state in which the absolute value of the primary transfer bias voltage or current is small to the extent that the point where the difference in Tb between the large and small absolute value states is substantially 0 can be acquired with high accuracy.

Similarly, the following operation may only be required to be performed in the case where only depending on the magnitude of the pressure at the primary portion N1, the first state in which the frictional force between the photosensitive drum 1 and the intermediary transfer belt 7 is relatively small and the second state in which the frictional force is relatively large are switched with each other. That is, in the operation in the speed instruction value adjusting mode in Embodiment 1 in accordance with the flowchart of FIG. 7, the measurement of Tb may only be required to be made in a state in which the pressure at the primary transfer portion N1 is relatively small (e.g., the pressure during the image formation) in place of the measurement of Tb is made in a state in which the toner exists at the primary transfer portion N1. Further, in the operation in the speed instruction value adjusting mode in accordance with the flowchart of FIG. 7, the measurement of Tb made in a state in which the pressure at the primary transfer portion N1 is relatively large (e.g., twice the pressure during the image formation) in place of the measurement of Tb made in a state in which there is no toner at the primary transfer portion N1.

As described above, the control means 110 can form the first state by causing the electric field forming means not to form the electric field between the image bearing member 1 and the feeding member 7 and form the second state by causing the electric field forming means to form the electric field between the image bearing member 1 and the feeding member 7. Further, the control means can form the first state by causing the electric field forming means to form a first electric field between the image bearing member 1 and the feeding member 7 and can form the second state by causing the electric field forming means to form a second electric field stronger than the second electric field. Further, the following operation may also be performed in the case where the image forming apparatus 100 includes the urging means 50 capable of urging the feeding member 7 against the image bearing member 1 at the contact portion N1 between the image bearing member 1 and the feeding member 7 at the first urging force and the second urging force larger than the first urging force. That is, the control means 110 can form the first state by causing the urging means 50 to urge the feeding member 7 against the image bearing member 1 at the first urging force and can form the second state by causing the urging means 50 to urge the feeding member 7 against the image bearing member 7 at the second urging force.

As described above, an effect similar to that in Embodiment 1 can be obtained also by the constitution in this embodiment.

Embodiment 4

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

The image forming apparatus 100 in this embodiment includes the intermediary transfer belt 7 constituted by the endless belt stretched by the plurality of stretching rollers. In such an image forming apparatus including the belt, in order to prevent a complete shift of the belt to one longitudinal end of the stretching rollers with respect to the longitudinal direction, a mechanism for adjusting a widthwise traveling position of the belt by adjusting alignment among the stretching rollers is provided in some cases. As described specifically later, the image forming apparatus 100 in this embodiment is provided with a mechanism (shift correcting mechanism, steering mode) for adjusting a change (shift of belt, shift to one end) in widthwise trailing position of such a belt.

However, in the case where the shift correcting mechanism is provided, a load exerted on the belt changes in some cases due to an operation for adjusting alignment among the stretching rollers or a change in stretching roller alignment itself. For that reason, when the shift correcting mechanism is actuated in the operation in the speed instruction value adjusting mode, the change in load exerted on the belt has the influence on a load for driving the belt, so that accuracy of the control lowers in some cases.

Therefore, in this embodiment, as described specifically below, a constitution in which the influence of the shift correcting mechanism in the operation in the speed instruction value adjusting mode is suppressed is employed.

2. Shift Correcting Mechanism

Next, the shift correcting mechanism as an adjusting means for adjusting the widthwise traveling position of the belt by tilting at least one stretching roller of the plurality of stretching rollers will be described.

Figure 15:
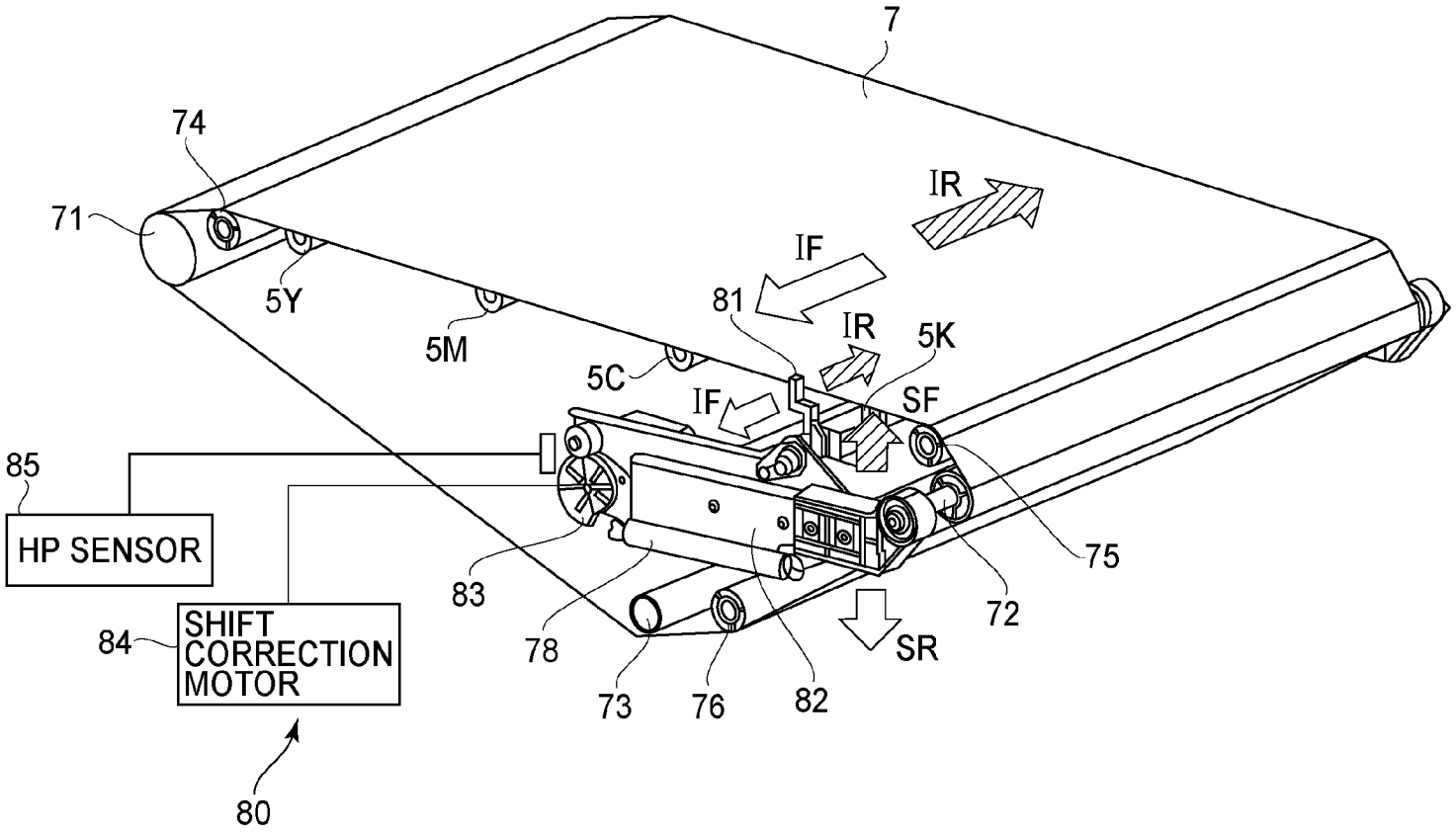
FIG. 15 is a perspective view showing a shift correcting mechanism.

FIG. 15 is a perspective view showing a shift correcting mechanism 80 in this embodiment. In this embodiment, of the plurality of stretching rollers for the intermediary transfer belt 7, the tension roller 72 also functions as a tiltable shift correcting roller. Further, the shift correcting mechanism 80 includes a shift detecting sensor 81, a shift correcting arm 82, a shift correcting cam 83 and a shift correcting motor 84. The shift correcting roller (tension roller) 72 corrects lateral shift of a traveling position of the intermediary transfer belt, with respect to a widthwise direction, detected by the shift detecting sensor 81. In this embodiment, the shift correcting roller 72 is fixed at a position on one end side (rear side in FIG. 15) with respect to a longitudinal direction thereof and is vertically movable in FIG. 15 on the other end side (front side in FIG. 15). The shift correcting cam 83 is rotated by the shift correcting motor 84, whereby a degree of tilting of the shift correcting roller 72 is changed via the shift correcting arm 82. As a result, a change in traveling position of the intermediary transfer belt 7 with respect to the widthwise direction is corrected. Incidentally, the shift correcting roller 72 is urged (pressed) by a tension spring 78 (not shown on the rear side in FIG. 15) as an urging means in a direction from the inner peripheral surface side toward the outer peripheral surface side of the intermediary transfer belt 7, and imparts a tension (tensile force) to the intermediary transfer belt 7.

In FIG. 15, when the widthwise traveling position of the intermediary transfer belt 7 shifts to the front side or the rear side, a movable portion of the shift detecting sensor 81 is moved in an arrow IF direction or an arrow IR direction by the widthwise end portion of the intermediary transfer belt 7. At that time, the shift correcting motor 84 is driven depending on the position of the intermediary transfer belt 7 detected by the shift detecting sensor 81. When the shift correcting motor 84 is driven, the shift correcting cam 83 is rotated, so that the shift correcting arm is vertically operated (in an arrow SF or SR direction). As a result, the shift correcting roller 72 is tilted. By the tilting of the shift correcting roller 72, the intermediary transfer belt 7 is moved in the arrow IF or IR direction so as to decrease the degree of the lateral shift of the widthwise traveling position of the intermediary transfer belt 7. By repeating these operations, the lateral shift of the widthwise traveling position of the intermediary transfer belt 7 is corrected.

The tilting (tilting position) of the shift correcting roller 72 is detected by a HP sensor 85 provided coaxially with a rotation shaft of the shift correcting cam 83. The shift detecting sensor 81 is constituted, for example, by an LED and two photo-diodes. A received light quantity of the two photo-diodes varies depending on a flag position of the shift detecting sensor 81. By detecting the received light quantity, the widthwise traveling position of the intermediary transfer belt 7 is grasped. On the inner peripheral surface of the intermediary transfer belt 7, an unshown HP mark is provided, and this HP mark is detected by an unshown belt HP sensor 85 every one full circumference of the intermediary transfer belt 7. The HP mark is used during correction of an edge shape of the intermediary transfer belt 7 at a widthwise end portion of the intermediary transfer belt 7. That is, in some cases, the edge shape of the intermediary transfer belt 7 at the widthwise end portion is not linear but is caused to become wavy. For that reason, the widthwise traveling position of the intermediary transfer belt 7 is detected by the shift detecting sensor 81 while taking the edge shape into consideration, it is possible to properly detect the widthwise traveling position of the intermediary transfer belt 7. Specifically, the edge shape of the intermediary transfer belt 7 at the widthwise end portion varies every intermediary transfer belt 7 due to a condition or the like during processing (cutting) of the intermediary transfer belt 7. Accordingly, during exchange (replacement) of the intermediary transfer belt 7, an operation in a detecting mode of a profile of the edge shape at the widthwise end portion is executed, and a detected profile is stored. By checking this profile against a detection result of the shift detecting sensor 81, the widthwise traveling position of the intermediary transfer belt can be detected more properly. The above-described belt HP detecting sensor detects the HP mark provided on the inner peripheral surface of the intermediary transfer belt 7 and enables preparation of the above-described profile and recognition of a reference position of the intermediary transfer belt 7 with respect to the rotational direction during the shift correction.

Figure 16:
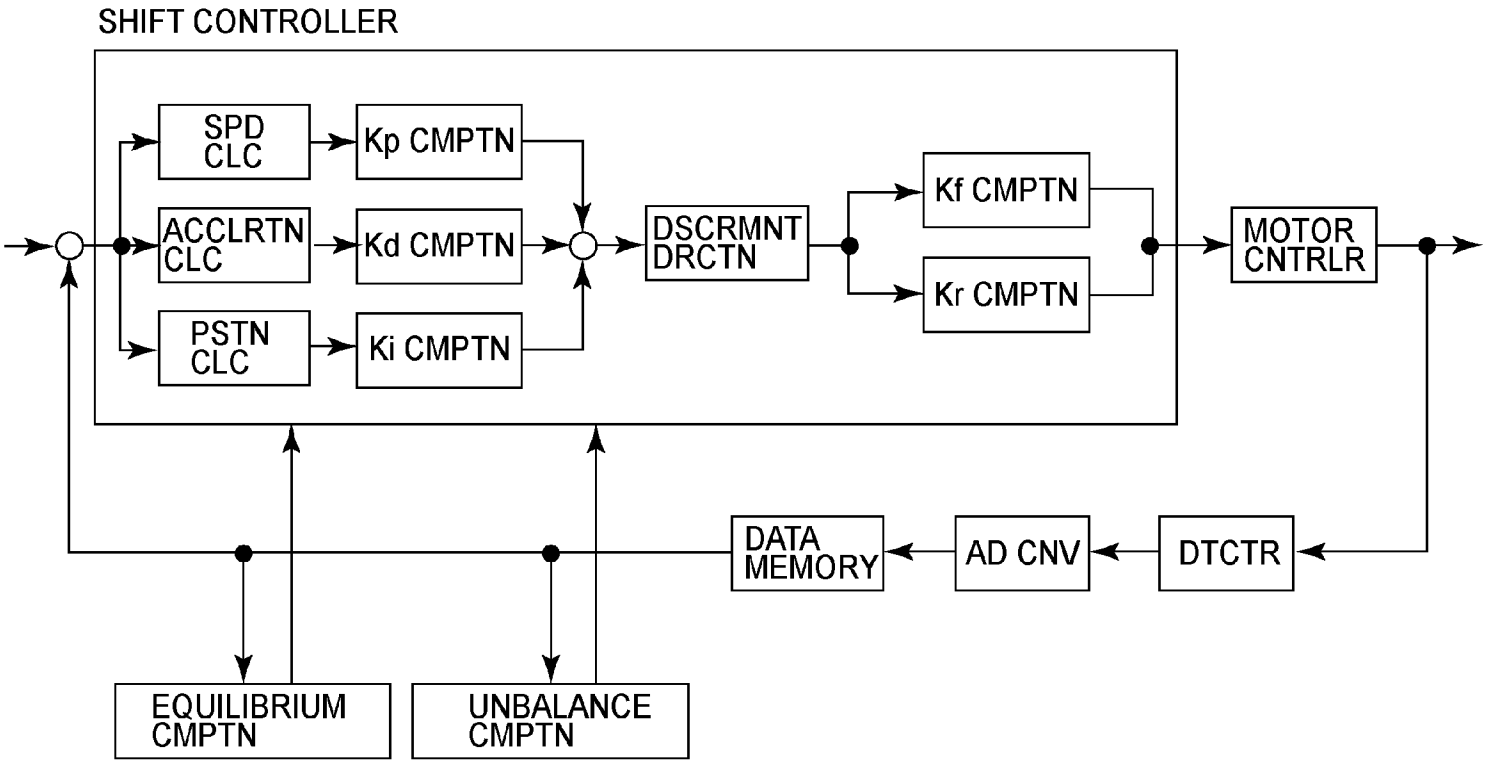
FIG. 16 is a block diagram showing the shift correcting mechanism.

Next, a basic operation of the shift correction by the shift correcting mechanism 80 will be described. FIG. 16 is a block diagram of shift correction control. As shown in FIG. 16, the traveling position of the intermediary transfer belt 7 with respect to the widthwise direction is detected by the shift detecting sensor 81 shown as a shift amount detecting portion in FIG. 16, and a value acquired by AD conversion of a detected signal is stored in a shift amount memory. A shift controller calculates a shift speed, a shift acceleration and a shift position from stored traveling position data of the intermediary transfer belt 7 with respect to the widthwise direction and calculates a shift correction amount on the basis of a result of integration of the above-described values with coefficients Kp, Kd and Ki, respectively, thus controlling the shift correcting motor 84. Incidentally, functions of the shift controller, a motor controller, an equilibrium point operation part and the like shown in FIG. 16 are realized by the controller 110 for effecting integrated control of the operation of the image forming apparatus 100 in this embodiment.

Next, an operation in an equilibrium point detecting mode for acquiring an equilibrium point will be described. The equilibrium point of the shift correcting roller 72 refers to an inclination (tilting position) of the shift correcting roller 72 when the lateral shift of the traveling position of the intermediary transfer belt 7 with respect to the widthwise direction least generates and the intermediary transfer belt 7 is fed most stably. In the operation in the equilibrium point detecting mode, the inclination (tilting) of the shift correcting roller 72 is detected as an angle of rotation (rotational angle) of the shift correcting cam 83 and is stored. The operation in the equilibrium detecting mode is executed, for example, during factory shipment, during initial (stage) installation, during machine movement, during exchange of the intermediary transfer belt 7, and the like.

Figure 17:
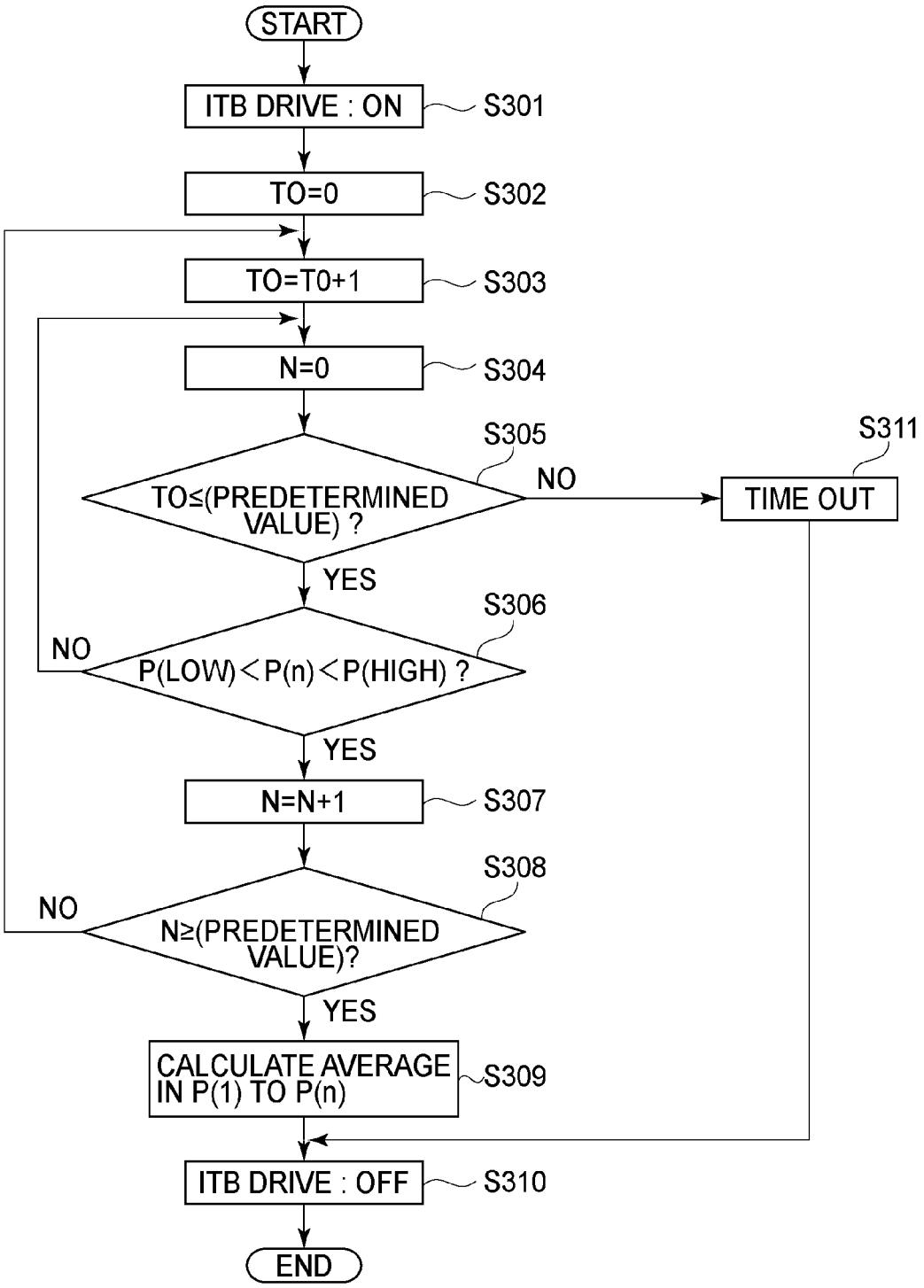
FIG. 17 is a flowchart of an equilibrium point detecting mode of a shift correcting roller.
Figure 18:
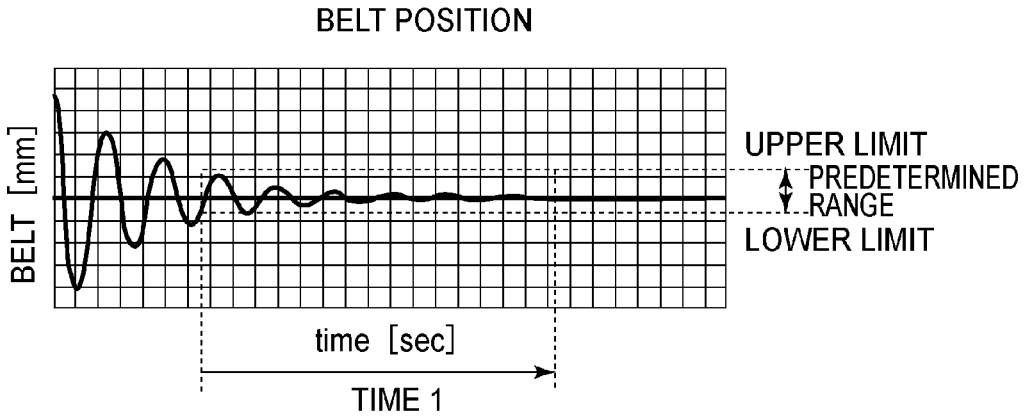
In FIG. 18, (a) and (b) are illustrations of an operation in the equilibrium point detecting mode of the shift correcting roller.
Figure 18:
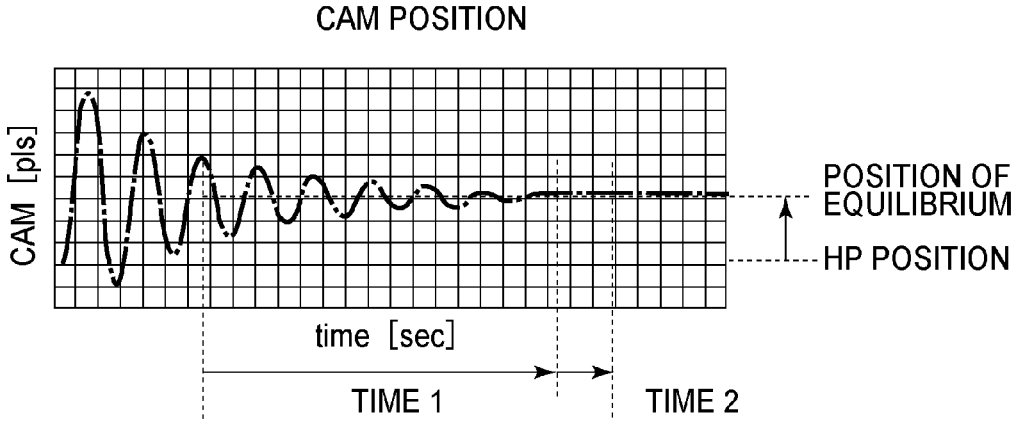

FIG. 17 is a flowchart of the operation in the equilibrium point detecting mode, and (a) and (b) of FIG. 18 are illustrations for explaining an operation for acquiring the equilibrium point of the shift correcting roller 72 in the operation in the equilibrium point detecting mode. The operation in the equilibrium point detecting mode is executed by control of the controller 110.

As shown in FIG. 17, when the operation in the equilibrium point detecting mode is executed, drive of the intermediary transfer belt 7 is turned on, so that the above-described shift control by the shift controller is stored (S301). Then, whether or not the widthwise traveling position of the intermediary transfer belt 7 continuously falls within a predetermined range between an upper-limit position (P) (e.g., +0.3 mm) and a lower-limit position (P) (e.g., −0.3 mm) for a predetermined time (e.g., 60 sec) is determined (S302-S306). At this time, if the widthwise traveling position of the intermediary transfer belt 7 falls within the predetermined range for the predetermined time, discrimination that feeding of the intermediary transfer belt 7 is stable is made ((a) of FIG. 18).

After the discrimination that the feeding of the intermediary transfer belt 7 is stable is made, an average of values of the inclination of the shift correcting roller 72 for the predetermined time (e.g., 10 sec) is computed as the angle of rotation of the shift correcting cam 83 (S307-S309). At this time, a computation (operation) result of the angle of rotation of the shift correcting cam 83 is stored as the equilibrium point ((b) of FIG. 18). Thereafter, the drive of the intermediary transfer belt 7 is turned off (S310).

When the drive of the intermediary transfer belt 7 is started, by moving the shift correcting roller 72 to the equilibrium point every time, the feeding of the intermediary transfer belt 7 can be started in a state in which the degree of the lateral shift of the intermediary transfer belt 7 is smallest.

3. Speed Instruction (Command) Value Adjusting Mode

Figures 19, 19A, 19B:
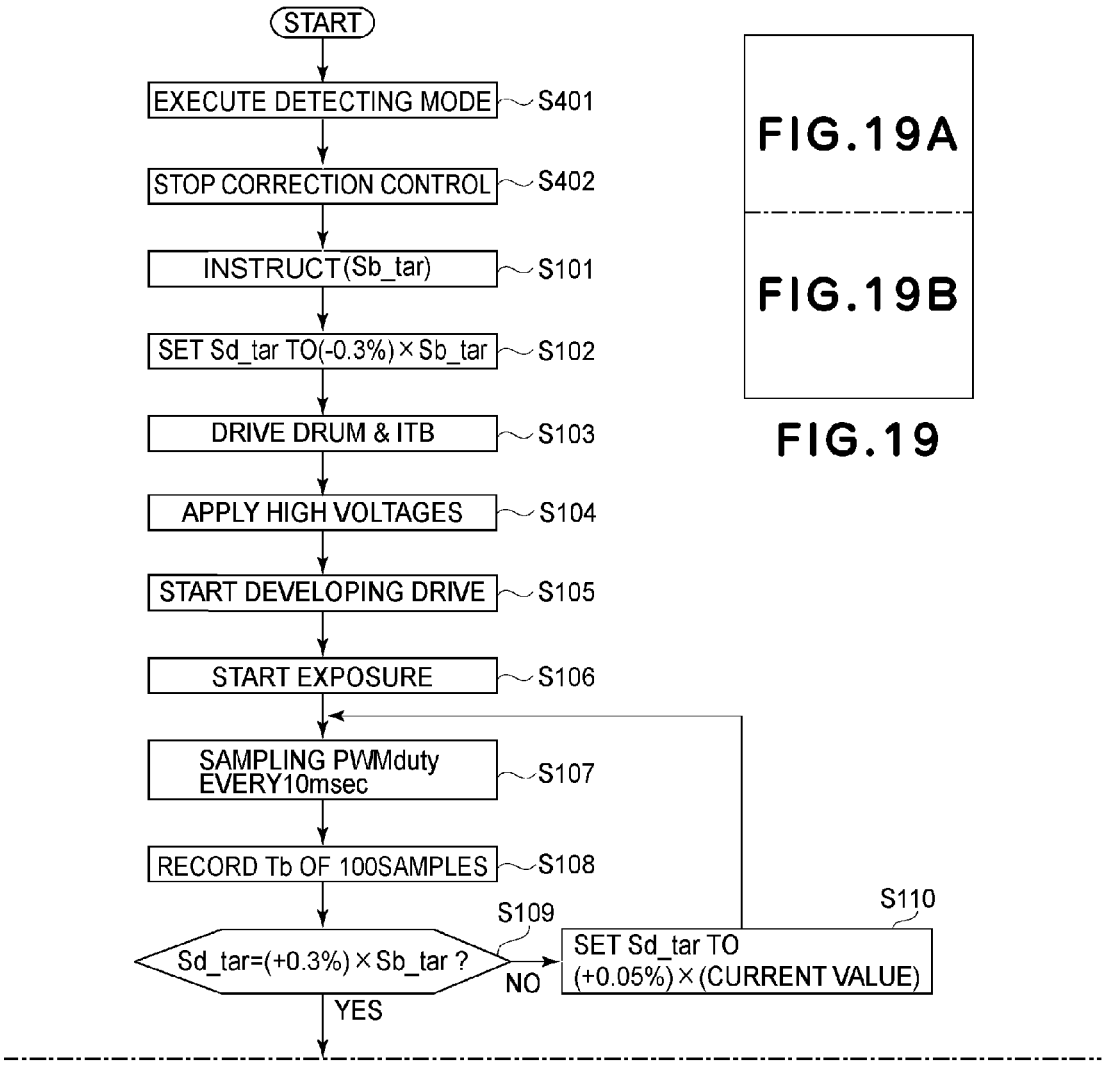
FIG. 19, comprised of FIGS. 19A and 19B, is a flowchart of a speed instruction value adjusting mode in Embodiment 4.
Figure 19B:
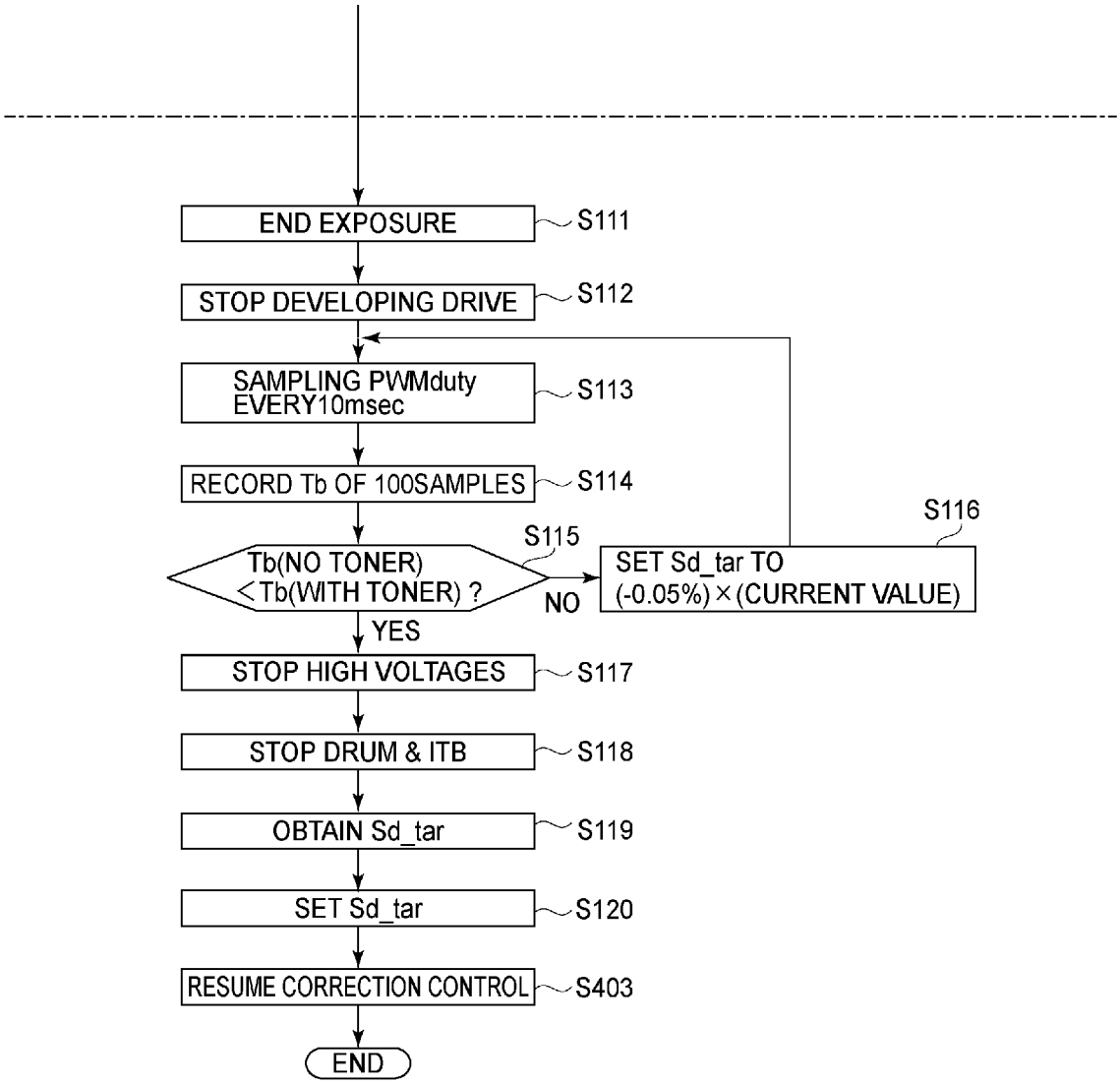

Next, the speed instruction value adjusting mode in this embodiment will be described. FIG. 19 is a flowchart schematically showing a procedure of an operation in the speed instruction value adjusting mode in this embodiment. In the operation in the speed instruction value adjusting mode, processes similar to those in Embodiment 1 in accordance with the flowchart of FIG. 7 are represented by the same step symbols and will be omitted from detailed description.

First, when the operation in the speed instruction value adjusting mode is started, the controller 110 executes the operation in the equilibrium point detecting mode of the shift correcting roller 72 (S401). When the equilibrium point of the shift correcting roller 72 has already been stored at this time and there is no need to execute the operation in the equilibrium point detecting mode, the operation in the equilibrium point detecting mode is not required to be performed.

As described above, by moving the shift correcting roller 72 to the equilibrium point when the drive of the intermediary transfer belt 7 is started, the intermediary transfer belt 7 can be fed in a state in which the degree of the lateral shift is smallest. For that reason, in this embodiment, a required time for the processes of the operation in the speed instruction value adjusting mode and later are about 60 sec, but the intermediary transfer belt 7 is not completely shifted to the longitudinal end of the stretching rollers even when the shift correction by the shift correcting mechanism 80 is not made for that period (about 60 sec).

Therefore, the controller 110 then moves the shift correcting roller 72 to the equilibrium point and stops the shift correction by the shift correcting mechanism 80 (S402).

Thereafter, the controller 110 executes the same processes as those of S101-S120 in FIG. 7. As a result, Sd-tar where the difference in Tb during toner existence and during no toner is substantially 0 is acquired, and on the basis of this Sd-tar, the speed instruction value for the photosensitive drum 1 during the image formation is set.

Finally, the controller 110 eliminates the stop of the shift correction by the shift correcting mechanism 80 and resumes the shift correction (S403).

As described above, the image forming apparatus 100 in this embodiment includes an adjusting means (shift correcting mechanism) 80 for adjusting the widthwise traveling position of the intermediary transfer belt 7 by tilting at least one stretching roller of the plurality of speeding rollers for the intermediary transfer belt 7. Then, the controller does not cause the adjusting means 80 to execute the adjustment in the first detecting period and the second detecting period in the above-described detecting operation. Particularly, in this embodiment, the controller 110 causes the adjusting means 80 to dispose the above-described at least one stretching roller at a predetermined tilting position before the execution of the detecting operation, and does not cause the adjusting means 80 to make the adjustment during the execution of the detecting operation. The predetermined tilting position is acquired in advance so that the widthwise traveling position of the intermediary transfer belt 7 can be caused to fall within the predetermined range for the predetermined time.

As described above, according to this embodiment, the influence of the shift correction by the shift correcting mechanism 80 is suppressed, so that an effect similar to that in Embodiment 1 can be obtained.

In this embodiment, the influence of the shift correction on the adjustment of the speed instruction value was eliminated by stopping the shift correction by the shift correcting mechanism 80 during the operation in the speed instruction value adjusting mode, so that the speed instruction value was able to be adjusted with high accuracy. However, depending on a constitution of the image forming apparatus, it would be considered that when the shift correction is stopped in all of periods in the operation in the speed instruction value adjusting mode, the traveling position of the intermediary transfer belt 7 with respect to the widthwise direction is completely shifted to the longitudinal ends of the stretching rollers. In this case, for example, when a detection value of the shift detecting sensor 81 shows a position out of the predetermined range, the operation in the speed instruction value adjusting mode is temporarily stopped. Then, an operation (which may be the same operation as the operation in the equilibrium point detecting mode) for causing the widthwise traveling position of the intermediary transfer belt 7 to fall within the predetermined range is executed and the movement of the shift correcting roller 72 to the equilibrium point is effected again, and thereafter the operation in the speed instruction value adjusting mode can be resumed. As a result, an effect similar to that in this embodiment can be obtained. That is, the controller 110 causes the adjusting means 80 to dispose at least one stretching roller at the predetermined tilting position before the execution of the detecting operation and does not cause the adjusting means 80 to make the adjustment and then resume the operation in the speed instruction value adjusting mode. In the case where the widthwise traveling position of the intermediary transfer belt 7 exceeds the predetermined range and changes during the execution of the detecting operation, the detecting operation is interrupted and then the adjustment by the adjusting means 80 is made. As a result, the widthwise traveling position of the intermediary transfer belt 7 is caused to fall within the predetermined range, and typically, the above-described at least one stretching roller is disposed at the predetermined tilting position described above. Thereafter, the detecting operation can be resumed without making the adjustment by the adjusting means 80.

Further, depending on a constitution of the image forming apparatus, it would be considered that the equilibrium point of the shift correcting roller 72 is unstable and the shift correction cannot be stopped. In this case, as an operation mode of the shift correcting mechanism 80, separately from a normal mode in the case where the intermediary transfer belt 7 is fed during the image formation or the like, a special mode for making the shift correction in the operation in the speed instruction value adjusting mode may also be provided. In this special mode, for example, a correction speed and a correction amount of the widthwise traveling position of the intermediary transfer belt 7 are reduced, so that a fluctuation in load on the intermediary transfer belt 7 is suppressed. Specifically, in the special mode, compared with the normal mode, a speed of changing the tilting position of the shift correcting roller 72 can be lowered and an upper limit of the tilting angle can be made small. That is, the controller 110 makes an adjusting gain by the adjusting means 80 against the change in widthwise traveling position of the intermediary transfer belt 7 smaller than that during the image formation and can make the adjustment by the adjusting means 80.

In this embodiment, as the operation for setting the speed instruction value in the operation in the speed instruction value adjusting mode, an operation similar to the operation in Embodiment 1 is applied, but operations similar to those in Embodiments 2 and 3 may also be applied.

Embodiment 5

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

In Embodiments 1-4, the example in which the operation in the speed instruction value adjusting mode is executed in the case where any one of the plurality of photosensitive drums 1 or the intermediary transfer belt 7 is exchanged was described.

However, in some cases, for example, depending on a characteristic of the intermediary transfer belt 7, the friction coefficient between the photosensitive drum 1 and the intermediary transfer belt 7 is small at an initial stage of use of the photosensitive drum 1 and the intermediary transfer belt 7 and thus the speed instruction value cannot be adjusted with high accuracy in the operation in the speed instruction value adjusting mode. That is, the slope of Tb in the case where the frictional force between the photosensitive drum 1 and the intermediary transfer belt 7 is made relatively large does not become sufficiently large, so that the speed instruction value, for the photosensitive drum 1, where the surface speeds of the photosensitive drum 1 and the intermediary transfer belt 7 are equal to each other cannot be acquired with high accuracy.

Therefore, in this embodiment, as described specifically later, the operation in the speed instruction value adjusting mode is executed after the surfaces of the photosensitive drum 1 and/or the intermediary transfer belt 7 are properly roughened by use and thus the friction coefficient between the photosensitive drum 1 and the intermediary transfer belt 7 becomes sufficiently large.

Figure 20:
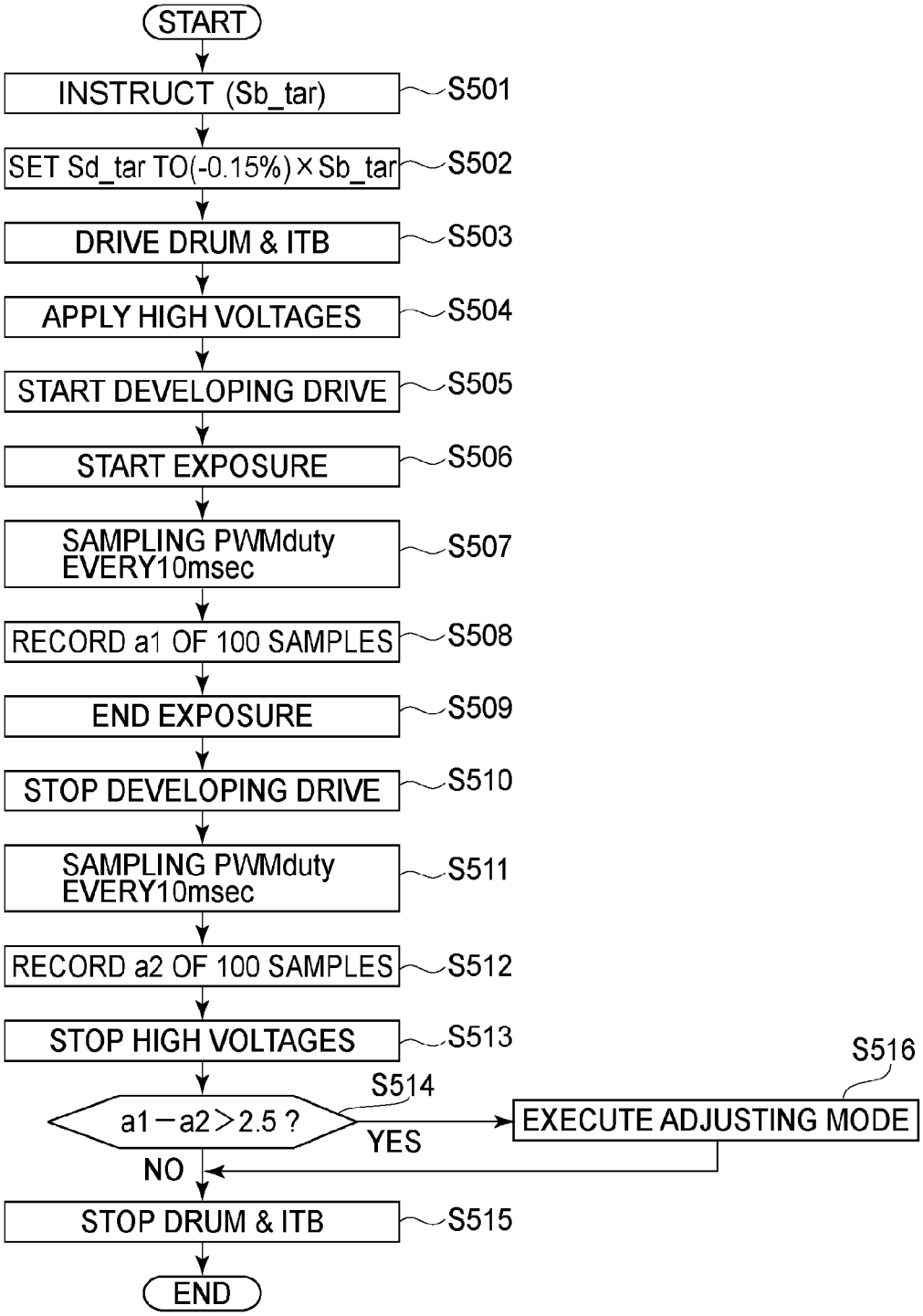
FIG. 20 is a flowchart of execution discrimination control of a speed instruction value adjusting mode in Embodiment 5.

2. Execution Discrimination Control in Operation in Speed Instruction (Command) Value Adjusting Mode Next, control for discriminating whether or not the operation in the speed instruction value adjusting mode in this embodiment is executed will be described. FIG. 20 is a flowchart schematically showing a procedure of an operation of the image forming apparatus including the discrimination control in this embodiment.

When a print job is sent, the controller 110 sets a speed instruction value Sb-tar for the intermediary transfer belt 7 at a fixed value and sets a speed instruction value Sd-tar for all of the photosensitive drums 1 at a value slower than the speed instruction value Sb-tar by 0.15% (S501-S502). Then, the controller 110 executes the pre-rotation and the image forming operation by the above-described sequence (S503-S506).

In a state in which the toner image exists at the primary transfer portion N1 of each of all of the image forming portions S during the image forming operation, the controller 110 detects a duty (PWM duty) of a PWM driving signal, outputted from the ITB speed controller 37 to the ITB driving motor 31, every 10 ms (S507). Then, the controller 110 acquires an average a1 of 100 sampling values for 1 second as a PWM duty during toner existence and then stores the PWM duty (S508).

After the image forming operation is ended, the controller 110 stops the exposure and the developing drive in the listed order in the sequence described above by the post-rotation operation (S509, S510). As a result, the toner on the developing sleeve 41 is not moved onto the photosensitive drum 1, and therefore a state in which there is substantially no toner at the primary transfer portions N1 of all of the image forming portions S is formed.

After the developing drive during the post-rotation operation, the controller 110 detects the duty of the PWM driving signal, every 10 ms, outputted from the ITB speed controller 37 to the ITB driving motor 31 (S511). Then, the controller 110 derives an average a2 of the 100 sampling values for 1 sec as a PWM duty during no toner and stores the PWM duty (S512). Then, the controller 110 ends the application of the charging bias, the developing bias and the primary transfer bias (S513).

Then, the controller 110 discriminates whether or not a difference between the above-described a1 and a2 is not more than a predetermined threshold, 2.5% in this embodiment (S514). In the case where the difference is not more than 2.5% (S514: NO), the controller 110 stops the rotational drive of the intermediary transfer belt 7 and all of the photosensitive drums 1 and thus stops the operation of the image forming apparatus 100 (S515). On the other hand, in the case where the difference between a1 and a2 is larger than 2.5% (S514: YES), the controller 110 executes the operation in the speed instruction value adjusting mode (S516). Thereafter, the controller 110 stops the rotational drive of the intermediary transfer belt 7 and all of the photosensitive drums 1 and thus stops the operation of the image forming apparatus 100 (S515).

In this embodiment, the threshold of the difference between a1 and a2 was 2.5%, but is determined in view of the influence on the image and accuracy of the operation in the speed instruction value adjusting mode for the reasons described later. However, the threshold varies depending on a drive constitution and a control system, so that the present invention is not limited to the above value.

Figure 21:
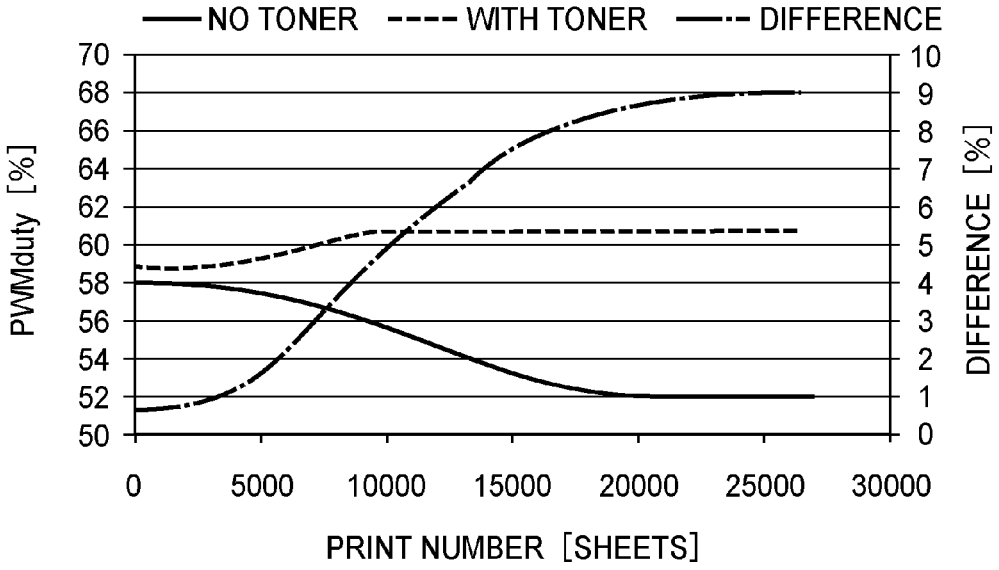
FIG. 21 is a graph showing a progression of a PWM duty of the intermediary transfer belt driving motor depending on the number of sheets subjected to image formation (print number).

FIG. 21 shows progression of the PWM duty of the ITB driving motor in the image forming apparatus in this embodiment depending on an increase in the number of sheets subjected to image formation (print number) from a start of use of the photosensitive drums 1 and the intermediary transfer belt 7. In this case, the image forming operation is performed with setting of Sb-tar at 300 mm/s and Sd-tar at 299.55 mm/s (i.e., the speed instruction difference of −0.15%), and the operation in the speed instruction value adjusting mode was not executed. From FIG. 12, it is understood that the PWM duty during toner existence somewhat increases with an increasing print number, and on the other hand, the PWM duty during no toner largely lowers with the increasing print number. The difference between these values changes a fluctuation in load exerted on the ITB driving motor before and after the developing drive (rotation) during the above-described pre-rotation operation. In the image forming apparatus in this embodiment, when this difference exceeds 2.5%, a rotation fluctuation of the intermediary transfer belt 7 cannot be converged until the image forming operation starts, so that an image defect such as a shock image or color misregistration generates in some cases.

Further, in some cases, in a state in which the photosensitive drum 1 and the intermediary transfer belt 7 are close to a brand new condition, for example, in a state in which the print number is about 3000 sheets in which the difference in PWM duty during toner existence and during no toner, a relationship between the PWM duty and the speed instruction difference similar to that in FIG. 9 is provided. In this case, a sufficient difference in slope of Tb cannot be obtained during toner existence and during no toner, so that an error when Sd-tar where the difference in Tb is substantially 0 is acquired becomes large in some cases.

For that reason, in this embodiment, after the difference between a1 and a2 exceeds 2.5%, as described above, the operation in the speed instruction value adjusting mode is executed.

Here, in the case where the operation in the speed instruction value adjusting mode is executed in accordance with FIG. 20, until any one of the plurality of photosensitive drums 1 or the intermediary transfer belt 7 is subsequently exchanged, there is no need to effect the execution discrimination control of the operation in the speed instruction value adjusting mode. The operation in the speed instruction value itself in this embodiment is the same as that in Embodiment 1 performed in accordance with the flowchart of FIG. 7, and therefore description will be omitted.

As described above, in this embodiment, the controller 110 executes a comparison process for comparing a detection result of the detecting means 37 between the first state and the second state in the following manner. In the comparison process, the following detecting process is executed in each of the first state and the second state. In the detecting process, the speed instruction values for the driving means 10 for the image bearing member 1 and the driving means 30 for the feeding member 7 are set at predetermined speed instruction values, respectively, and then the image bearing member 1 and the feeding member 7 are driven, so that an output torque of the driving means 30 for the intermediary transfer belt 7 is detected by the detecting means 37. Then, in the case where the difference in detection result of the detecting means 37 between the first state and the second state exceeds the predetermined threshold by the above comparison process, the controller 110 executes the detecting operation and sets the speed instruction value for the photosensitive drum 1 during the image formation. Particularly, in this embodiment, the controller 110 executes the detection in the first state by the detecting means 37 for the comparison process in a state in which the toner in a predetermined amount or more exists between the image bearing member 1 and the feeding member 7 during the image formation.

As described above, in this embodiment, the operation in the speed instruction value adjusting mode is executed in the case where the difference in Tb between during toner existence (during image formation) and during no toner (during post-rotation) exceeds the predetermined value (2.5% in this embodiment). As a result, without generating the image defect such as the shock image or the color misregistration, the speed instruction value where the surface speeds of the photosensitive drum 1 and the intermediary transfer belt 7 are equal to each other can be acquired, so that it becomes possible to set an optimum speed instruction value during the image formation.

In this embodiment, using the first state in which the frictional force between the photosensitive drum 1 and the intermediary transfer belt 7 is relatively small and the second state in which the frictional force is relatively large, whether or not the operation in the speed instruction value adjusting mode should be executed is discriminated by making the comparison of the output torque of the ITB driving motor 31 between during the image formation and during the post-rotation. However, the present invention is not limited thereto; for example, in the case where the execution of the operation in the speed instruction value adjusting mode is instructed, an operation (in a test mode) for discriminating whether or not the operation in the speed instruction value adjusting mode should be executed may also be executed similarly as in the cases of FIG. 20 separately from the image forming operation. In this case, as a method of forming the first state in which the frictional force between the photosensitive drum 1 and the intermediary transfer belt 7 is relatively small and the second state in which the frictional force is relatively large, any of methods described in Embodiments 1-3 may be used.

In this embodiment, in order to discriminate whether or not the operation in the speed instruction value adjusting mode should be executed, the difference in output torque of the ITB driving motor 31 was used, but it is only required that a difference in output torque of at least one of the drum driving motor 11 and the ITB driving motor 31 be used.

In this embodiment, the operation in the speed instruction value adjusting mode, an operation similar to the operation in Embodiment 1, is applied, but operations similar to those in Embodiments 2 and 3 may also be applied.

Embodiment 6

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

In this embodiment, similarly as in Embodiment 5, after the frictional force between the photosensitive drum 1 and the intermediary transfer belt 7 becomes sufficiently large, the operation in the speed instruction value adjusting mode is executed. Particularly, in this embodiment, the operation in the speed instruction value adjusting mode is executed in the case where information on an amount of use from an initial stage of use of the photosensitive drum 1 or the intermediary transfer belt 7 exceeds a threshold set in advance. This threshold can be set in advance so that the slope of Tb between during toner existence and during no toner becomes sufficiently large, depending on the relationship as shown in FIG. 21. In this embodiment, as an example, after at least one of the photosensitive drum 1 and the intermediary transfer belt 7 is exchanged, when the image formation of 5000 sheets is effected, the operation in the speed instruction value adjusting mode is executed.

Incidentally, the information on the amount of use of the intermediary transfer belt 7 is not limited to the print number, but any index correlating with the amount of use of the photosensitive drum 1 or the intermediary transfer belt 7 can be used. For example, the information may also be the number of turns of the intermediary transfer belt 7, a rotation time of the intermediary transfer belt 7, or the like.

Figure 22:
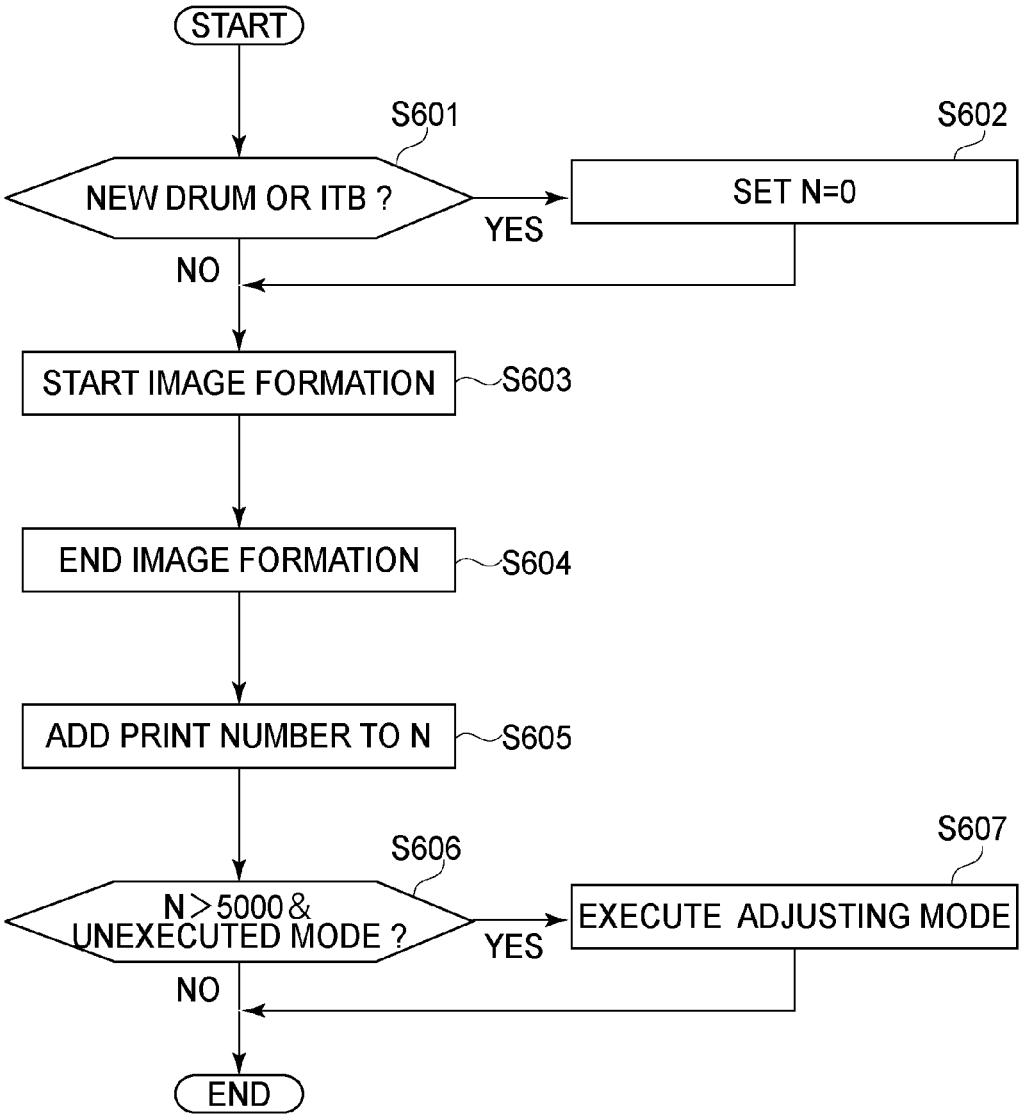
FIG. 22 is a flowchart of execution discrimination control of a speed instruction value adjusting mode in Embodiment 6.

2. Discrimination of Execution of Operation in Speed Instruction Value Adjusting Mode Next, referring to a flowchart of FIG. 22, control for discriminating whether or not the operation in the speed instruction value adjusting mode in this embodiment should be executed will be described. In this embodiment, as a use amount detecting means, the controller 110 updates (renews) the print number in real time from the time of a brand-new condition of the photosensitive drum 1 or the intermediary transfer belt 7 and stores (counts) the print number.

When a print job is sent, the controller 110 discriminates whether or not the photosensitive drum 1 or the intermediary transfer belt 7 is in the brand-new condition (S601), and in the case of the brand-new condition, the controller 110 sets a counter N at 0 (S602). Thereafter, the controller 110 performs a normal image forming operation, and adds the print number (sheets) to the value of the counter N at the time when the print job is ended (S603-S605).

Then, the controller 110 discriminates whether or not the value of the counter N exceeds a predetermined threshold, 5000 sheets in this embodiment (S606). In the case where the value of the counter N is not more than 5000 sheets or the operation in the speed instruction value adjusting mode has already been executed (S606: NO), the controller 110 stops the operation of the image forming apparatus 100. On the other hand, in the case where the value of the counter N exceeds 5000 sheets and the operation in the speed instruction value adjusting mode has not been executed (S606: YES), the controller 110 executes the operation in the speed instruction value adjusting mode (S607). Thereafter, the controller 110 stops the operation of the image forming apparatus 100.

The operation in the speed instruction value itself in this embodiment is the same as that in Embodiment 1 performed in accordance with the flowchart of FIG. 7, and therefore description will be omitted.

Thus, in this embodiment, in the case where the information on the amount of use from start of use of the image bearing member 1 or the feeding member 7 exceeds the predetermined threshold by the above comparison process, the controller 110 executes the detecting operation and sets the speed instruction value for the photosensitive drum 1 during the image formation.

As described above, also in this embodiment, not only an effect similar to that in Embodiment 5 but also different from Embodiment 5, the control in which the torque of the ITB driving motor during toner existence and during no toner is monitored during the image forming operation can be omitted, and therefore the control can be simplified.

In this embodiment, as the operation for setting the speed instruction value in the operation in the speed instruction value adjusting mode, an operation similar to the operation in Embodiment 1, but operations similar to those in Embodiments 2 and 3 may also be applied.

Embodiment 7

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

In this embodiment, similarly as in Embodiments 5 and 6, after the frictional force between the photosensitive drum 1 and the intermediary transfer belt 7 becomes sufficiently large, the operation in the speed instruction value adjusting mode described above is executed. In Embodiment 5, both of Tb measuring operations during toner existence and during no toner in the operation in the speed instruction value adjusting mode was executed in the case where information on an amount of use from an initial stage of use of the photosensitive drum 1 or the intermediary transfer belt 7 exceeds the print number set in advance. However, in some cases, the Tb measurement during toner existence can be sufficiently performed at the time when the use amount of the photosensitive drum 1 or the intermediary transfer belt 7 is smaller. That is, as is understood from the relationship of FIG. 21, at that time when the use amount of the photosensitive drum 1 or the intermediary transfer belt 7 is smaller, an initial fluctuation in Tb during toner existence is stable. Thus, for example, depending on a combination of the photosensitive drum 1 and the intermediary transfer belt 7, the frictional force between the photosensitive drum 1 and the intermediary transfer belt 7 is relatively large from the time close to the initial stage of use and a part of the operation in the speed instruction value adjusting mode can be sufficiently executed in some cases. Further, in some cases, it is unclear that the combination of the photosensitive drum 1 and the intermediary transfer belt 7 which are used for the image formation is a combination in which the frictional force at the initial stage of use is low or a combination in which the frictional force at the initial stage of use is high.

Therefore, in this embodiment, the speed instruction value adjusting operation is performed at timing closer to the initial stage of use, and whether or not a sufficient difference can be acquired in slope of Tb during toner existence and during no toner is discriminated. As a result, in the case where it is discriminated that the sufficient difference cannot be acquired and there is a possibility that an error when Sd-tar where the difference in Tb is substantially 0 is acquired becomes large, a measurement result of Tb during toner existence is recorded, and then only measurement of Tb during no toner is made again after a lapse of a predetermined print number (of sheets subjected to the image formation). As a result, it becomes possible to realize shortening of a control time and reduction of the toner use amount.

Figure 23:
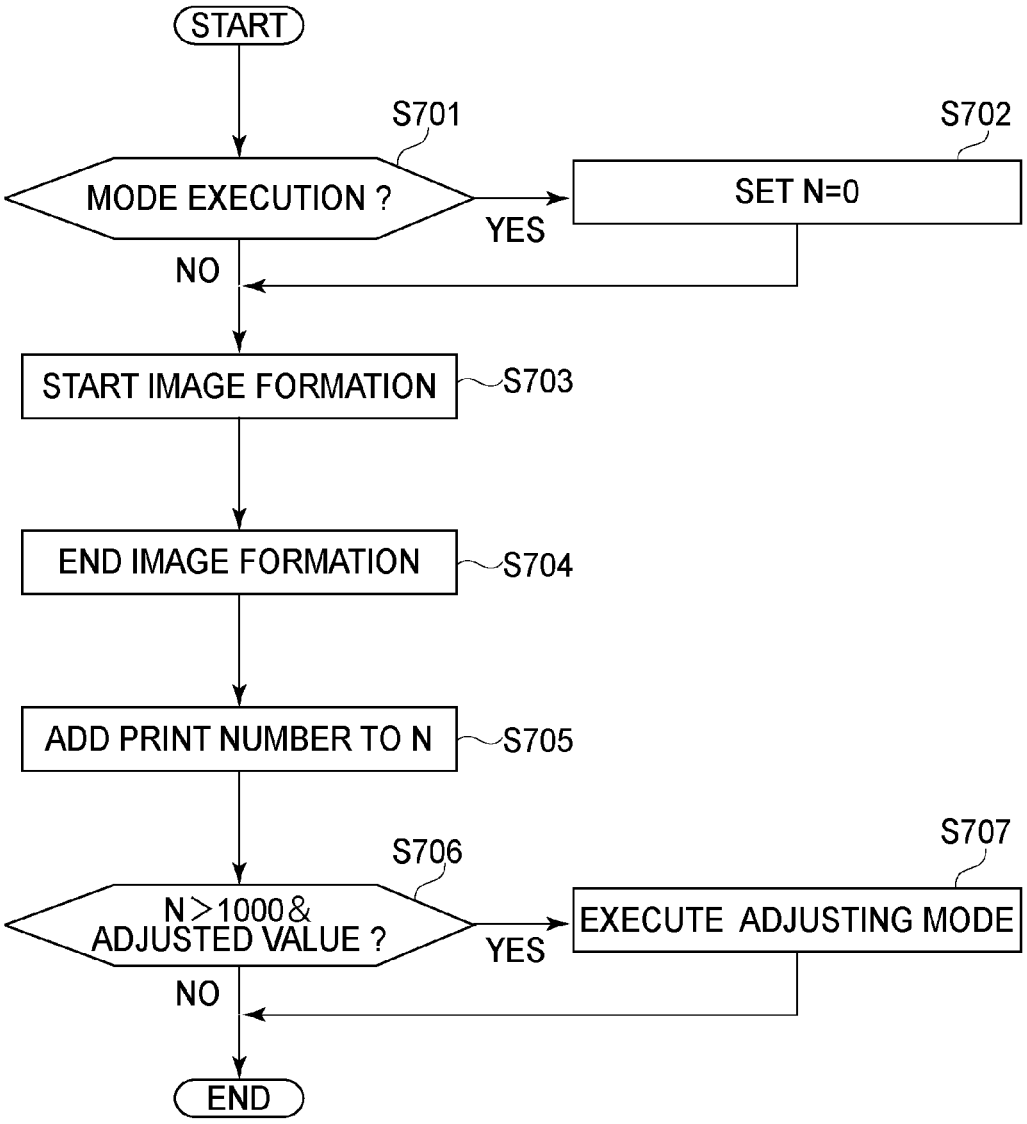
FIG. 23 is a flowchart of execution discrimination control of a speed instruction value adjusting mode in Embodiment 7.

2. Discrimination of Execution of Operation in Speed Instruction Value Adjusting Mode Next, referring to a flowchart of FIG. 23, control for discriminating whether or not the operation in the speed instruction value adjusting mode in this embodiment should be executed will be described. In this embodiment, as a use amount detecting means, the controller 110 updates (renews) the print number in real time from the time of a brand-new condition of the photosensitive drum 1 or the intermediary transfer belt 7 and stores (counts) the print number.

When a print job is sent, the controller 110 discriminates whether or not the operation in the speed instruction value adjusting mode was executed immediately before the sending of the print job (S701), and in the case of the execution of the operation, the controller 110 sets a counter N at 0 (S702). Thereafter, the controller 110 performs a normal image forming operation, and adds the print number (sheets) to the value of the counter N at the time when the print job is ended (S703-S705).

Then, the controller 110 discriminates whether or not the value of the counter N exceeds a predetermined threshold, 1000 sheets in this embodiment (S706). In the case where the value of the counter N is not more than 5000 sheets or the operation in the speed instruction value adjusting mode has already been executed (S706: NO), the controller 110 stops the operation of the image forming apparatus 100. On the other hand, in the case where the value of the counter N exceeds 1000 sheets and the speed instruction value for the photosensitive drum 1 has not been adjusted (S706: YES), the controller 110 executes the operation in the speed instruction value adjusting mode in accordance with the flowchart of FIG. 24 described later (S707). Thereafter, the controller 110 stops the operation of the image forming apparatus 100.

3. Speed Instruction (Command) Value Adjusting Mode

Figures 24, 24A, 24B:
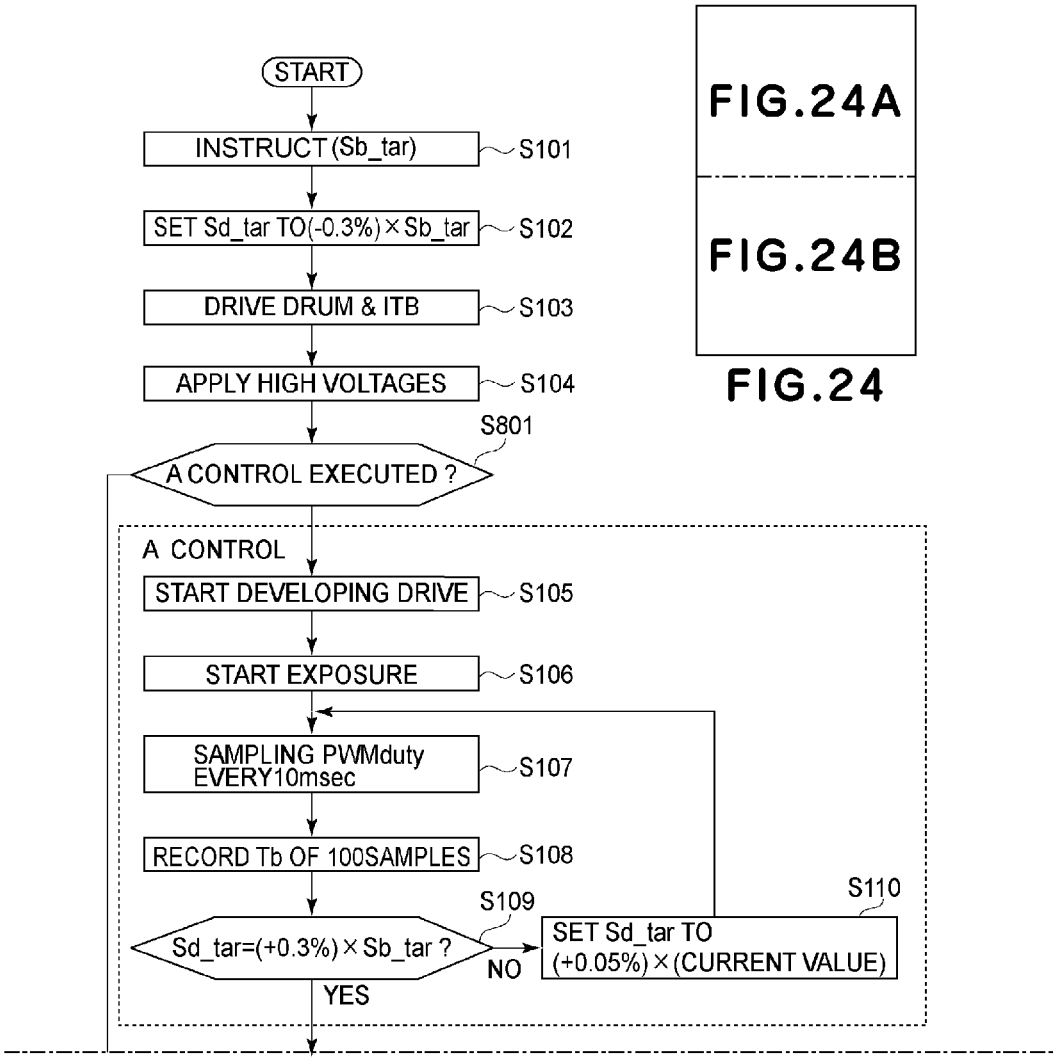
FIG. 24, comprised of FIGS. 24A and 24B, is a flowchart of the speed instruction value adjusting mode in Embodiment 7.
Figure 24B:
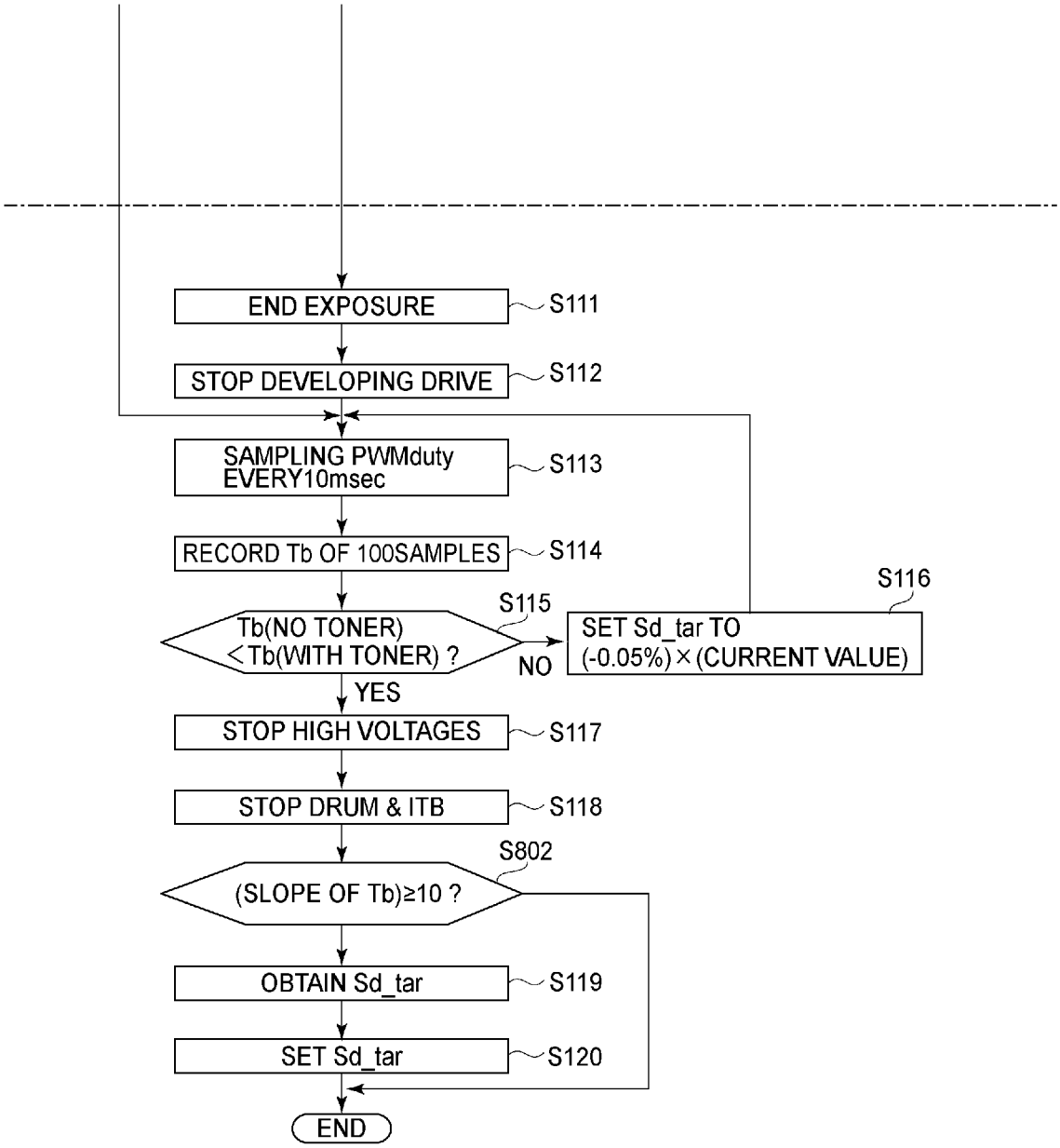

Next, the speed instruction value adjusting mode in this embodiment will be described. FIG. 24 is a flowchart schematically showing a procedure of an operation in the speed instruction value adjusting mode in this embodiment. In the operation in the speed instruction value adjusting mode, processes similar to those in Embodiment 1 in accordance with the flowchart of FIG. 7 are represented by the same step symbols and will be omitted from detailed description.

First, when the operation in the speed instruction value adjusting mode is started, the controller 110 executes the same processes as those in S101-S104 in FIG. 7.

Then, the controller discriminates whether or not A control described later is executed (S801). Then, in the case where discrimination that the A control is not executed is made, the controller 110 executes the same processes as those in S105-S112 in FIG. 7. Here, the processes corresponding to S105-S110 constitute the A control. On the other hand, in the case where discrimination that the A control is executed in S801 is made, the controller 110 omits the A control and the sequence goes to the process of S113. Then, the controller 110 executes the same processes as those in S113-S118.

Then, the controller 110 performs a differential operation of the relationship between Sd-tar and PWM duty acquired by the processes of S113-S116 and thus acquires the slope of Tb during no toner, and then discriminates whether or not a maximum thereof is a predetermined threshold or more (S802). In this embodiment, if the value of the slope is 10 or more, it is possible to accurately acquire the speed instruction value, for the photosensitive drum 1, where the surface speeds of the photosensitive drum 1 and the intermediary transfer belt 7 are equal to each other, and therefore the threshold is set at 10.

In the case where the maximum of the differential value of Tb is 10 or more in S802, the controller 110 executes the same processes as those of S119-S120 in FIG. 7 and then ends the sequence. As a result, Sd-tar where the difference in Tb between during toner existence and during no toner is substantially 0 is acquires, and on the basis of the Sd-tar, the speed instruction value for the photosensitive drum 1 during the image formation is set. On the other hand, in the case where the maximum of the differential value of Tb is less than 10 in S802, the controller 110 ends the sequence without making acquirement of Sd-tar where the difference in Tb between during toner existence and during no toner is substantially 0 and setting of the speed instruction value for the photosensitive drum 1 during the image formation.

Thus, in this embodiment, on the basis of the detection result of the detecting means 37 in the second detecting period of the detecting operation described above, the control means 110 obtains a proportion (ratio) of a change in output torque of the driving means 30 for the intermediary transfer belt 7 relative to the change in speed instruction value for the photosensitive drum 1. Then, in the case where the proportion is less than a predetermined threshold, when the information on the use amount of the image bearing member 1 or the feeding member 7 exceeds the predetermined threshold, another detecting operation including only the second detecting period of the first and second detecting periods is executed. Thereafter, the control means 110 sets the speed instruction value for the photosensitive drum 1 during the image formation on the basis of the detection result of the detecting means 37 in the second detecting period in the above-described detecting operation and the detection result of the detecting means 37 in the first detecting period in another detecting operation described above.

As described above, also in this embodiment, not only an effect similar to those in Embodiments 5 and 6 can be obtained but also it becomes possible to realize shortening of the control time and the reduction in toner use amount.

Embodiment 8

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

1. Summary

In Embodiments 1-7, the speed instruction values for the photosensitive drums 1 of all of the image forming portions during the image formation were collectively adjusted. However, in some cases, there is a variation in tolerance of outer diameter among the photosensitive drums 1 of the image forming portions and in this case, a variation in surface speed difference between the photosensitive drum 1 and the intermediary transfer belt 7 can generate among the image forming portions S. For that reason, in some cases, pulling or loosening of the intermediary transfer belt 7 generates among the image forming portions S within a range of the tolerance of the outer diameter of the photosensitive drums 1. As a result, in some cases, the image defect such as the color misregistration occurs.

Therefore in this embodiment, the speed instruction value for the photosensitive drum 1 where the surface speeds of the photosensitive drum 1 and the intermediary transfer belt 7 are equal to each other is acquired every image forming portion S, and on the basis of the speed instruction value, an optimum speed instruction value for the photosensitive drums 1 during the image formation is made settable. Typically, in an operation in a single speed instruction value adjusting mode, it is possible to effect a series of setting processes for setting all of speed instruction values for the plurality of photosensitive drums 1 one by one. However, the present invention is not limited thereto, but in the operation in the single speed instruction value adjusting mode, it is possible to set at least one speed instruction value of the speed instruction values for the plurality of photosensitive drums 1. At this time, it is not necessarily limited to individual adjustment of the speed instruction values for the plurality of photosensitive drums 1, but similarly as in the above-described embodiments, some of the speed instruction values for the photosensitive drums 1 may also be collectively adjusted. For example, in the operation in the single speed instruction value adjusting mode, it is possible to set only the speed instruction value(s) for the exchanged photosensitive drum(s) 1 of the plurality of photosensitive drums 1 one by one or collectively for some speed instruction values.

3. Speed Instruction (Command) Value Adjusting Mode

Figures 25, 25A:
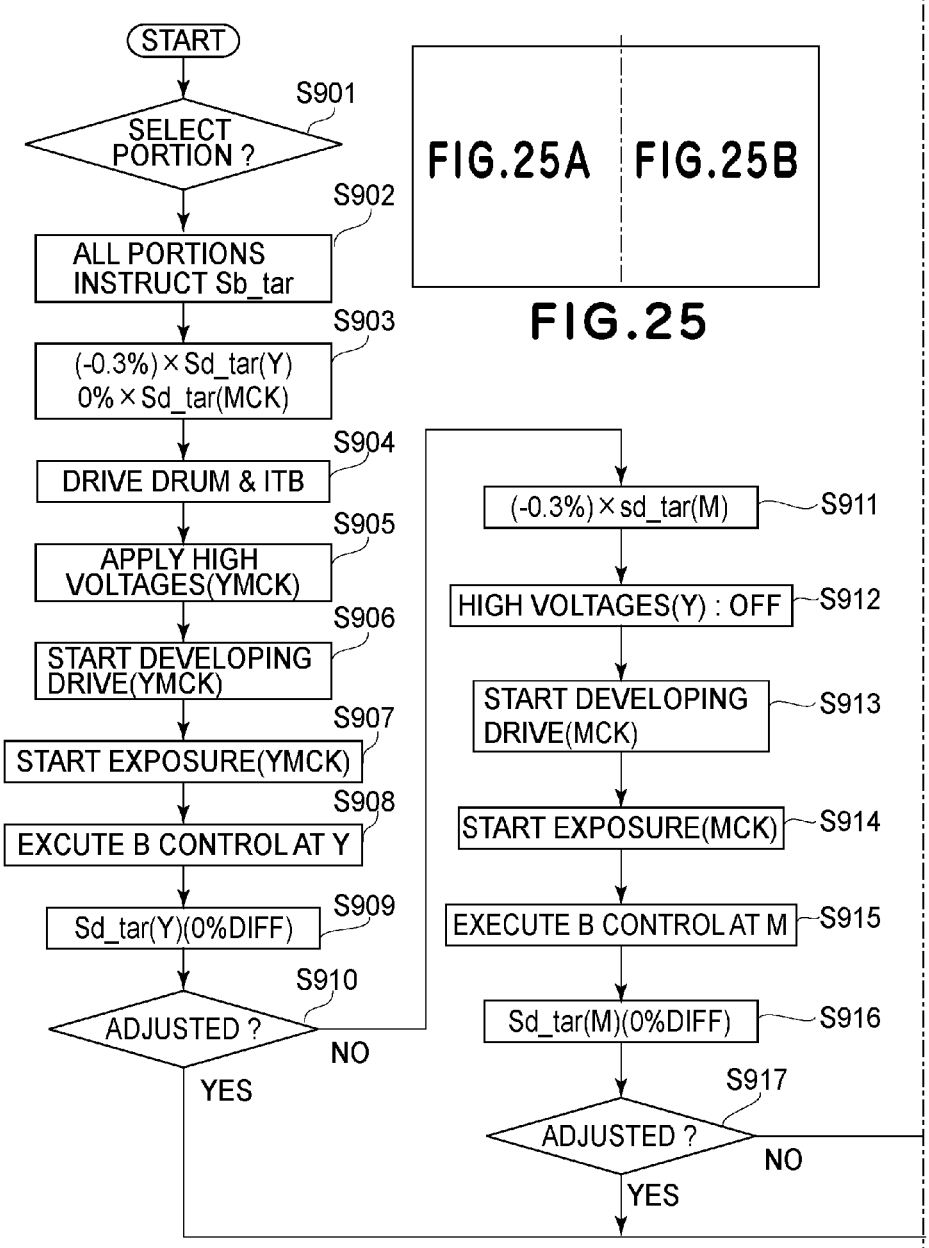
FIG. 25, comprised of FIGS. 25A and 25B, is a flowchart of an example of a speed instruction value adjusting mode in Embodiment 8.
Figure 25B:
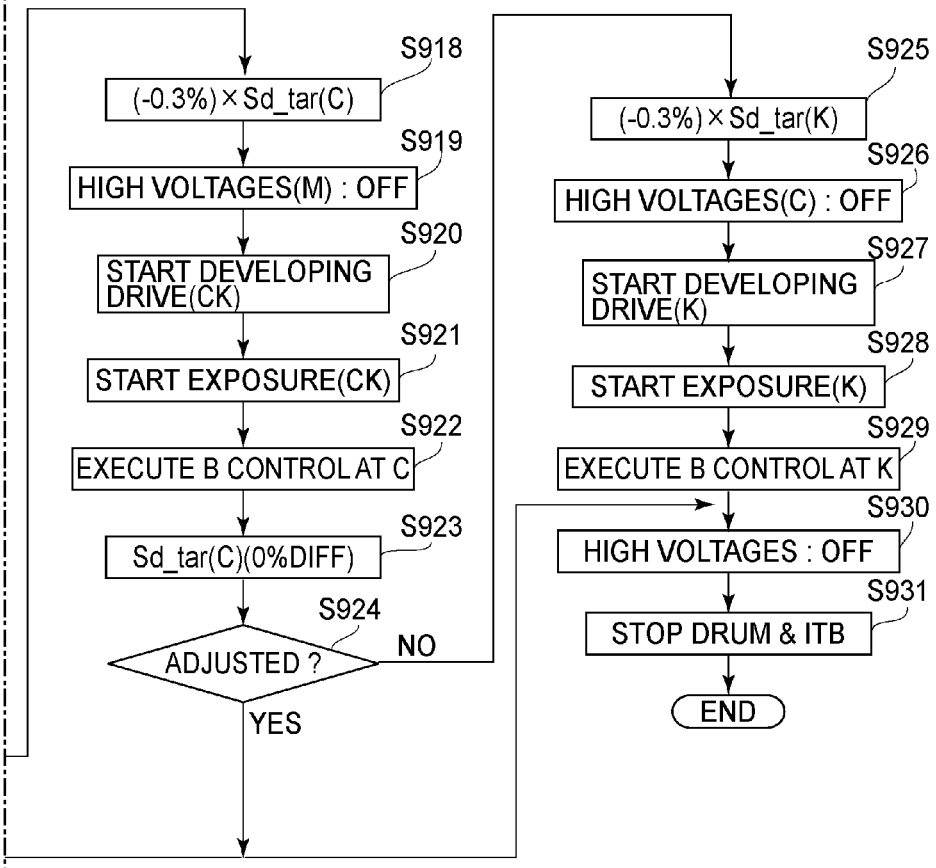
Figure 26:
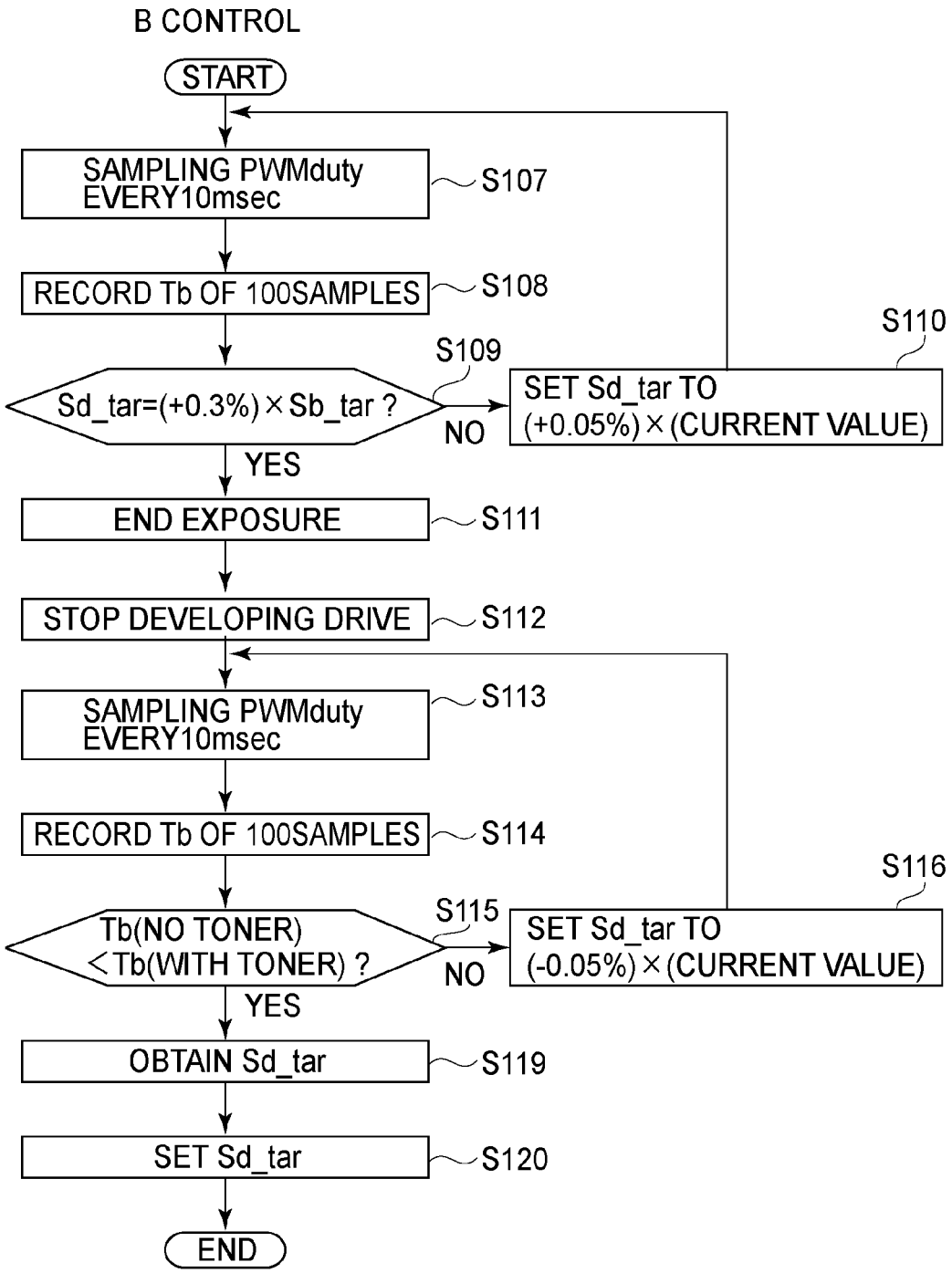
FIG. 26 is a flowchart of another example of the speed instruction value adjusting mode in Embodiment 8.

Next, the speed instruction value adjusting mode in this embodiment will be described. FIGS. 25 and 26 are flowcharts each schematically showing an example of a procedure of an operation in the speed instruction value adjusting mode in this embodiment. In the flowchart of FIG. 26, processes similar to those in Embodiment 1 in accordance with the flowchart of FIG. 7 are represented by the same step symbols and will be omitted from detailed description. Here, first, the case where in the operation in the single speed instruction value adjusting mode, the speed instruction values for the photosensitive drums 1 of all of the image forming portions S are successively set one by one will be described. Particularly, in this embodiment, with respect to the rotational direction of the intermediary transfer belt 7, the speed instruction values for the photosensitive drums 1 are successively adjusted one by one from the most upstream image forming portion S to the most downstream image forming portion S.

In this embodiment, the controller 110 executes the operation in the speed instruction value adjusting mode in the case where exchange (replacement) of any one of the plurality of photosensitive drums 1 or the intermediary transfer belt 7 is detected or on the basis of start instruction (command) from an operator such as a user or a service person.

Referring to FIG. 25, first, when the operation in the speed instruction value adjusting mode is started, the controller 110 selects the image forming portion S to be subjected to the adjustment of the speed instruction value (S901). As described above, in this case, the case where the speed instruction values for the photosensitive drums 1 of all of the image forming portions S will be described.

The controller 110 sets a speed instruction value Sb-tar for the intermediary transfer belt 7 at a fixed value (S902). Then, the controller 110 sets a speed instruction value Sd-tar for the Y photosensitive drum 1Y at a value slower than the speed instruction value Sb-tar by 0.3% and sets speed instruction values Sd-tar for the MCK photosensitive drums 1M, 1C, 1K at a fixed value (speed instruction difference: 0%) equal to the speed instruction value Sb-tar (S903). Then, the controller 110 starts constant-speed rotation of the ITB driving motor 31 and all of the drum driving motors 11 (S904).

The controller 110 starts, when the speeds of the intermediary transfer belt 7 and all of the photosensitive drums 1 become desired speeds, application of each of the charging bias, the developing bias and the primary transfer bias at the above-described timing at all of the image forming portions S (S905). Further, when the application of each of the biases is started, at all of the image forming portions S, the developing drive is started and exposure is started by inputting a predetermined image signal into the exposure device 3, and then predetermined toner images are sent to the primary transfer portions N1 (S906-S907).

Then, the controller 110 controller 110 executes B control at the Y image forming portion SY in accordance with FIG.

26. As shown in FIG. 26, the controller 110 executes, as the B control, the same processes as those of S107-S116 and S119-S120 of FIG. 7. At this time, at the MCK image forming portions SM, SC, SK, the developing drive (rotation) is made as described above so as not to have the influence on the adjustment of the speed instruction value by the B control at the Y image forming portion SY, so that the primary transfer portions N1 are placed in a state in which the toner images always exist. That is, at the image forming portions other than the image forming portion S where the adjustment of the speed instruction value is made by the B control, a state in which the frictional force between the photosensitive drum 1 and the intermediary transfer belt 7 is relatively small is formed, so that sensitivity to the fluctuation in output torque of the ITB driving motor is lowered. Specifically, at the image forming portion S downstream, with respect to the rotational direction of the intermediary transfer belt 7, of the image forming portion S where the adjustment of the speed instruction value is made by the B control as described above, the sensitivity can be lowered by causing the toner to exist between the photosensitive drum 1 and the intermediary transfer belt 7. In the B control, in S111, the exposure by all of the exposure devices 3 (the YMCK exposure devices in this case) which are turned on is ended. Further, in the B control, in S112, the developing drive of all of the developing devices (the YMCK developing devices in this case) which are turned on is stopped. By the process described above, it is possible to acquire Sd-tar for the Y photosensitive drum 1 capable of making the surface speeds of the Y photosensitive drum 1 and the intermediary transfer belt 7 equal to each other. Further, by the processes described above, on the basis of the acquired Sd-tar for the Y photosensitive drum 1Y, it is possible to set Sd-tar for the Y photosensitive drum 1 during the image formation.

Referring again to FIG. 25, the controller 110 then sets the speed instruction value for the Y photosensitive drum 1 at Sd-tar where the difference in Tb acquired by the B control in S908 is substantially 0 (S909). Thus, at the image forming portion S where the speed instruction value has already been adjusted by the B control, Sd-tar is set at the Sd-tar where the difference in Tb acquired by the B control is substantially 0. As a result, at the Y image forming portion SY, the surface speeds of the photosensitive drum 1 and the intermediary transfer belt 7 coincide with each other, and therefore at the primary transfer portion N1, the speed of the intermediary transfer belt 7 is not adversely affected depending on the presence or absence of the toner. For that reason, during adjustment of the speed instruction values for the MCK photosensitive drums 1M, 1C, 1K at subsequent MCK image forming portions SM, SC, SK, no toner state can be formed at the primary transfer portion N1Y at the Y image forming portion SY. that is, the developing drive can be kept stopped. As a result, the toner from the Y image forming portion SY is supplied to the primary transfer portions N1M, N1C, N1K at the downstream MCK image forming portions SM, SC, SK, so that it is possible to prevent the influence on the adjustment of the speed instruction values for the photosensitive drums 1 at the downstream image forming portions.

Then, the controller 110 potentials whether or not the adjustment of the speed instruction values at all of the image forming portions S selected in the operation in the speed instruction value adjusting mode (S910). In this case, the case where the adjustment of the speed instruction values at all of the image forming portions S is described as an example, and therefore the sequence has not been ended yet.

Then, the controller 110 sets the speed instruction value Sd-tar for the M photosensitive drum 1M at a value slower than Sb-tar by 0.3% (S911). Then, the controller 110 ends the application of the charging bias, the developing bias and the primary transfer bias at the Y image forming portion SY (S912). Thus, at the image forming portion S where the speed instruction value has already been adjusted by the B control, also the primary transfer bias may desirably be turned off (0 V). As a result, for some reason, even in the case where a minute deviation generates between the surface speeds of the photosensitive drum 1 and the intermediary transfer belt 7 at the image forming portion S where the speed instruction value adjustment has already been made, it is possible to reduce a degree of the influence of the deviation on the adjustment of the speed instruction values at the downstream image forming portions S.

Thereafter, the controller 110 starts the developing drive at the MCK image forming portions SM, SC, SK and starts the exposure by inputting a predetermined image signal into the exposure device 3, so that a predetermined toner image is sent to the primary transfer portion N1 (S913-S914).

Then, the controller 110 executes the B control at the M image forming portion SM in accordance with the flowchart of FIG. 26, so that the adjustment of the speed instruction value for the M photosensitive drum 1M is made (S915).

Subsequently, similarly as in S909-S915 described above, the speed instruction value adjustment for the C photosensitive drum 1C and the speed instruction value adjustment for the K photosensitive drum 1K are made at the C image forming portion SC in S916-S922 and at the K image forming portion SK in S923-S929, respectively. At this time, similarly as described above, as shown in FIG. 25, at the image forming portion S downstream of the image forming portion S where the speed instruction value adjustment is made, in order to prevent the influence on the image forming portion S where the speed instruction value adjustment is made, a state in which the toner image already exists at the associated primary transfer portion N1 is formed. Further, at the image forming portion S where the speed instruction value has already been adjusted by the B control, Sd-tar is set at the Sd-tar where the difference in Tb acquired by the B control is substantially 0, and the primary transfer bias is turned off (0 V).

Then, the controller 110 ends the application of the charging bias, the developing bias and the primary transfer bias (at the K image forming portion SK in this case) (S930), and then stops the rotational drive of the intermediary transfer belt 7 and all of the photosensitive drums 1 (S931).

As described above, at each of the image forming portions S, an optimum speed instruction value for the photosensitive drum 1 during the image formation can be set. As a result, even in the case where there is a variation in tolerance of the outer diameter among the photosensitive drums 1 of the image forming portions S and thus a variation in surface speed difference between the photosensitive drum 1 and the intermediary transfer belt 7 generates among the image forming portions S, the variation is corrected, so that a good image can be outputted.

3. Modified Embodiment

In the above-described embodiments, the case where the speed instruction value adjustment for the photosensitive drums 1 at all of the image forming portions was made was described as an example, but the present invention is not limited thereto as described above. For example, the flowchart of FIG. 25 can meet the case where the speed instruction value adjustment for the photosensitive drum 1 is made only at the Y image forming portion SY, only at the YM image forming portions SY, SM or only at the YMC image forming portions SY, SM, SC. In this case, it is only required that the speed instruction value adjustment for the photosensitive drums 1 is made successively from the upstream image forming portion S and the sequence is caused to go to S930 at the time when the speed instruction value adjustment for the photosensitive drums 1 at all of the selected image forming portions S is ended. Further, also in the case where the speed instruction value adjustment for the photosensitive drum 1 is made only at the M image forming portion SM, only at the MC image forming portions SM, SC, and only at the MCK image forming portions SM, SC, SK, it would be easily understood that the control may only be required to be effected in accordance with the flowchart of FIG. 25. In this case, it is only required that the image forming portion S where the speed instruction value adjustment for the photosensitive drum 1 is first made is the M image forming portion SM and that then the speed instruction value adjustment for the photosensitive drums 1 is successively made at the selected downstream image forming portions S. In this case, at the Y image forming portion SY upstream of the M image forming portion SM where the speed instruction value adjustment is first made, Sd-tar may only be required to be made equal to the speed instruction value Sb-tar for the intermediary transfer belt 7. This is true for also the case where the speed instruction value adjustment for the photosensitive drum 1 is made only at the C image forming portion SC or only at the CK image forming portions SC, SK. Further, this is true for also the case where the speed instruction value adjustment for the photosensitive drum 1 is made only at the K image forming portion SK, and in this case, this adjustment corresponds to the speed instruction value adjustment for the photosensitive drum 1 only at the K image forming portion SK where the speed instruction value adjustment is first made.

Further, in the above-described embodiments, as a method in which the sensitivity to the adjustment is lowered at the downstream image forming portion S than at the image forming portion S where the speed instruction value adjustment is made. However, the method is not limited thereto, but any of the methods, described in Embodiments 1-3, for relatively decreasing the frictional force between the photosensitive drum 1 and the intermediary transfer belt 7 may also be used. That is, the primary transfer bias may also be turned off or the pressure at the primary transfer portion N1 may also be lowered. Further, in the above-described embodiments, at the image forming portion S upstream of the image forming portion S where the speed instruction value adjustment is made, the primary transfer bias is turned off, so that the influence on the adjustment is further suppressed. Similarly, the absolute value of the voltage or the current of the primary transfer bias may also be made smaller than that during the image formation. Further, in place of or in addition to the turning ON/OFF (large/small) of the primary transfer bias, the pressure at the primary transfer portion N1 may also be lowered.

Figure 12:
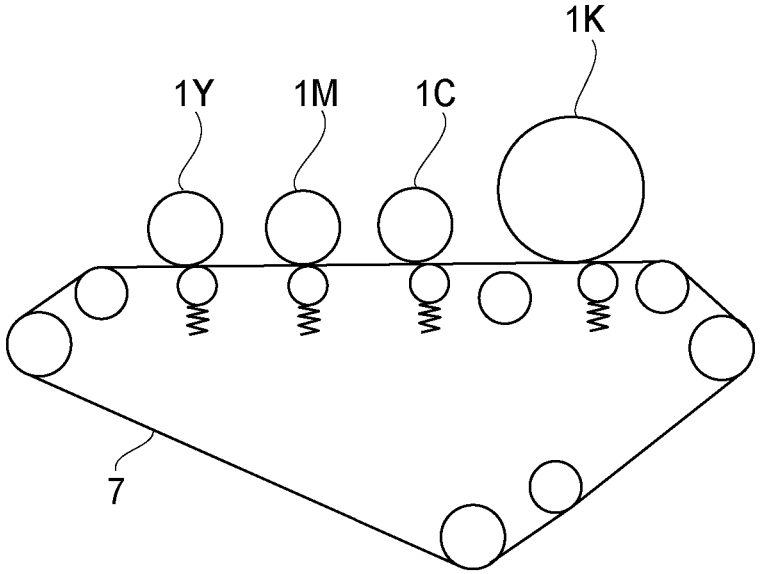
In FIG. 12, (a) and (b) are schematic views for illustrating a spacing mechanism for primary transfer portions.
Figure 12:
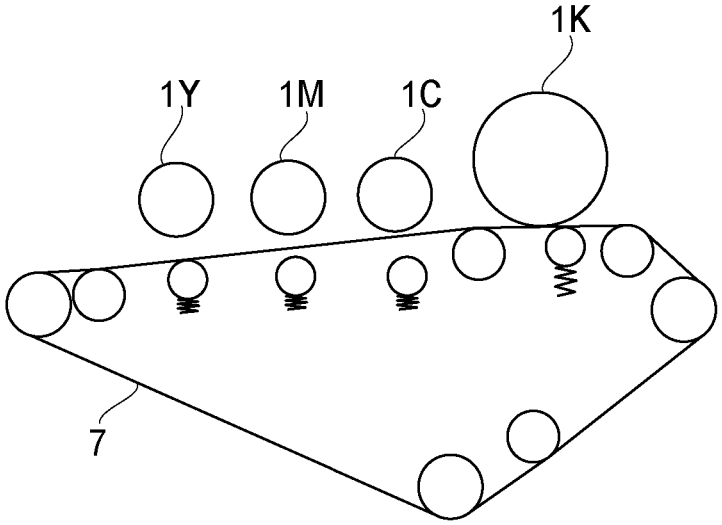

Further, as described in Embodiment 2 with reference to FIG. 12, in some cases, the image forming apparatus 100 includes the spacing mechanism capable of spacing, for example, the intermediary transfer belt 7 from the photosensitive drums 1 of the YMC image forming portions SY, SM, SC, in the operation in the monochromatic mode. In this case, when the speed instruction value adjustment is made at the K image forming portion SK, the photosensitive drum 1 and the intermediary transfer belt 7 are spaced from each other at the YMC image forming apparatus SY, SM, SC, and then the operations of the photosensitive drums 1 and the developing devices may also be stopped. Thus, the image forming apparatus 100 may include the spacing mechanism as the spacing means capable of spacing the feeding member 7 from the image bearing members 1 other than the image bearing member during execution of the detecting operation described above. In this case, for example, first, the speed instruction value adjustment for the photosensitive drum 1 at the K image forming portion SK is made, and thereafter the speed instruction values for the photosensitive drums 1 at the YMC image forming portions SY, SM, SC are successively adjusted similarly as in the above-described embodiment. Further, in the case where a constitution in which the photosensitive drums 1 at the image forming portions and the intermediary transfer belt 7 can be individually contacted to and spaced from each other is employed, it is possible to space the photosensitive drum 1 and the intermediary transfer belt 7 from each other at any of the image forming portions S other than the image forming portion S where the speed instruction value adjustment is made.

Further, for example, in the case where only the photosensitive drum 1 at a specific image forming portion S is exchanged, similarly as described above, the speed instruction value adjustment may only be required to be made only at the objective image forming portion S. As a result, there is no need to uselessly make the speed instruction value adjustment at all of the image forming portions S. Thus, the image forming apparatus 100 includes, in the control means 110, a designating means, such as an operating portion, for designating the image bearing member 1, of the plurality of image bearing members 1, for which the above-described detecting operation is executed. The control means 100 executes the detecting operation for the image bearing member 1, of the plurality of image bearing members, designated by the designating means, so that the setting of the speed instruction value for the photosensitive drum 1 during the image formation can be made.

As described above, according to this embodiment, irrespective of the friction coefficient between the intermediary transfer belt 7 and the photosensitive drum 1, the speed instruction value where the surface speeds of the photosensitive drum 1 and the intermediary transfer belt 7 are equal to each other can be acquired individually at the respective image forming portions S, so that it is possible to set an optimum speed instruction value during the image formation.

Other Embodiments

The present invention was described above based on the specific embodiments, but is not limited to the above-described embodiments.

In the above-described embodiments, in the operation in the speed instruction value adjusting mode, the speed instruction value for the intermediary transfer belt was fixed, and then the output torque of the ITB driving motor was measured. However, the present invention is not limited thereto, but the output torque of the drum driving motor may also be measured after the speed instruction value for the intermediary transfer belt is changed and the speed instruction value for the photosensitive drum is fixed. Further, in the above-described embodiments, the speed instruction value for the photosensitive drum during the image formation is adjusted, but the speed instruction value for the intermediary transfer belt during the image formation may also be adjusted. However, in the case where the speed of the intermediary transfer belt is changed, the speed relative to the recording material changes and thus the image expands and contracts in some cases, and therefore, the speed of the photosensitive drum may preferably be changed.

Figure 27:
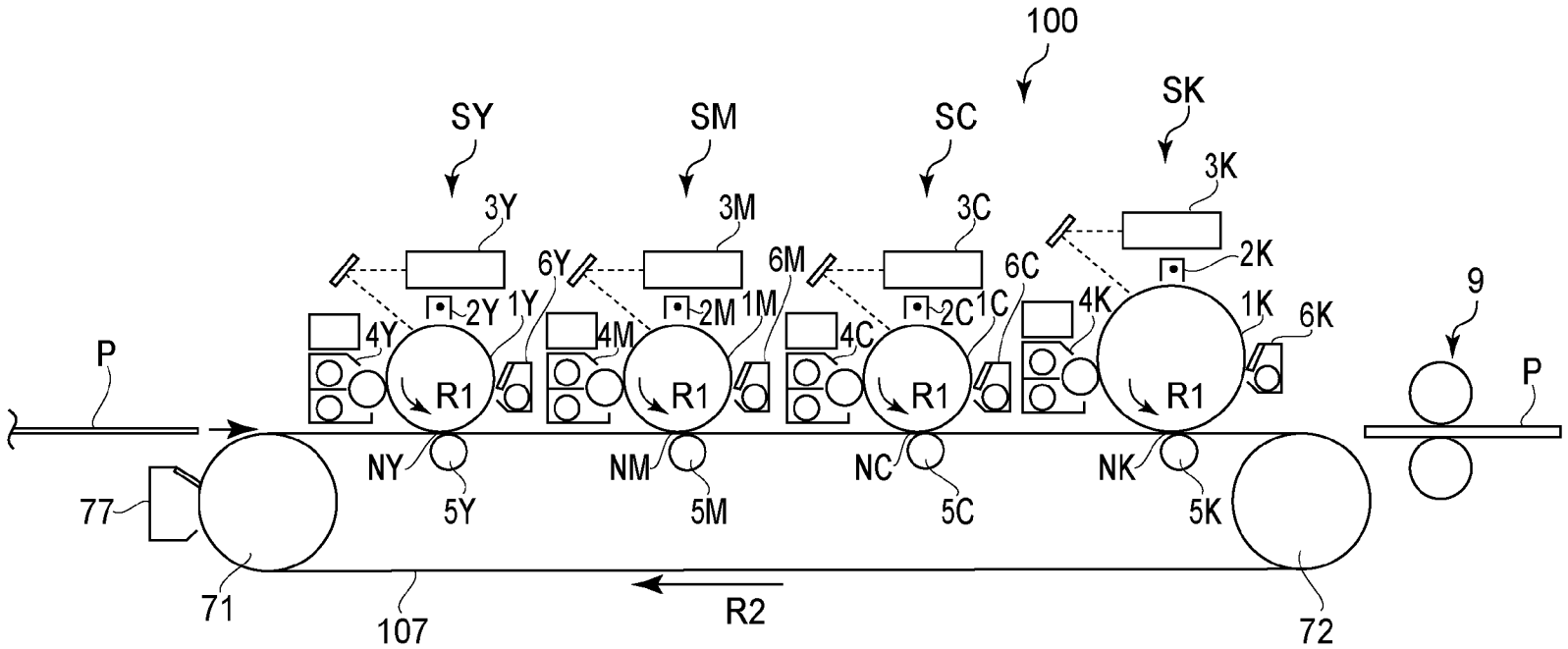
FIG. 27 is a schematic sectional view of another image forming apparatus.

In the above-described embodiments, the image forming apparatus of the intermediate transfer type was described as an example, but the present invention is also applicable to an image forming apparatus of a direct transfer type. FIG. 27 is a schematic sectional view of a principal part of the image forming apparatus of the direct transfer type. In FIG. 27, elements having the same or corresponding functions or constitutions are represented by the same reference numerals or symbols. The image forming apparatus 100 in FIG. 27 includes, in place of the intermediary transfer belt 7, a recording material carrying belt 107 constituted by an endless belt as a recording material carrying member. The recording material carrying belt 107 is an example of a rotatable feeding member for carrying the recording material onto which the toner images are transferred from the image bearing members while contacting the image bearing member. In the image forming apparatus 100 in FIG. 27, each of toner images formed on the photosensitive drums 1 at the image forming portions S is transferred at the transfer portions N onto the recording material P carried and fed on the recording material carrying belt 107. Also in such an image forming apparatus 100 of the direct transfer type, similarly as in the case of the image forming apparatus of the intermediary transfer type in the above-described embodiments, the surface speed difference between the photosensitive drum 1 and the recording material carrying belt 107 may desirably be controlled to a desired value with high accuracy. Accordingly, the present invention is also applicable to the image forming apparatus of the direct transfer type, and effects similar to those in the above-described embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-040785 filed on Mar. 2, 2015, which is hereby incorporated by reference herein in its entirety.

What is claimed is:

1. An image forming apparatus comprising:

a rotatable image bearing member for bearing a toner image;

a toner image forming portion configured to form the toner image on said image bearing member;

a rotatable intermediary transfer member, contacting said image bearing member at a transfer portion, and configured to carry the toner image transferred from said image bearing member at the transfer portion and then to be transferred onto a recording material;

a first driving motor configured to rotationally drive said image bearing member;

a second driving motor configured to drive said intermediary transfer member;

a detecting portion configured to detect information on an output torque of said first driving motor or said second driving motor;

a changing portion configured to change a speed instruction value of each of driving speeds of said first driving motor and said second driving motor;

an executing portion configured to execute an operation in a detecting mode in which information on the output torque of another driving motor corresponding to the speed instruction value of one driving motor is detected while driving said first driving motor and said second driving motor in a period other than during image formation, wherein the detecting mode includes a first detection period in which a state relating to a frictional force between said image bearing member and said intermediary transfer member at the transfer portion is set at a first state and then the detection is made, and includes a second detection period in which the state is set at a second state greater in the frictional force than in the first state and then the detection is made, wherein in each of the first and second detection periods, the speed instruction value of the other driving motor is set at a fixed value, wherein in the first detection period the speed instruction value of the one driving motor is successively changed to a plurality of different values and information on plural output torque values of the one driving motor corresponding to the different speed instruction values is successively detected, and wherein in the second detection period the speed instruction value of the one driving motor is successively changed to a plurality of different values and information on plural output torque values of the one driving motor corresponding to the plurality of different speed instruction values is successively detected; and a setting portion configured to set the speed instruction value of the one driving motor to be used during the image formation on the basis of the information on plural output torque values detected in the first detection period and the information on plural output torque values detected in the second detection period.

2. An image forming apparatus according to claim 1, wherein said executing portion forms the first state by executing, in the first detection period, a supplying operation for supplying toner to said image bearing member in an amount per unit area not less than a predetermined amount per unit area and forms the second state by not executing the supplying operation in the second detection period.

3. An image forming apparatus according to claim 2, further comprising a cleaning member, contacting said intermediary transfer member, configured to remove the toner from said intermediary transfer member with rotation of said intermediary transfer member, wherein said executing portion ends the first detection period when the toner supplied to said image bearing member in the first detection period is fed by said intermediary transfer member and reaches a contact portion between said cleaning member and said intermediary transfer member.

4. An image forming apparatus according to claim 3, wherein said executing portion starts the second detection period after a region on said intermediary transfer member where the toner supplied to said image bearing member in the first detection period is deposited passes through a contact portion between said cleaning member and said intermediary transfer member.

5. An image forming apparatus according to claim 1, further comprising:

a transfer roller configured to form an electric field at the transfer portion, wherein said executing portion causes said transfer roller to form the electric field at the transfer portion in both of the first detection period and the second detection period.

6. An image forming apparatus according to claim 1, wherein said intermediary transfer member is an endless belt stretched by a plurality of stretching rollers, wherein said image forming apparatus comprises an adjusting portion configured to adjust a traveling position of said belt with respect to a widthwise direction by tilting at least one stretching roller of said plurality of stretching rollers, and wherein said adjusting portion does not adjust the traveling position during the detecting mode.

7. An image forming apparatus according to claim 1, wherein said executing portion executes a detecting operation configured to detect the information for the one driving motor or the other driving motor in each of the first state and the second state in a first image forming job in which each of the speed instruction values of said first driving motor and said second driving motor is set at a predetermined speed instruction value, and thereafter repetitively executes the detecting operation in an image forming job executed after the first image forming job, and executes the detecting mode when a difference in the information between the first state and the second state exceeds a predetermined threshold.

8. An image forming apparatus according to claim 1, wherein said executing portion changes the speed instruction value of the one driving motor in a range including the speed instruction value of the one driving motor where detection results of said detecting portion in the first detection period and the second detection period are equal to each other.

9. An image forming apparatus according to claim 1, wherein said executing portion acquires the speed instruction value of the one driving motor where detection results of said detecting portion in the first detection period and the second detection period are equal to each other, and sets the speed instruction value of the one driving motor on the basis of the speed instruction value.

10. An image forming apparatus according to claim 1, wherein the information on the output torque of the other driving motor detected by said detecting portion is information on a driving current value or a driving voltage value for driving the other driving motor.

11. An image forming apparatus comprising:

a plurality of rotatable image bearing members configured to bear toner images;

a plurality of toner image forming portions configured to form the toner images on said plurality of image bearing members, respectively;

a rotatable intermediary transfer member, contacting said plurality of image bearing members at a plurality of transfer portions, respectively, and configured to carry the toner images transferred from said image bearing members at the plurality of transfer portions and then to be collectively transferred onto a recording material;

a plurality of first driving motors configured to rotationally drive said plurality of image bearing members, respectively;

a second driving motor configured to rotationally drive said intermediary transfer member;

a detecting portion configured to detect information on an output torque of said plurality of first driving motors or said second driving motor;

a changing portion configured to change a speed instruction value of each of driving speeds of said plurality of first driving motors and said second driving motor;

an executing portion configured to execute an operation in a detecting mode in which information on the output torque of said second driving motor corresponding to the speed instruction value of a specific first driving motor of said plurality of first driving motors is detected while driving said plurality of first driving motors and said second driving motor in a period other than during image formation, wherein the detecting mode includes a first detection period in which a state relating to a frictional force between a specific image bearing member corresponding to the specific first driving motor and said intermediary transfer member at the transfer portion is set at a first state and then the detection is made, and includes a second detection period in which the state is set at a second state greater in the frictional force than in the first state and then the detection is made, wherein in each of the first and second detection periods, the speed instruction value of said second driving motor is set at a fixed value, wherein in the first detection period the speed instruction value of the specific first driving motor is successively changed to a plurality of different values and information on plural output torque values of the specific first driving motor corresponding to the different speed instruction values is successively detected, and wherein in the second detection period the speed instruction value of the specific first driving motor is successively changed to a plurality of different values and information on plural output torque values of the specific first driving motor corresponding to the plurality of different speed instruction values is successively detected; and a setting portion configured to set the speed instruction value of the specific first driving motor to be used during the image formation on the basis of the information on plural output torque values detected in the first detection period and the information on plural output torque values detected in the second detection period.

12. An image forming apparatus according to claim 11, wherein said executing portion forms the first state by executing, in the first detection period, a supplying operation for supplying toner to said image bearing member in an amount per unit area not less than a predetermined amount per unit area and forms the second state by not executing the supplying operation in the second detection period.

13. An image forming apparatus according to claim 12, further comprising:

a plurality of transfer rollers configured to form electric fields at the plurality of transfer portions, respectively, wherein said executing portion causes said plurality of transfer rollers not to form the electric fields at the transfer portions corresponding to image bearing members other than said specific image bearing member when the information on said second driving motor corresponding to the speed instruction value of the specific first driving motor is detected.

14. An image forming apparatus according to claim 11, wherein said executing portion causes the toner to exist at the transfer portions corresponding to image bearing members other than the specific image bearing member when the information on said second driving motor corresponding to the speed instruction value of the specific first driving motor is detected.

15. An image forming apparatus according to claim 11, further comprising:

a processing portion configured to perform a series of processes in which the setting is made by executing the detecting mode sequentially from an upstream side image bearing member to a downstream side image bearing member with respect to a rotational direction of said intermediary transfer member.

16. An image forming apparatus according to claim 15, wherein in the series of processes, when the information on said second driving motor corresponding to the speed instruction value of the specific first driving motor is detected, the speed instruction value of said first driving motor, the image bearing member for which the setting has already been completed in the series of processes, is set at a value where detection results of said detecting portions in the first detection period and the second detection period are equal to each other.

* * * * *